United States Patent [19]

Crowe et al.

[11] 4,085,566

[45] Apr. 25, 1978

[54] MACHINE FOR STACKING AND CASING ARTICLES

[75] Inventors: Norman P. Crowe, Miami Township, Clermont County; Joseph M. Lohse, Terrace Park, both of Ohio

[73] Assignee: Multifold-International, Inc., Milford, Ohio

[21] Appl. No.: 778,129

[22] Filed: Mar. 16, 1977

[51] Int. Cl.[2] ..... B65B 63/02; B65B 57/10; B65B 35/50

[52] U.S. Cl. ..... 53/124 D; 53/59 R; 53/77; 53/159; 214/6 H

[58] Field of Search ..... 53/124 D, 159, 59 R, 53/77; 214/6 H

[56] References Cited

U.S. PATENT DOCUMENTS

| | | | |
|---|---|---|---|
| 3,532,230 | 10/1970 | Gutberlet et al. | 214/6 H |
| 3,533,213 | 10/1970 | Lloyd | 53/159 X |
| 3,643,816 | 2/1972 | Jacobsen | 214/6 H |

*Primary Examiner*—Travis S. McGehee
*Attorney, Agent, or Firm*—James W. Pearce; Roy F. Schaeperklaus

[57] ABSTRACT

A machine for arranging flat articles in a stack and for placing the stack in a case. The machine includes endless flight supports mounted on opposite sides of a stack forming station and opposed flights mounted on the flight supports for supporting a stack of the articles therebetween. The stack is formed on the flights. The flights are lowered as the stack builds up thereon until a complete stack has been formed. The complete stack is lowered onto stack supports. First pusher means advance the complete stack from the stack supports onto a turntable having a pile face. A second stack starts to form on second flights as the first pusher means advances the complete stack from the stack supports and returns to a position for engaging the second stack when the second stack reaches the stack supports. The turntable can be turned 90° and the stack is discharged from the turntable crosswise of the path of stack advance from the stack supports to the turntable. A case support holds a case with an open end of the case in the path of discharge of the stack from the turntable. Side guides are resiliently supported from side guide supports which overlie the turntable. Lower edges of the side guides are releasably held down against the pile face of the turntable.

19 Claims, 29 Drawing Figures

14
20
22
48R
50R
54R
64R
374
390
396
372
376
370
210
380
378
384
386
388
LS-4A
LS-6
LS-4
LS-1
138A
138B
138C
138D
134R
134L
196A
196B
196C
202R
202L
204A
204B
204C
204D
294R
294L
128
130
131
136
140
142
146
148
150
154
166
170
172
176
178
180
182
184
186
188
190
192
194
196
198
202
204
206
208
212
214
216
218
220
221
222
224
228
230
232
234
240
242
244
246
248
250
252
254
256
258
270
272
274
276
278
280
284
286
288
290
292
296
298
300
302
304
306
308
310
312
318
320
322
324
326
328
330
334
336
338
340
342
348
350
352
356
358
362
364
366
398
48L
50L
54L
64L
68

FIG. 8
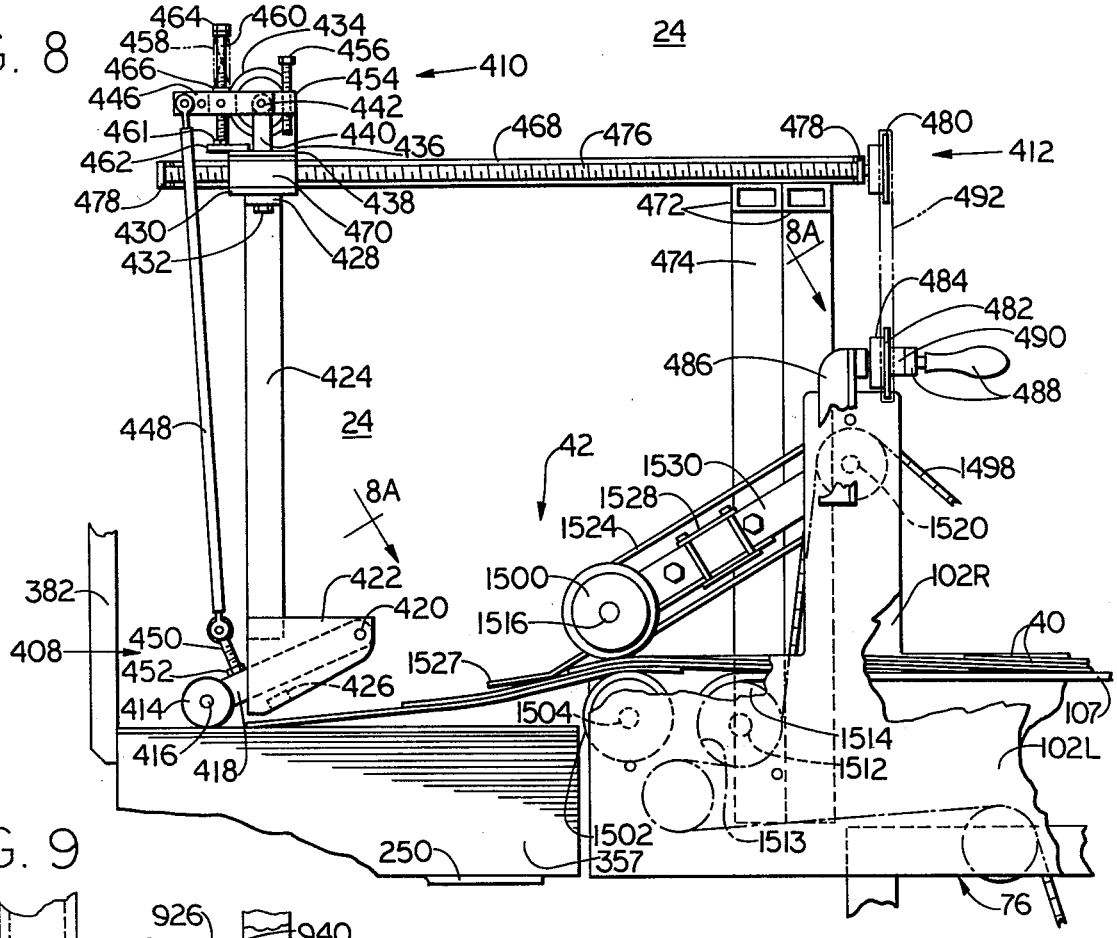
FIG. 9
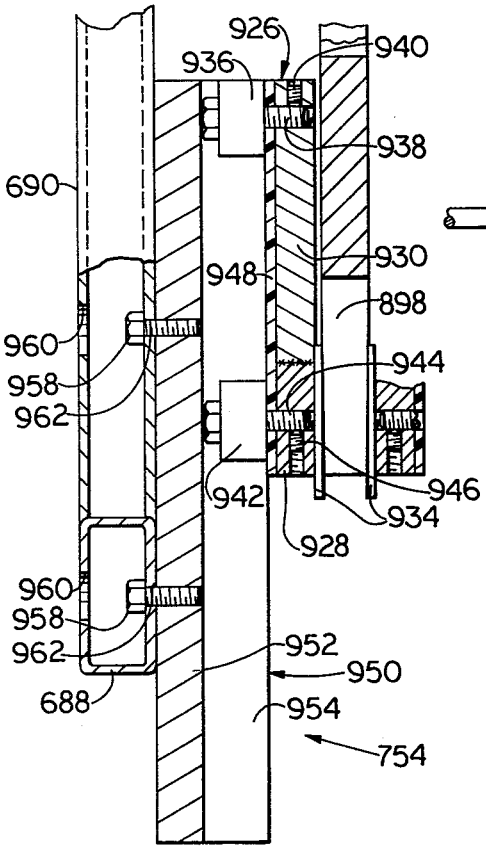
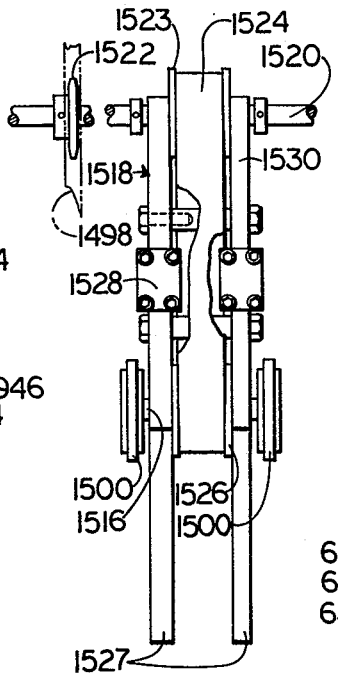
FIG. 8A
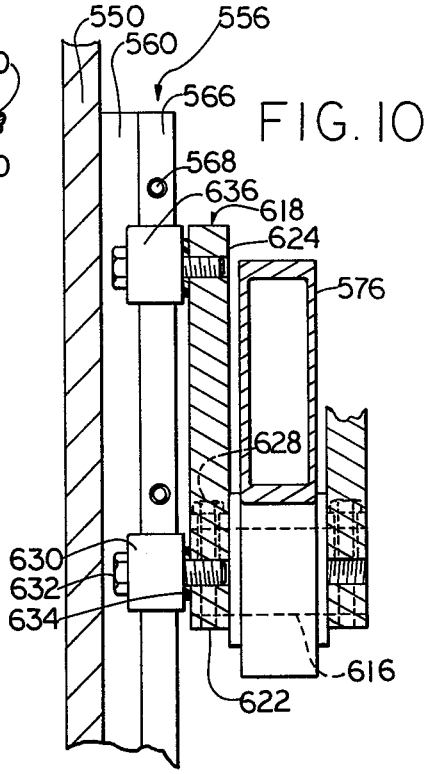
FIG. 10

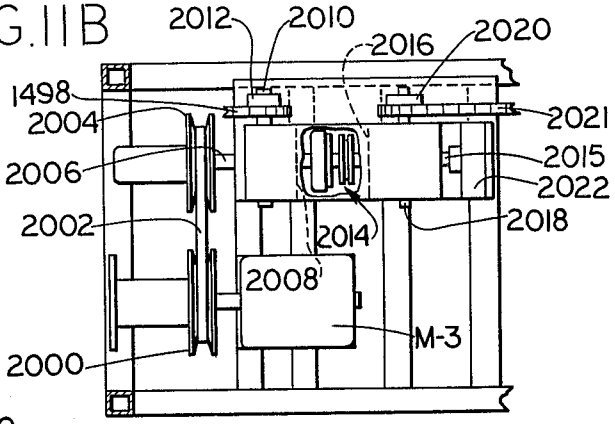
FIG. IIB
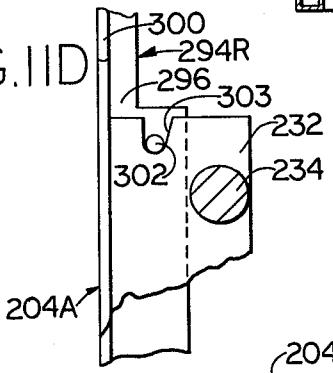
FIG. IID
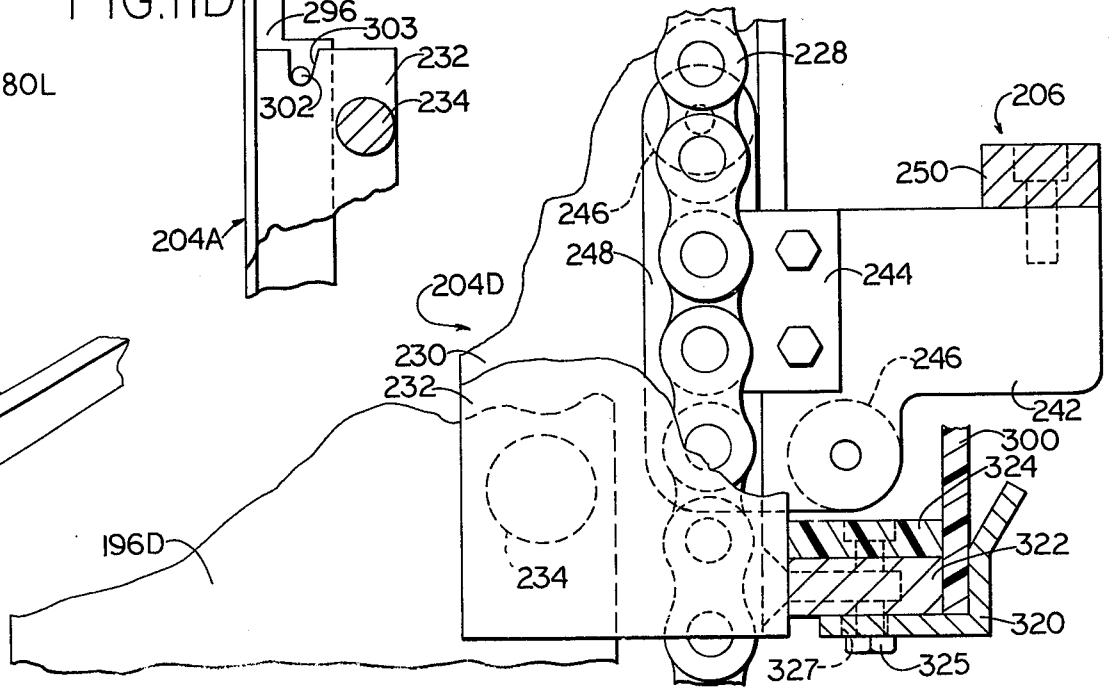
FIG. IIC
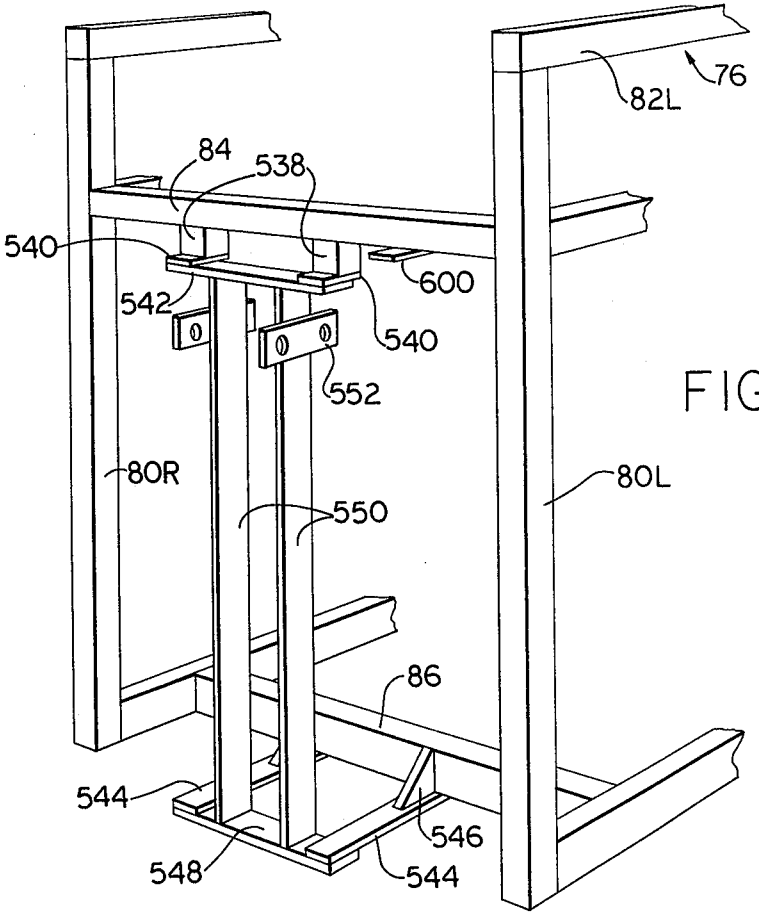
FIG. IIA

LEFT SIDE

MACHINE FOR STACKING AND CASING ARTICLES

This invention relates to a machine for arranging flat articles such as flattened cartons in a stack and for inserting the stack in a case.

An object of this invention is to provide a machine which arranges flat articles in an upright stack on elevator flights on which opposed edges of the stack are supported.

A futher object of this invention is to provide such a machine in which the stack, when completed, is removed from a stack forming area while still within the confines of the elevator and in which a new stack starts to form as the first stack is being removed from the elevator.

A further object of this invention is to provide such a machine in which the stack is lowered by the flights onto horizontal stack supports and is then removed from the elevator in a horizontal direction while the new stack starts to form.

A further object of this invention is to provide such a machine in which the flights of the elevator pass the horizontal stack supports and then return upwardly to stack starting position and in which the new stack forms on a second set of flights while the first set of flights is returning.

A further object of this invention is to provide such a machine in which the articles are discharged from the stack supports onto a turntable which turns through an angle of 90° so that the stack can be discharged crosswise of the direction of discharge from the elevator flights following turning of the stack on the turntable.

A further object of this invention is to provide such a machine in which the turntable has a soft, resilient rug surface across which the stack is advanced.

A further object of this invention is to provide such a machine in which there are side guide members above the turntable and guide supports for the side guide members mounted above the turntable which are movable to adjust the position of the side guide members.

A further object of this invention is to provide such a machine in which there is means for releasably holding lower edges of the side guide members against the rug surface of the turntable in selected position so that articles cannot be displaced underneath the side guide members.

A further object of this invention is to provide such a machine in which a pusher device, which discharges the stack from the turntable, is mounted on and turns with the turntable.

A further object of this invention is to provide such a machine in which one of the side guide members is removable and the turntable can be positioned for discharge of the stack when the stack is being advanced onto the turntable so that the stack can be discharged from the turntable without turning of the stack.

Briefly, this invention provides a machine in which flat articles are delivered shingle-fashion to a stack-forming station at which a stack is formed on opposed first flights of an elevator. Portions adjacent to edges of the lowermost article of the stack are supported on the first flights, and the first flights descend as the stack increases in height so that the level of the top of the stack remains constant during forming of the stack. When a stack has been formed, the first flights deposit the stack on stack supports which support edge portions of the lowermost article and also a central portion thereof. The first flights pass the stack supports as a second stack starts to form on second flights of the elevator. As the second stack starts to be formed, a first pusher pushes the first stack horizontally onto a turntable. The first pusher returns before the second stack is of sufficient size to interfere with the first pusher. When the first pusher has been retracted, the turntable can turn 90°. A stack compressor urges the top of the stack downwardly to hold the stack in position on the turntable. A second pusher pushes the stack crosswise of the direction of advance of the first pusher into a case, which is supported on a tipover table at one side of the machine. The compressor guides the top of the stack into the case. The case is held in place on the tipover table by vacuum cup means. When the stack has been advanced into the case, the tipover table swings to set the case in upright position, and the case can be removed.

The above and other objects and features of the invention will be apparent to those skilled in the art to which this invention pertains from the following detailed description and the drawings, in which:

FIG. 8 is a fragmentary partly schematic view in side elevation, partly broken away and in section showing operation of the elevator section;

FIG. 8A is a fragmentary view taken in the direction of the arrows 8A—8A in FIG. 8, showing an upper nip roll assembly of the machine;

FIG. 9 is a fragmentary view in section taken on an enlarged scale on the line 9—9 in FIG. 13;

FIG. 10 is a view in section taken on an enlarged scale on the line 10—10 in FIG. 11;

FIG. 11A is a fragmentary perspective view of a pusher frame assembly of the machine;

FIG. 11B is a view in section taken on the line 11B—11B in FIG. 1;

FIG. 11C is a fragmentary view in upright section showing details of a flight and a stack support of the elevator section of the machine;

FIG. 11D is a fragmentary view in section showing details of mounting of a side guide assembly;

Figure 1:
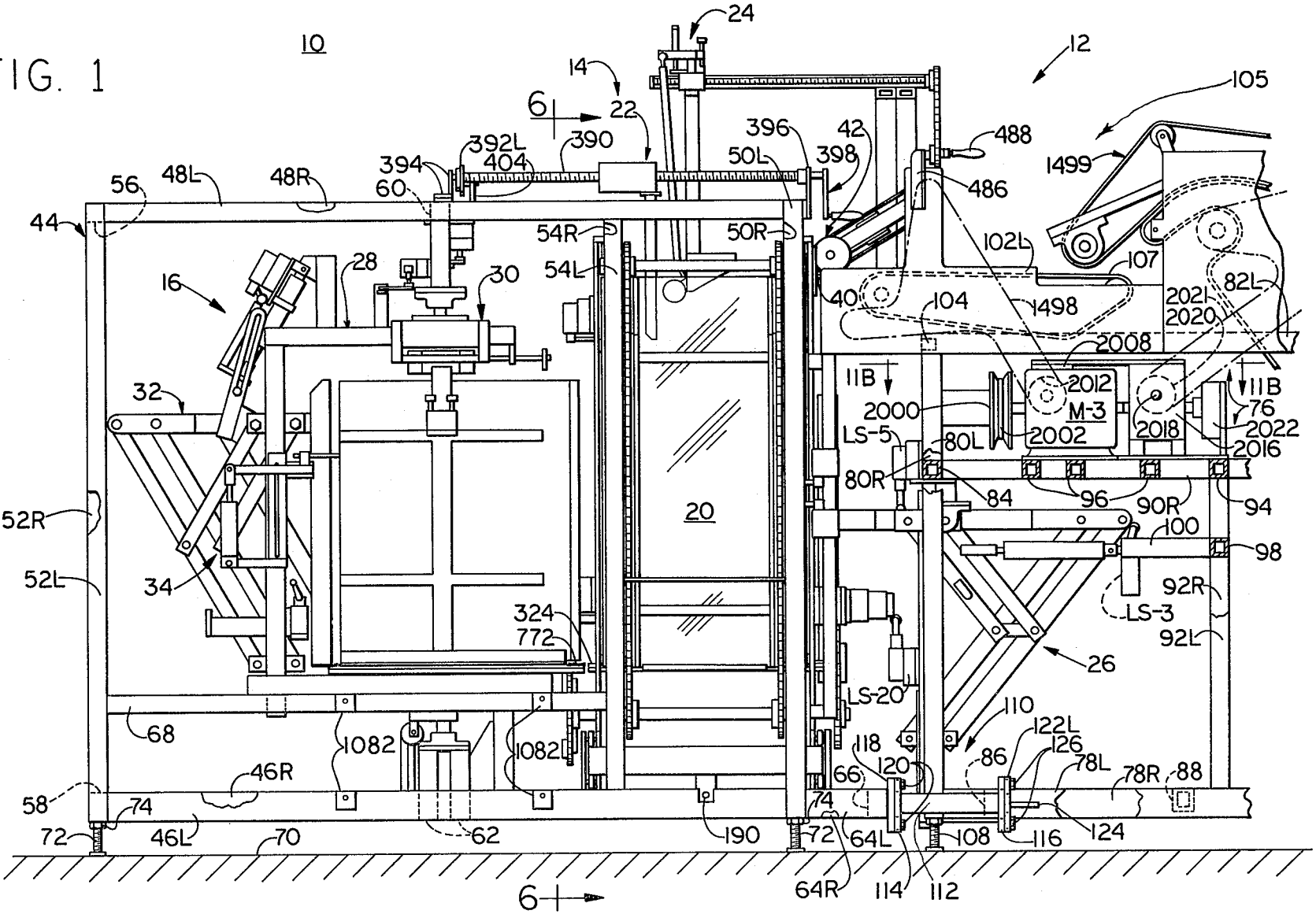
FIG. 1 is a somewhat schematic view in side elevation of a carton packing machine constructed in accordance with an embodiment of this invention, parts being broken away to reveal details of construction, a turntable being shown in a first position.

In the following detailed description and the drawings, like reference characters indicate like parts. FIG. 1 shows a dual purpose packing machine 10 which is constructed in accordance with an embodiment of this invention.

The packing machine 10 is used in conjunction with a carton assembling machine 12, only the output end of which is shown in FIG. 1. The dual purpose packing machine 10 is comprised of a stacking assembly 14, a stack output assembly 16 and a case packing assembly 18 as is shown in FIG. 3. Referring to FIG. 1, the stacking assembly 14 is comprised of an elevator assembly 20, a fence assembly 22, a rate valve assembly 24, and a number 1 pusher assembly 26. The rate valve assembly 24 and the number 1 pusher assembly 26 are mounted on the framework of the carton assembling machine 12, as will be described hereinafter. The stack output assembly 16 is comprised of a turntable assembly 28, a side guide assembly 30, an adjustable number 2 pusher assembly 32 and a compressor assembly 34. Now referring to FIG. 2, the case packing assembly 18 is comprised of a flap holding assembly 36 and a corrugated case output assembly 38.

A definition of logistical terms is now in order. The reader, in viewing FIG. 1 is looking at the left side of the packing machine 10, which is also known as the output side of the machine. A procession of flattened cartons 40, one of which is shown in FIG. 3, enters the dual purpose packing machine 10 from a nip roll assembly 42 (FIG. 1) of the carton assembling machine 12 and, in general, travels lengthwise of the machine as indicated by the arrow 43 in FIG. 3 and exits laterally to the left side thereof from the stack output assembly 18 as indicated by the arrow 43A. The end of the packing machine 10 to the right side of FIG. 1 is the input end.

MECHANICAL DESCRIPTION - FRAME

Figure 2:
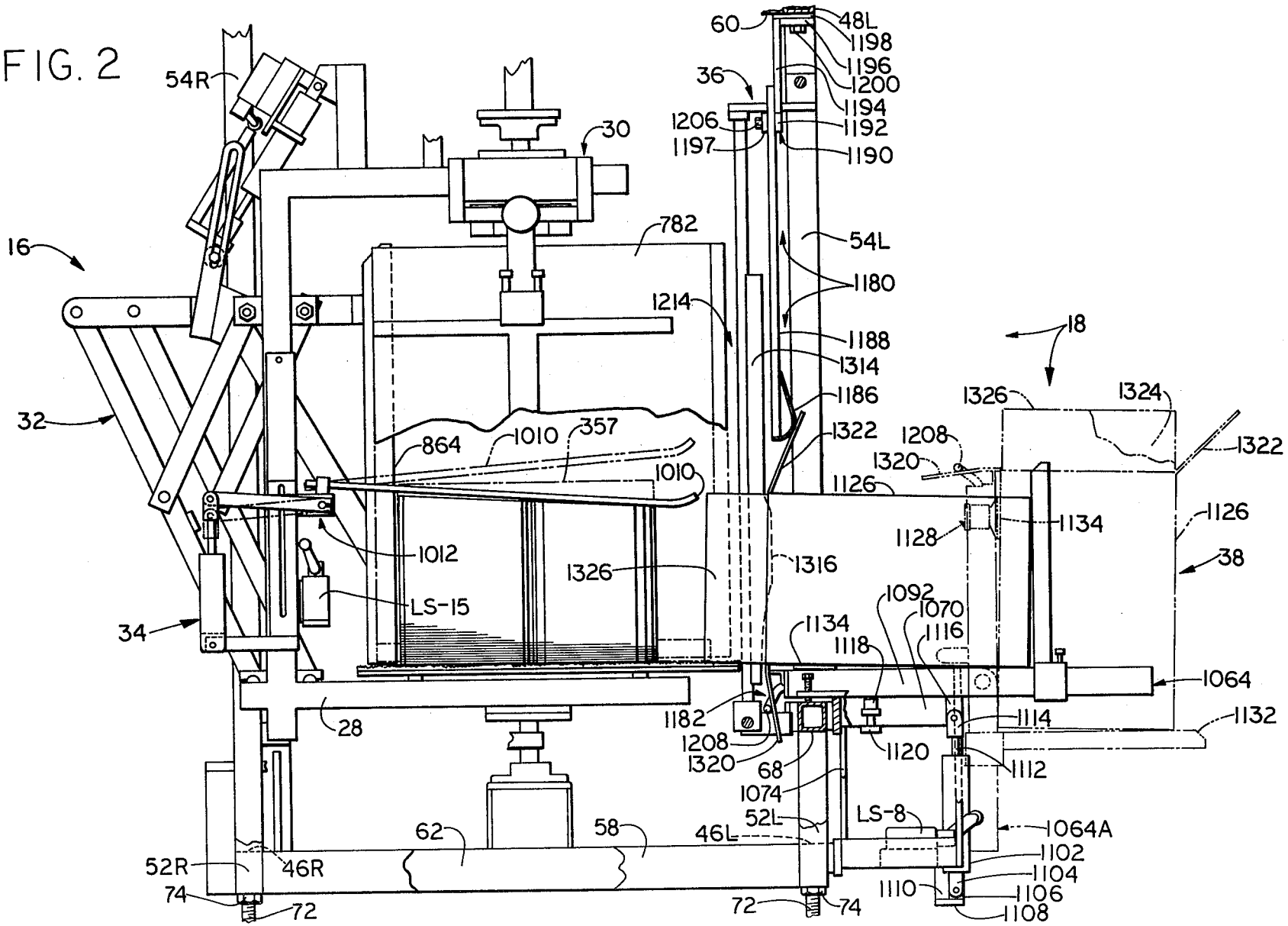
FIG. 2 is a view in end elevation on an enlarged scale of a turntable section of the machine partly broken away and in section, a raised position of compressor rods being shown in dot-dash lines, the turntable being shown in a second position.
Figure 3:
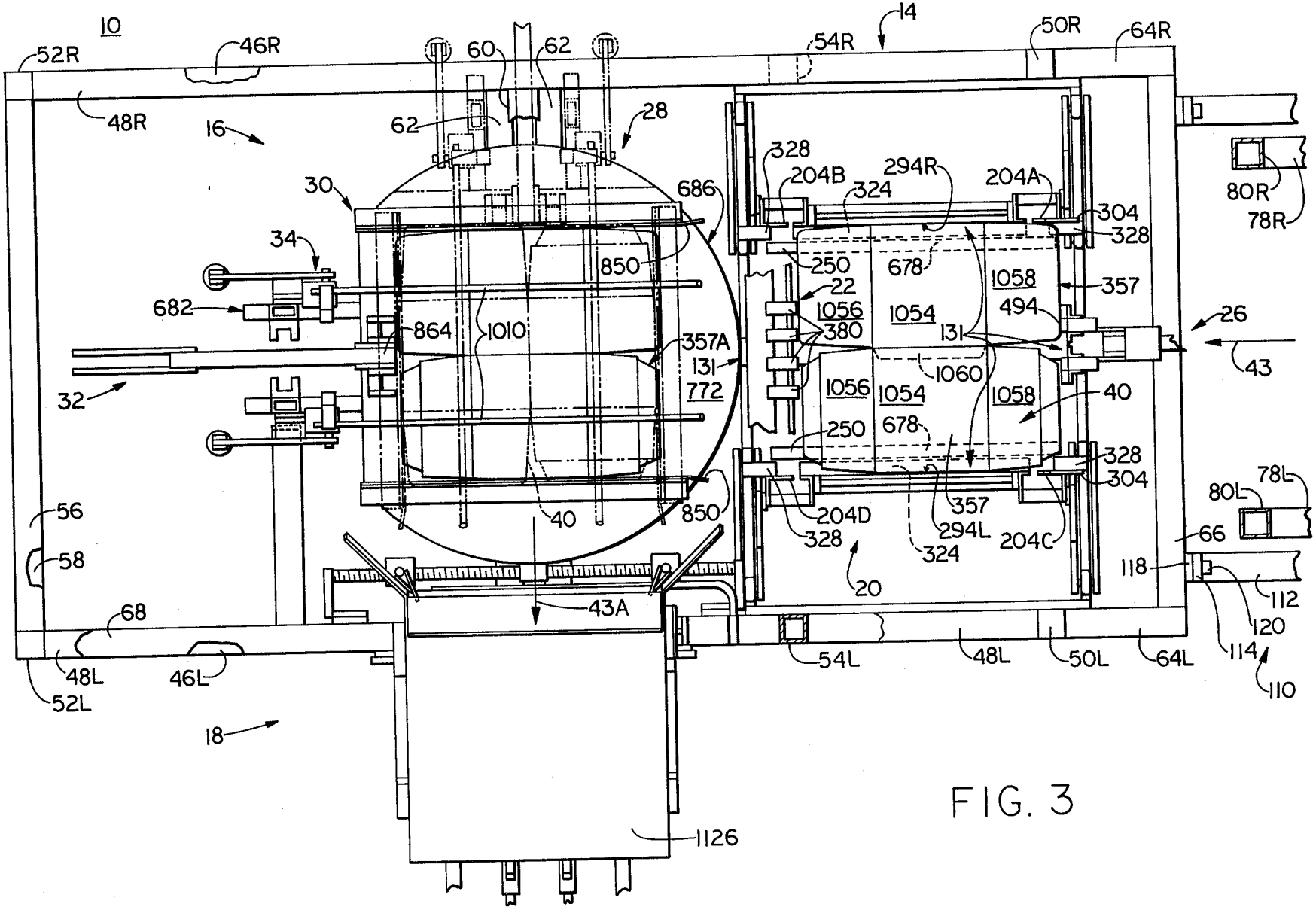
FIG. 3 is a fragmentary plan view of the machine partly broken away and in section, the turntable being shown in its first position in full lines and in its second position in double-dot-dash lines, stacks of cartons and a case being shown in association therewith.

A frame assembly 44 of the dual purpose packing machine is shown in FIGS. 1, 2 and 3, and is comprised of a pair of bottom stringers 46L and 46R and a pair of top stringers 48L and 48R, that are rigidly held in vertical spaced and parallel relationship by elevator input posts 50L and 50R and output posts 52L and 52R. Elevator output posts 54L and 54R span the bottom and top stringers to form symmetrical left and right hand sides of the frame assembly 44.

The right and left hand sides of the frame assembly 44 are rigidly held in lateral spaced and parallel relationship by a top output lateral stiffener 56, a bottom output lateral stiffener 58, a top middle lateral stiffener 60, and a pair of bottom middle lateral stiffeners 62. The input extremity of the frame assembly 44 rigidly incorporates at its bottom end a pair of longitudinal frame extensions 64L and 64R. A bottom input lateral stiffener 66 spans input extremities of the pair of longitudinal frame extensions 64L and 64R. A short longitudinal beam 68 is rigidly affixed between the left hand output post 52L and the left hand elevator output post 54L.

The frame assembly 44 is supported above the floor 70 by a set of four adjustable legs 72 (FIGS. 1 and 2). The legs 72 are threaded into the closed bottoms of the output posts 52L and 52R and the elevator input posts 50L and 50R. After proper leveling of the dual purpose packing machine 10, the set of four adjustable legs 72 is set in fixed place by a set of four lock nuts 74.

Figure 4:
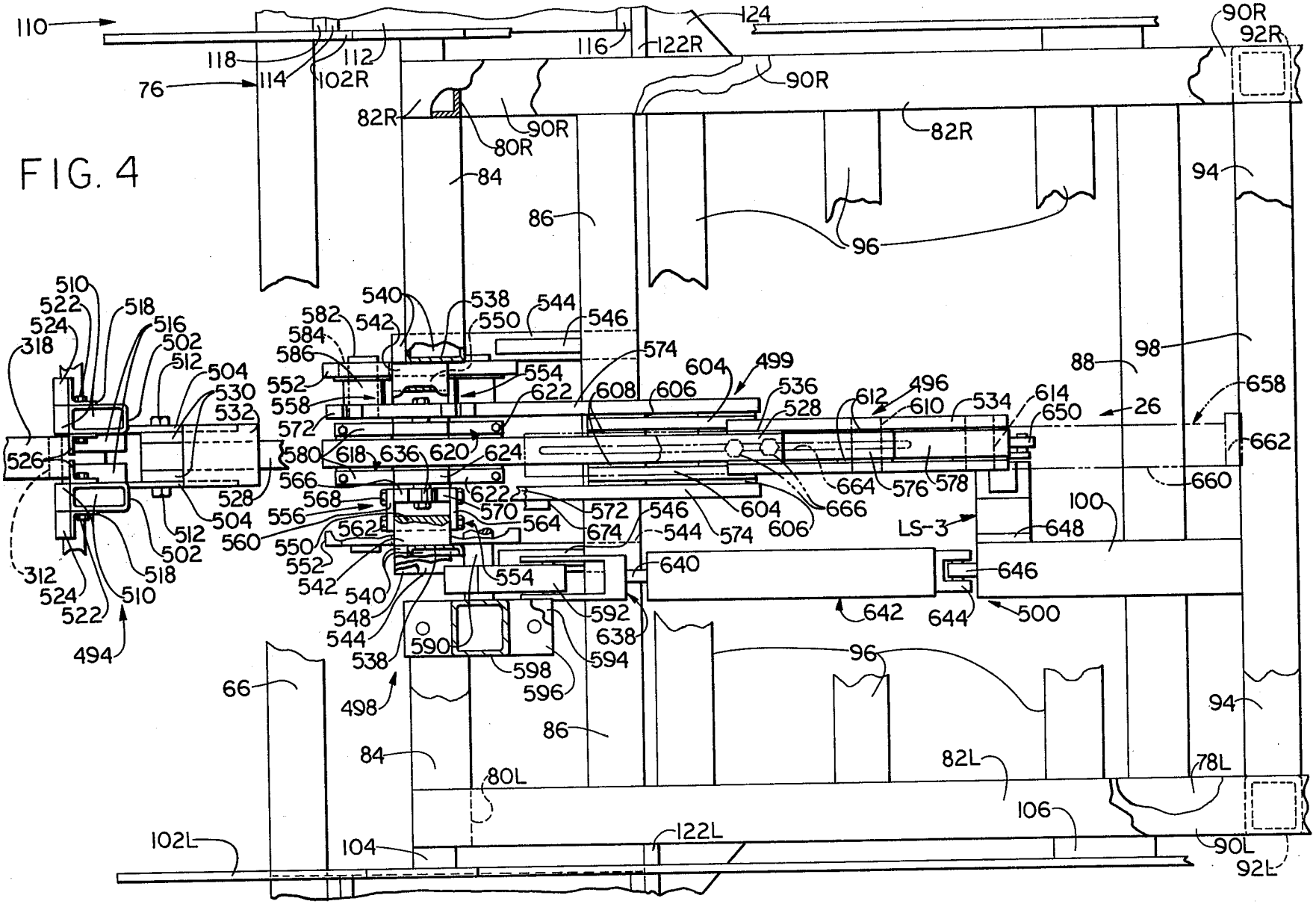
FIG. 4 is a plan view, partly broken away and in section of a pusher section of the machine, a switch actuating plate being shown in double-dot-dash lines.

The packing machine 10 is set in close longitudinal line with, and adjacent to, the output end of the carton assembling machine 12, as is shown in FIG. 1. An assembling machine framework 76, shown in FIGS. 1 and 4, is partially comprised of base stringers 78L and 78R, output risers 80L and 80R, and upper stringers 82L and 82R. The partially described assembling machine framework 76 is held in lateral spaced relationship by an upper output transverse beam 84, a base transverse beam 86, and a base middle stiffener 88. Other lateral frame members associated with the input end of the assembling machine framework 76 have been omitted. The output end of the assembling machine framework 76 also comprises a pair of middle stringers 90L and 90R whose output ends are rigidly affixed to the input faces of the pair of output risers 80L and 80R, respectively, and ajacent to the intersection of the upper output transverse beam 84. Middle riser supports 92L and 92R are mounted on the base stringers 78L and 78R and support the middle stringers 90L and 90R. A middle stiffener 94 spans the middle stringers 90L and 90R. A set of three power pack mount beams 96 is also rigidly affixed between the pair of middle stringers 90L and 90R and uniformly distributed therealong between the upper output transverse beam 84 and the middle stiffener 94. An actuator lateral mount beam 98 is rigidly affixed between the middle riser supports 92L and 92R, toward the upper ends thereof, to rigidly accommodate an actuator mount beam 100 that is in turn cantilever mounted from the output face thereof. As can be more easily seen in FIG. 4, mount plates 102L and 102R are mounted on outboard surfaces of upper stringers 82L and 82R, respectively, by a pair of output spacer blocks 104 and a pair of input spacer blocks 106. The mount plates 102L and 102R are of irregular shape and form the mounting structure for the nip roll assembly 42 and a carry-off belt assembly 105 only a portion of which is shown. The carry-off belt assembly is mounted between the pair of mount plates 102L and 102R and supports a belt conveyor 107 (FIG. 5) which advances articles to the nip roll assembly 42. The mount plates 102L and 102R also function as mounting members for the rate valve assembly 24, to be discussed in detail hereinafter. The assembling machine framework 76 is adjustable mounted upon a set of four legs 108, one of which is shown in FIG. 1.

The frame assembly 44 and the assembling machine framework 76 are fixedly held in longitudinal spaced relationship by a pair of coupling assemblies 110 shown in FIGS. 1 and 3. Each member of the pair of coupling assemblies 110 is comprised of a coupling bar 112 that rigidly incorporates at its output end a packing frame flange 114, and at its input end an assembling frame flange 116. The packing frame flange 114 is adjustably and fixedly attached to a packing frame mount plate 118 by means of a pair of bolts 120 that pass through vertical slots in the packing frame flange 114 and threadably mount into the packing frame mount plate 118. The packing frame mount plate 118 is rigidly affixed to the input face of the bottom input lateral stiffener 66, as is shown in FIG. 3. Assembling frame mount plates 122L (FIG. 1) and 122R (FIG. 4) are rigidly affixed along inboard edges to the outboard surfaces of the pair of base stringers 78L and 78R, respectively, adjacent to the intersection of the base transverse beam 86. Perpendicularlity between the assembling frame mount plates 122L and 122R and the base stringers 78L and 78R is assured by a pair of gussets 124. The assembling frame flange 116 is fixedly attached to its respective member of the pair of assembling frame mount plates 122L and 122R by bolts 126 that pass through vertical slots within each member of the pair of assembling frame mount plates 122 and threadably mount into the assembling frame flange 116. In this manner, the frame assembly 44 and the assembling machine framework 76 can be fixedly coupled after each have been set up and leveled. Vertical alignment of the base of each framework with respect to each other is not necessary.

STACKING ASSEMBLY

The stacking assembly 14 is specifically shown in FIGS. 5–11. The stacking assembly 14 is comprised of the elevator assembly 20, the fence assembly 22, the rate valve assembly 24 and the pusher assembly 26, as shown in FIG. 1.

The elevator assembly 20 (FIGS. 5, 6 and 7) is made up of an adjustable elevator frame assembly 128, a lift assembly 132, an elevator side guide assembly 130 and an elevator floor assembly 131.

Figure 5:
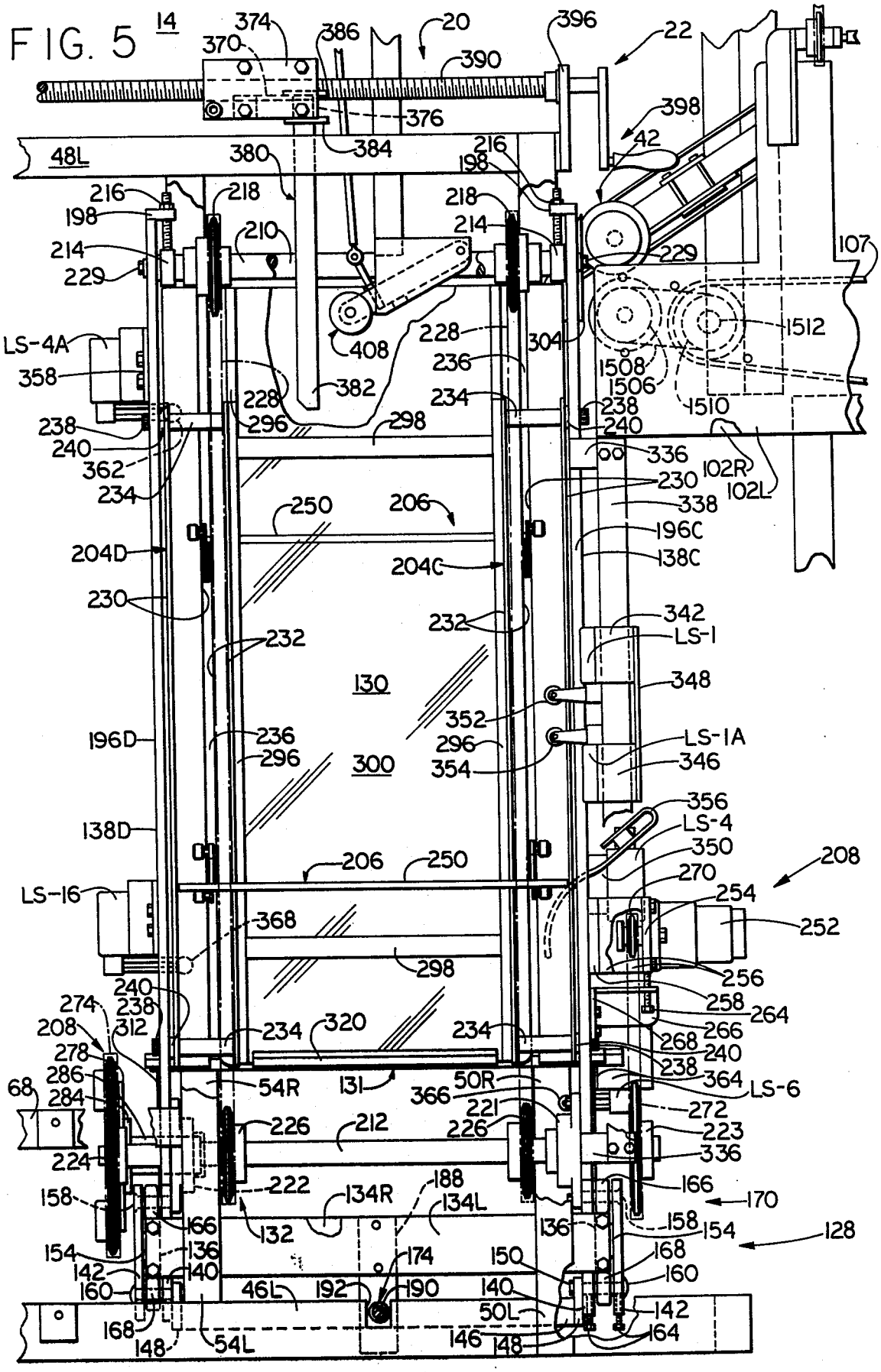
FIG. 5 is a view in side elevation of an elevator section of the machine.
Figure 6:
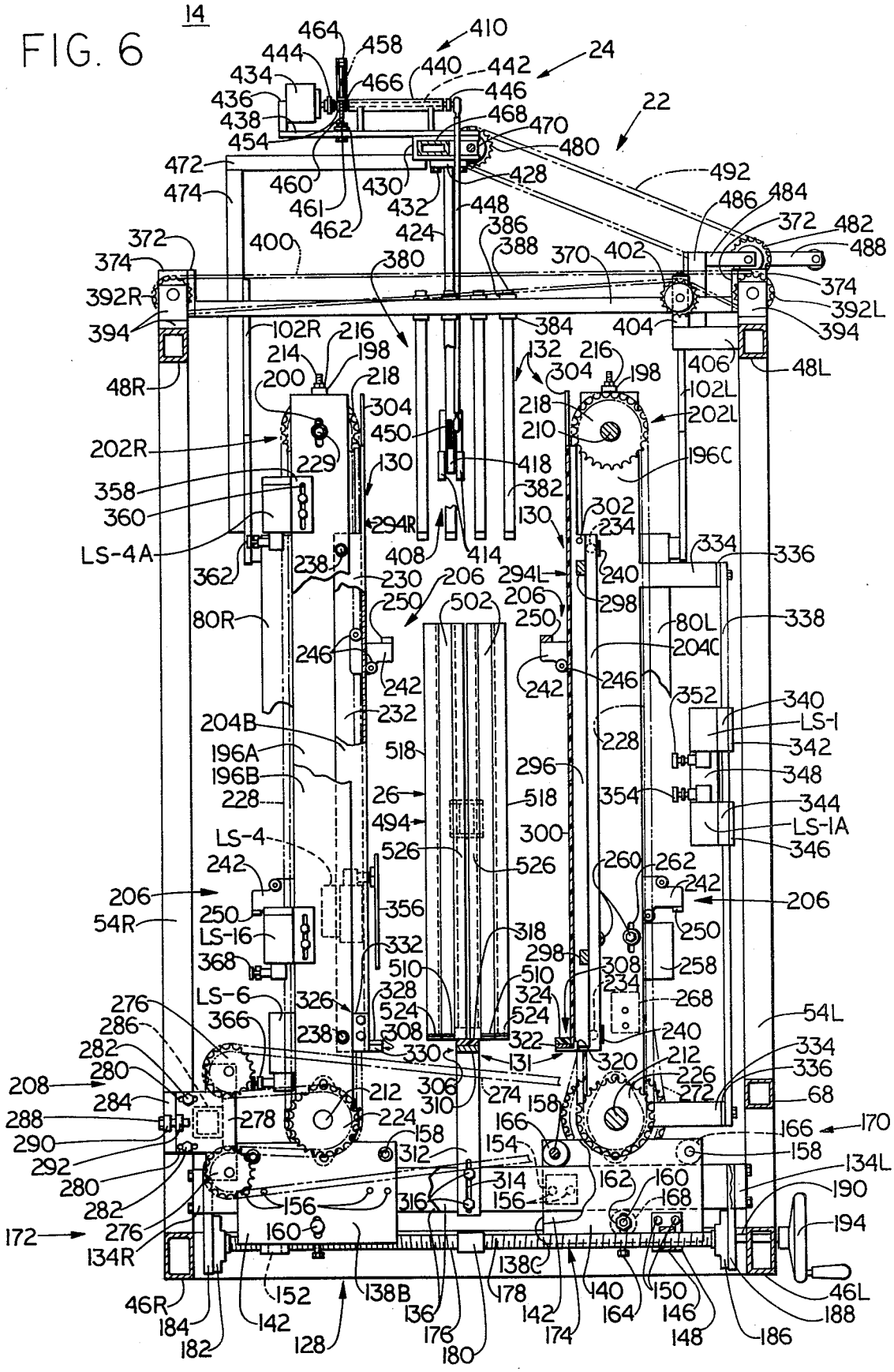
FIG. 6 is a view in section taken on an enlarged scale generally on the line 6—6 in FIG. 1.

The adjustable elevator frame assembly 128 incorporates a pair of rail mounts 134L and 134R. The right hand rail mount 134R is rigidly affixed in a longitudinal disposition along the inboard surfaces of the right hand elevator input post 50R and elevator output post 54R. The left hand rail mount 134L is likewise rigidly affixed to the inboard surfaces of the left hand elevator input post 50L and the elevator output post 54L. As can be seen in FIGS. 5 and 6, the pair of rail mounts 134L and 134R is mounted slightly above the pair of bottom stringers 46L and 46R. A rectangular frame is formed by attaching between end portions of the rail mounts 134L and 134R a pair of rails 136.

Movably mounted upon the transverse pair of rails 136 is a set of four upright frame assemblies 138 that is comprised of a right hand input member 138A, a right hand output member 138B, a left hand input member 138C, and a left hand output member 138D. These four assemblies are identical save for the differences of left and right handedness and mirror image effects. Each member of the set of four upright frame assemblies 138A, 138B, 138C and 138D incorporates an inside roller plate 140 and an outside roller plate 142. The inside roller plates 140 of the left hand upright frame assemblies 138C and 138D are fixedly held in longitudinal spaced relationship by a left hand pusher bar 146. Each end of the left hand pusher bar 146 rigidly incorporates at right angles thereto, one member of a pair of attachment blocks 148. Each member of the pair of attachment blocks 148 is fixedly attached to the inside surface of its respective inside roller plate 142 by a pair of bolts 150 that pass therethrough and threadably mount into the inside roller plate 140. The inside roller plates 140 of the right hand upright frame assemblies 138A and 138B are fixedly held in longitudinal spaced relationship by a right hand pusher bar 152 in the same manner as was previously described for the left hand pusher bar 146. The longitudinal spaced relationship of the inside roller plates 140 is such that they are held in close parallel proximity to the inside surfaces of the pair of rails 136, but do not touch.

As is shown in FIG. 6, the inside surface of each of the outside roller plates 142 fixedly incorporate a pair of plastic slide shoes 154. A pair of countersunk screws 156 pass through clear holes in each plastic shoe 154 and threadably fasten into the associated outside roller plate 142 to fasten the slide shoes 154 in place. Each of the outside roller plates 142 is fixedly attached to its respective inside roller plate 140 by a pair of upper roller bolts 158, as shown in FIGS. 5 and 6. The pair of upper roller bolts 158 passes through clear holes in the outside roller plate 142 and is also countersunk therein, and threadably mounts into the inside roller plate 140. A lower roller bolt 160 is of the carriage bolt variety and passes through clear vertical slots in both the inside and outside roller plates 140 and 142, respectively, and is held in place by a nut 162 (FIG. 6). The vertical position of the longitudinally disposed lower roller bolt 160 within the vertical slots of the inside and outside roller plates 140 and 142, respectively, is accomplished by a pair of setting bolts 164, threadably mounted in the bottom of the inside and outside roller plates 140 and 142, respectively, and in vertical alignment with the clear vertical slots thereof as is shown in FIG. 5. Upper ends of the setting bolts 164 engage the lower roller bolt 160, as shown in FIG. 5. The upper roller bolts 158 rotatably support a pair of load carrying rolls 166 that ride upon the top surface of its respective member of the pair of rails 136. The lower roller bolt 160 rotatably supports a clamp roll 168 that rolls against the lower surface of its respective member of the pair of rails 136 and is compressively held thereagainst by the pair of setting bolts 164. The pairs of upper roller bolts 158 and the lower roller bolts 160 of the members of the upright frame assemblies 138A, 138B, 138C and 138D are proportionately tightened to draw the pairs of plastic slide shoes 154 against the outside surfaces of the pair of rails 136, while maintaining proper longitudinal spaced relationship of the inside roller plates 140 therewith. The left hand members of the upright frame assembly 138C and 138D function as a left side elevator support assembly 170. The right hand members of the upright frame assemblies 138A and 138B function as a right side elevator support assembly 172. The left and right side elevator support assemblies 170 and 172 translate smoothly along the pair of rails 136.

The left and right side elevator support assemblies 170 and 172, respectively, are laterally moved along the pair of rails 136 by a compound jack screw 174. The compound jack screw 174 is comprised of a right hand threaded screw 176 and a left hand threaded screw 178 that are fixedly attached at the center of the machine by a shaft coupler 180. The right hand threaded screw 176 is rotatably mounted at its right extremity in a right side jack screw bearing 182 that is in turn fixedly attached to a right side bearing mount 184. The upper outboard surface of the right side bearing mount 184 is fixedly affixed to the inboard surface of the right hand rail mount 134R. The left end of the left hand threaded screw 178 is rotatably mounted in a left side jack screw bearing 186 that is in turn fixedly attached to the inboard surface of a left side bearing mount 188. The left side bearng mount 188 is fixedly attached at its upper outboard surface to the central inboard surface of the left hand rail mount 134L. The left extremity of the left hand threaded screw 178 incorporates a shaft extension 190 that passes through a clear hole in the lower portion of the left side bearing mount 188 and extends laterally outward through a square cutout 192 in the left hand bottom stringer 46L. The outboard extremity of the shaft extension 190 carries a crank wheel 194. The right hand threaded screw 176 threadably passes through the right hand pusher bar 152 of the right side elevator support assembly 172, and in a similar manner the left hand threaded screw 178 threadably passes through the left hand pusher bar 146 of the left side elevator support assembly 170. When the crank wheel 194 is turned clockwise, the right and left side elevator support assemblies 172 and 170 respectively will uniformly move toward each other narrowing the space between them, and, conversely, when the crank wheel 194 is turned counterclockwise, the elevator support assemblies will move away from each other, increasing the space between them.

Elevator plates 196A, 196B, 196C and 196D are centrally mounted on the inside roller plates 140 of the upright frame assemblies 138A, 138B, 138C and 138D, respectively. Each elevator riser plate 196A, 196B, 196C and 196D incorporates a jack screw mount 198 that is rigidly affixed to the top thereof and extending inwardly therefrom. Also incorporated near the top of each of the elevator riser plates 196A, 196B, 196C and 196D is a slot 200, as can be seen in FIG. 6.

The lift assembly 132 (FIGS. 5, 6 and 7) is comprised of a pair of chain lifts 202L and 202R, a set of four guide tracks 204A, 204B, 204C and 204D, a set of four elevator flight assemblies 206 and a power input assembly 208.

Figure 7:
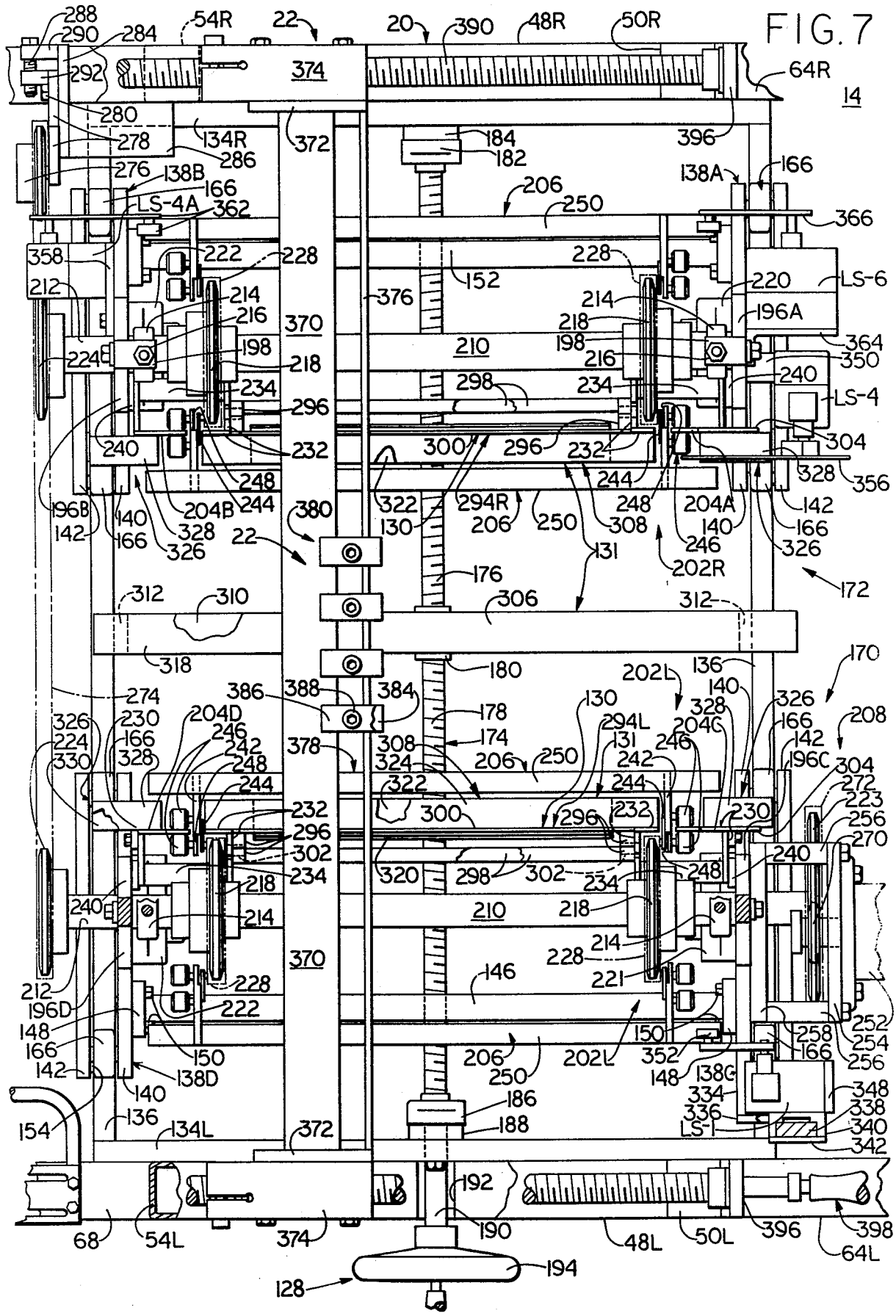
FIG. 7 is a fragmentary plan view on an enlarged scale of the elevator section of the machine.

The left hand chain lift 202L is similar to the right hand chain lift 202R except for their mirror image orientation, and the same part numbers have been applied to parts of both assemblies. Each member of the pair of chain lifts 202L and 202R incorporates an upper sprocket shaft 210 and a lower sprocket shaft 212. The upper sprocket shaft 210 is rotatably supported by eyebolts 214. The threaded shank of each of the eyebolts 214 extends vertically upward and passes through a clear hole in a respective one of the jack screw mounts 198. Nuts 216 on the shanks of the eyebolts 214 provide vertical adjustment of the upper sprocket shaft 210. The upper sprocket shaft 210 carries a pair of upper chain sprockets 218 adjacent the eyebolts 214. The input extremity of the lower sprocket shaft 212 of the right hand chain lift 202R is rotatably mounted in a right hand input bearing 220 (FIG. 7) that is in turn fixedly attached to the inner face of the right hand input elevator riser plate 196A adjacent to the intersection with the appropriate inside roller plate 140. The input extremity of the lower sprocket shaft 212 of the left hand chain lift 202L is rotatably mounted through a left hand input bearing 221, that is in turn fixedly attached to the inner face of the left hand input elevator riser plate 196C adjacent to the intersection with the appropriate inside roller plate 140. The input extremity of the lower sprocket shaft 212 of the left hand chain lift 202L passes from the left hand input bearing 221, through a clear hole in the left hand input elevator riser plate 196C, to fixedly incorporate a power input sprocket 223 (FIGS. 5 and 7). The output ends of the two lower sprocket shafts 212 are rotatably mounted through a pair of output bearings 222, and clear through the respective output members of the elevator riser plates 196B and 196D to fixedly incorporate upon each output extremity a power transfer sprocket 224. The output bearings 222 are attached to the inner surface of the appropriate elevator riser plates 196B and 196D. The lower sprocket shafts 212 fixedly incorporate lower chain sprockets 226 in vertical alignment with the appropriate pair of upper chain sprockets 218. Lift chains 228 circumscribe the pairs of upper chain sprockets 218 and the pairs of lower chain sprockets 226 to provide locomotion for the set of four elevator flight assemblies 206 to be described hereinafter. Tension is achieved in the pairs of lift chains 228 by advancing the nuts 216 upon the eyebolts 214. Each of the upper sprocket shafts 210 is clamped into position by a pair of lockbolts 229. The lockbolts 229 pass through the slots 200 provided at the upper end of the elevator riser plates 196A, 196B, 196C and 196D and threadably mount in ends of each sprocket shaft 210.

Each of the four guide tracks 204A, 204B, 204C and 204D is identical except for right and left handedness, and mirror image orientation. Each guide track includes an outer vertical angle 230 (FIGS. 5 and 7) and an inner vertical angle 232, whose lateral flanges are cut away near their tops. Spacer bars 234 are disposed near the top and bottom of the lateral flanges of the inner and outer vertical angles 232 and 230 respectively. After proper alignment of the inner and outer vertical angles 232 and 230, respectively, to provide a uniform slot 236 between their longitudinal flanges, the spacer bars 234 are welded in place. Bolts 238 pass through clear holes in the appropriate elevator riser plates 196A, 196B, 196C and 196D and threadably mount in the outer ends of the spacer bars 234, and by means of square spacers 240, spacedly clamp the appropriate member of the set of four guide tracks 204A, 204B, 204C and 204D to their respective elevator riser plates 196A, 196B, 196C and 196D.

Referring now more specifically to FIGS. 6, 7 and 11C, the set of four elevator flight assemblies 206 are similar except for right and left handedness and mirror image effects. Each member of the set of four elevator flight assemblies 206 incorporates a pair of roller plates 242, a pair of chain attachment plates 244, and each roller plate of the pair of roller plates 242 carries a pair of guide rolls 246. The pair of roller plates 242 is of irregular shape to provide staggered mounting of the pairs of guide rolls 246. The pair of roller plates 242 also incorporates an offset inner edge 248 adjacent the pair of lift chains 228, as can be seen in FIG. 7. The guide rolls 246 are rotatably mounted upon their respective roller plates 242 so that the roller member that rides behind the longitudinal flange of the outer vertical angle 230 (FIG. 6) is located above its partner which rides upon the front inner face of the same longitudinal flange. This will resist the torque imposed by the application of weight to the roller plate 242. The offset inner edge 248 is milled thin to provide space for the attachment of the chain attachment plate 244 (FIGS. 7 and 11C) that is fixedly attached at one end to the roller plate 242 and at the other end to the appropriate lift chain 228. Each member of the set of four elevator flight assemblies 206 is made complete by fixedly attaching each end of a flight bar 250 to the top of each pair of roller plates 242. Two members of the set of four elevator flight assemblies 206 are incorporated into each member of the pair of chain lifts 202L and 202R. The two elevator flight assemblies 206 of each of the pair of chain lifts 202L and 202R are equally spaced upon the chains so that as one elevator flight assembly is descending, the other is rising in opposition therewith.

The power input assembly incorporates a hydraulic motor 252 (FIGS. 5 and 7) that is fixedly mounted to a motor face plate 254 that is in turn fixedly attached in a boxlike manner to a pair of standoff brackets 256 and a base plate 258. The base plate 258 (FIG. 6) is adjustably mounted to the input face of the left hand input elevator riser plate 196C by bolts 260 (FIG. 6) that pass through vertical slots 262 therein, only one of which is shown, to threadably fasten into the output face of the base plate 258. The hydraulic motor 252 is vertically adjustable by action of a motor adjustment bolt 264 (FIG. 5) that pushes vertically upward upon the bottom surface of the motor face plate 254. The bolts 260 are tightened to fix the motor in place. The motor adjustment bolt 264 is threadably mounted through a horizontal flange of a bracket 266 that is in turn rigidly affixed to a mount plate 268. The mount plate 268 is fixedly attached to the input face of the left hand input elevator riser plate 196C, centrally beneath the hydraulic motor 252, as is shown in FIG. 6. The shaft of the hydraulic motor 252 fixedly incorporates a drive sprocket 270 (FIGS. 5 and 7) that is in vertical alignment with the power input sprocket 223 of the lower sprocket shaft 212 of the left hand chain lift 202L. A motor chain 272 circumscribes the drive sprocket 270 and the power input sprocket 223, thereby delivering rotational power from the hydraulic motor 252 to the lower sprocket shaft 212 of the left hand chain lift 202L. Proper tension is set in the motor chain 272 by advancing the motor adjustment bolt 264 and locking the hydraulic motor 252 in place with the bolt 260, as has been previously indicated.

In viewing FIGS. 6 and 7, rotational power is transferred to the lower sprocket shaft 212 of the right hand chain lift 202R by means of the two power transfer sprockets 224, and a transfer chain 274. The transfer chain 274 passes about the power transfer sprocket 224 of the left hand chain lift 202L in a counterclockwise direction, and about the power transfer sprocket 224 of the right hand chain lift 202R in a clockwise direction. This is facilitated by a pair of idler sprockets 276, about each of which the transfer chain 274 rotates in a counterclockwise direction. The pair of idler sprockets 276 is rotatably and spacedly mounted upon the upper and lower extremities of an idler adjustment plate 278. The idler adjustment plate 278 is laterally adjustable by virtue of a pair of horizontal slots 280 and a cooperative pair of bolts 282. The pair of bolts 282 threadably mount into an idler mount plate 284 that is in turn rigidly affixed to the output end of a longitudinally disposed idler mount tube 286 (FIGS. 6 and 7). The idler mount tube 286 is rigidly affixed in a cantilever manner to the left hand face of the right hand elevator output post 54R. A tension bolt 288 passes through a clear hole in a plate lug 290 that is rigidly affixed at the right hand extremity of the output surface of the idler mount plate 284. The tension bolt 288 is threadably mounted through an adjustment lug 292 that is in turn rigidly attached to the right hand extremity of the output surface of the idler adjustment plate 278. Advancing of the tension bolt 288 moves the idler adjustment plate 278 and the pair of idler sprockets 276 outboardly to provide tension in the transfer chain 274. Thus, opposing pairs of the set of four elevator flight assemblies 206 move downwardly through the lift assembly 132 in unison and in an alternating manner.

The elevator side guide assembly 130 is comprised of a pair of side guides 294L and 294R. Referring now to FIGS. 5, 6 and 7, each member of the pair of side guides 294L and 294R is comprised of a pair of side frames 296, a pair of attachment bars 298 and a transparent face 300. The pair of side frames 296 is vertically disposed and each member thereof is held in spaced longitudinal and parallel relationship with each other by the pair of attachement bars 298 that is fixedly attached therebetween as is shown best in FIG. 5, but also shown in 6 and 7. This arrangment of parts forms a rectangular frame upon whose inboard surface is fixedly attached the transparent face 300. The transparent face 300 does not overextend the dimensions of the pair of side frames 296 so that each member of the pair of side guides 294L and 294R just fits between their respective pair of the guide tracks 204A, 204B, 204C and 204D (FIG. 7). the inboard face of each of the transparent faces 300 is mounted flush with the inboard surfaces of their respective pair of guide tracks by means of a pair of mounting pins 302. The pair of mounting pins 302 is located near the top of the pair of side frames 296 and suspend the side guides 294L and 294R in place. The pair of mounting pins 302 is forceably placed in clear and aligned holes in the pair of side frames 296 and are supported by their respective pair of the guide tracks 204A, 204B, 204C and 204D. As shown in FIG. 11D, a slot 303 in an upper portion of the inner angle 232 of the associated guide track supports each mounting pin 302. Lower edges of the faces 300 are releasably held by a mount angle 320 (FIGS. 5, 7 and 11C). Proper vertical alignment is assured by the elevator floor assembly 131 to be discussed hereinafter. A pair of irregular shaped input side guide extensions 304 is rigidly affixed atop the upper input corners of, and coplanar with the inboard surfaces of, the right hand input guide track 204A and the left hand input guide track 204C, as shown in FIGS. 5, 6 and 7.

The elevator floor assembly 131 (FIGS. 6 and 7) is comprised of a middle rail 306 and a pair of side rails 308. The middle rail 306 incorporates a longitudinally disposed floor beam 310 that is fixedly attached near each end thereof to the top ends of a pair of floor risers 312. Each of the floor risers 312 has a vertical slot 314 near the lower end thereof, through which a pair of bolts 316 pass, to threadably mount at the center of the inner surfaces of the pair of rails 136. This arrangement allows the middle rail 306 a vertical degree of freedom by which it can be aligned with the bottom of the pusher assembly 26 (FIG. 6). A plastic slide rail 318 is fixedly attached to the top surface of the longitudinally disposed floor beam 310.

Each of the pair of side rails 308 (FIGS. 6 and 7) includes a slide spacer or support 322 and a slide 324. The slide spacer or support 322 is fixedly attached to flanges of a pair of the vertical angles 232, as shown in FIG. 11C. The slide 324 is mounted on an upper face of the support 322. A horizontal flange of the mount angle 320 is attached to a lower face of the support 322 by fasteners 325 which extend through slots 327, only one of which is shown, in the horizontal flange. The support surface of the slide 324 is extended in both longitudinal directions by the incorporation of a short slide extension 326 (FIG. 7). The short slide extension 326 incorporates a short slide 328 that is fixedly attached to the top surface of a short slide mount 330. The short slide mount 330 is rigidly affixed across the lower inner edge of an attachment plate 332 that is in turn fixedly attached to the lower outer face of the laterally disposed flange of the outer vertical angle 230 of a respective one of the set of four guide tracks 204A, 204B, 204C and 204D.

The following description concerns the limit switches specific to the operation of the elevator assembly 20. The left hand input elevator riser plate 196C rigidly incorporates upon its outboard edge a pair of standoff switch mounts 334 as is most easily seen in FIG. 6. Fixedly attached to the outboard end of the pair of standoff switch mounts 334 and extending shortly in the input direction therefrom, is a pair of switch rail mounts 336, as is most easily seen in FIGS. 5 and 7. A vertical slide rail 338 is fixedly attached at its ends to the outboard surfaces of, and at the input end of, the pair of switch rail mounts 336. A limit switch LS-1 is fixedly attached to the inboard surface of an upper slide block 340 that can be fixedly clamped to the vertical slide rail 338 by a back plate 342. Similarly, a limit switch LS-1A is fixedly attached to the inboard surface of a lower slide block 344, that can be fixedly clamped to the vertical slide rail 338 by a back plate 346. The operation of the limit switches LS-1 and LS-1A are coordinated by coupling them with an adjustable spanner plate 348. The heads of the limit switches LS-1 and LS-1A are opposedly mounted so that their functioning can be more closely coupled. The limit switch LS-1 incorporates a switch arm and roller 352. The limit switch LS-1A incorporates a switch arm and roller 354. The limit switches LS-1 and LS-1A are so positioned so that their switch arms and rollers 352 and 354, respectively, extend in the longitudinal direction and in the vertical plane of the rising flight bar 250 of the left hand chain lift 202L. The input end of the flight bars 250 therefore actuate the limit switches LS-1A and LS-1 in that sequence.

A limit switch LS-4 is fixedly mounted upon the lower input surface of the right hand input elevator riser plate 196A by a standoff block 350 as is shown most clearly in FIGS. 5 and 7. The head of the limit switch LS-4 stands upright and incorporates a curved switch rod 356 that extends inwardly and downwardly to be actuated by the right hand input corner of a stack of cartons 357 (FIG. 8) descending through the lift assembly 132 as will be discussed hereinafter.

A limit switch LS-4A is fixedly mounted upon the upper output surface of the right hand output elevator riser plate 196B by a switch plate 358. The switch plate 358 is laterally disposed and vertically adjustable by virtue of a vertical slot 360 incorporated therein. The head of the limit switch LS-4A is inverted, and incorporates a switch arm and roller 362 that extends inwardly in a longitudinal plane to cooperate with the output end of the rising flight bars 250 of the right hand chain lift 202R.

A limit switch LS-6 is fixedly mounted upon the lower input surface of the right hand input elevator riser plate 196A by an angle mount 364 (FIGS. 5 and 7). The angle mount 364 incorporates a lateral flange that is vertically adjustable upon the right hand input riser plate 196A in the same manner as the switch plate 358 of the limit switch LS-4A (FIG. 6). The limit switch LS-6 is fixedly attached to the outboard surface of the angle mount 364 as is best shown in FIG. 7. The head of the limit switch LS-6 is inverted and incorporates a switch arm and roller 366 that extends inwardly in a longitudinal plane to cooperate with the input end of the rising flight bars 250 of the right hand chain left 202R.

A limit switch LS-16 is fixedly mounted upon the lower output surface of the right hand output elevator riser plate 196B in the same manner and orientation as the limit switch LS-4A as previously described (FIG. 6). The limit switch LS-16 incorporates a switch arm and roller 368 that extends inwardly in a longitudinal plane to cooperate with the output end of the rising flight bar 250 of the right hand chain lift 202R.

The appurtenances of the fence assembly 22 are shown in FIGS. 1, 5, 6 and 7. The fence assembly 22 includes a lateral tube 370 that is best shown in FIG. 7. Mounting flanges 372 at ends of the lateral tube 370 fixedly attach end portions of the lateral tube 370 to a pair of adjustment blocks 374. A lateral plate 376 is rigidly affixed between the inboard surfaces of, and at the input ends of, the pair of mounting flanges 372 so that it is in spaced parallel relationship with the lateral tube 370. The intervening space forms a transverse slot 378 within which a set of four bar assemblies 380 is adjustably clamped. Each bar assembly of the set of four bar assemblies 380 (FIGS. 5 and 6) incorporates a vertical bar 382 whose upper end rigidly incorporates a horizontally disposed lower clamp plate 384. The upper surface of the horizontally disposed lower clamp plate 384 is compressively held against the bottom surfaces of the lateral bar 370 and the lateral plate 376 by a top clamp plate 386 and a clamp bolt 388 (FIG. 7). The clamp bolt 388 passes down through a clear hole in the top clamp plate 386 and threadably mounts into the lower clamp plate 384. This arrangement provides lateral adjustment of each member of the set of four bar assemblies 380. The set of four bar assemblies 380 is longitudinally adjustable by virtue of the adjustment blocks 374. Each of the adjustment blocks 374 is threadably mounted upon a long adjustment screw 390. Each of the long adjustment screws 390 integrally incorporates at each end thereof a smaller diameter smooth shaft extension that facilitates rotatable mounting thereof. In addition to facilitating rotational mounting, each of the output extensions also fixedly incorporates one of a pair of chain sprockets 392L and 392R. The output extensions of the long adjustment screws 390 are rotatably mounted through upright flanges of output angle mounts 394, which are in turn mounted on top surfaces of the pair of top stringers 48L and 48R. The input extensions of the long adjustment screws 390 are rotatably mounted through upright input plate mounts 396 which are mounted on the elevator input posts 50L and 50R. In addition, the left hand extension fixedly incorporates a crank handle 398. A fence adjustment chain 400 (FIG. 6) circumscribes the chain sprockets 392L and 392R. Proper tension is provided in the fence adjustment chain 400 by an idler sprocket 402 that is rotatably mounted upon a vertical idler mount 404, that is in turn rigidly affixed upon the upper inboard edge of a horizontal idler mount 406. The horizontal idler mount 406 is perpendicularly and rigidly affixed to the inboard surface of the left hand top stringer 48L, just upstream of the top middle lateral stiffener 60. When the crank handle 398 is turned in either direction, the fence adjustment chain 400 provides equal rotation of the long adjustment screws 390 to adjust the set of four bar assemblies 380 of the fence assembly 22 in either longitudinal direction as desired.

The rate valve assembly 24 is shown in FIGS. 5, 6 and 8. It is comprised of a sensing assembly 408, a valve assembly 410, and a mounting and adjustment assembly 412.

The sensing assembly 408 incorporates a pair of sensing rollers 414 (most specifically shown in FIGS. 6 and 8). The sensing rollers 414 ride on the elevator stack 357. The sensing rollers 414 are rotatably mounted at the extremities of a short shaft 416. The short shaft 416 is fixedly attached through the output end of a radius arm 418, that is in turn pivotally mounted at its end upon a pivot pin 420 (FIG. 8). The pivot pin 420 is fixedly mounted through the input ends of a pair of sensor plates 422. The plates 422 are rigidly affixed in lateral spaced relationship upon sides of the lower extremity of a vertical suspension bar 424. A stop bar 426 is rigidly affixed to the inner surfaces of the pair of sensor plates 422 adjacent the bottom edge thereof, to prevent the radius arm 418 from pivoting downwardly beyond necessary limits. The top extremity of the vertical suspension bar 424 is rigidly affixed to the bottom surface of a mounting flange 428. The mounting flange 428 is fixedly attached to the lower surface of slide bracket 430 by a pair of bolts 432 that pass through clear holes in each end of the mounting flange 428 and threadably mount in the slide bracket 430.

The valve assembly 410 incorporates a rate valve 434 (FIG. 6) that is fixedly attached to the left hand surface of a vertical mount plate 436, that is in turn fixedly attached upon the top surface of, and at the right hand edge of, a cantilever mount plate 438. Rigidly affixed to the top surface of the cantilever mount plate 438 and in axial alignment with the rate valve 434, is a bearing stand 440. The bearing stand 440 pivotally incorporates a shaft 442 that is fixedly attached to the shaft of the rate valve 434 by a shaft coupler 444. The inboard extremity of the shaft 442 fixedly incorporates a torque arm 446 (FIG. 8) that extends in the output direction. The output extremity of the torque arm 446 pivotally accommodates the upper end of a turnbuckle rod 448, the lower end of which is also pivotally affixed to the top extremity of an eyebolt 450. The eyebolt 450 is mounted on the top of the radius arm 418 and locked in place by a lock nut 452. The placement of the eyebolt 450 is slightly upstream of the pair of sensing rollers 414. The outboard end of the shaft 442 is fixedly fitted through the center of a limiter arm 454. The input end of the limiter arm 454 incorporates a limit bolt 456 (FIG. 8) that is vertically disposed and threadably mounted therethrough, that functions as an "up" stop for the sensing assembly 408. The output end of the limiter arm 454 operates against a compression spring 458 that is coaxially mounted upon a spring shaft 460. The spring shaft 460 is perpendicularly and threadably mounted into the top output end of a cantilever shaft mount 462. The spring shaft 460 is fixedly locked into place within the cantilever shaft mount 462 by a lock nut 461. The cantilever shaft mount 462 is longitudinally disposed and fixedly attached upon the top surface of the cantilever mount plate 438. The spring shaft 460 passes vertically upward through a slot in the output end of the limiter arm 454. The top extremity of the spring shaft 460 incorporates a double nut arrangement 464 which confines the upper end of the compression spring 458, and the bottom end of which is restrained by a washer 466 that compressively rests against the top surface of, and overlaying the end slot of, the output end of the limiter arm 454. This arrangement puts a counterclockwise torque (FIG. 8) upon the shaft 442 which transfers into a downward thrust in the turnbuckle rod 448, driving the radius arm 418 downwardly toward the stop bar 426.

The slide bracket 430 is of "C" shape in cross section as is seen in FIG. 6, and fits about the top, bottom and right side of a rectangular slide tube 468. The open end of the slide bracket 430, or the left side of the rectangular slide tube 468, is closed by a pusher block 470 that is fixedly attached therebetween. The input end of the rectangular slide tube 468 is rigidly affixed in a cantilever configuration upon the top left hand end of a pair of lateral mount tubes 472. The right hand end of the pair of lateral mount tubes 472 is rigidly affixed upon the top extremities of a pair of vertical mount tubes 474. The vertical mount tubes 474 are affixed to the outboard surface of the right hand mount plate 102R of the assembling machine framework 76.

The pusher block 470 of the rate valve assembly 24 is threadably mounted upon an adjustment screw 476, that is in turn rotatably mounted in spaced parallel relationship with the rectangular slide tube 468. The adjustment screw 476 integrally incorporates at each end thereof, a length of smaller diameter shaft that is rotatably mounted in clear holes in one of a pair of screw mounts 478. The pair of screw mounts 478 is fixedly attached to both extremities of the rectangular slide tube 468 and extends horizontally to the left therefrom. The input shaft extension of the adjustment screw 476 passes through its respective member of the pair of screw mounts 468 to fixedly incorporate a chain sprocket 480. Laterally aligned to the left of the chain sprocket 480 is a crank sprocket 482 that is in turn rotatably mounted upon the left end of a lateral bar 484. The lateral bar 484 is rigidly affixed to the upper input surface of the lateral flange of a mount angle 486. The mount angle 486 is vertically disposed and one flange thereof is rigidly affixed upon the outboard surface of the left hand mount plate 102L of the assembling machine framework 76. Fixedly attached to the input face of the crank sprocket 482, through the intervening auspices of a crank spacer 490, is a crank handle 488. The presence of the crank spacer 490 allows the crank handle 488 to rotate without interference with the left hand mount plate 102L. A rate valve chain 492 circumscribes the chain sprocket 480 and the crank sprocket 482 so that when the crank handle 488 is turned, the adjustment screw 476 is rotated, moving the valve assembly 410 and the sensing assembly 408 in either longitudinal direction is desired.

The articles 40, in shingle stream, are delivered to the rate valve assembly 24 by the nip roll assembly 42, which receives the articles from the belt conveyor 107 as shown in FIG. 8. The belt conveyor 107 is driven by a drive chain 1498, only a portion of which is shown. The drive chain 1498 can be driven by appropriate drive mechanism (FIGS. 1 and 11B) described in detail hereinafter. The nip roll assembly 42 includes upper nip rolls 1500 (FIG. 8A) and lower nip rolls 1502, only one of which is shown in FIG. 8. The lower nip rolls 1502 are mounted on a shaft 1504 that is rotatably mounted between bearings (nor shown) mounted on the mount plates 102L and 102R. A sprocket 1506 (FIG. 5) is mounted on the shaft 1504 and is driven by a short drive chain 1508. The short drive chain 1508 is driven by a sprocket 1510 carried by a shaft 1512 which is also rotatably mounted between bearings (not shown) supported on the mount plates 102L and 102R. The shift 1512 also carries a sprocket 1513 (FIG. 8) on which the drive chain 1498 runs. The shaft 1512 also carries a pulley 1514 on which the conveyor belt 107 runs.

The upper nip rolls 1500 are mounted on a shaft 1516 (FIG. 8A) which is rotatably mounted in an upper nip roll frame 1518. The upper nip roll frame 1518 is rotatably mounted on a shaft 1520 that is also rotatably mounted between bearings (not shown) mounted on the mount plates 102L and 102R. A sprocket 1522 is mounted on the shaft 1520 and is driven by the drive chain 1498. A pulley 1523 mounted on the shaft 1520 drives a belt 1524. The belt 1524 drives a pulley 1526 mounted on the shaft 1516 to drive the upper nip rolls 1500. The upper and lower nip rolls are mounted in opposition to drive the articles 40 onto the top of the stack 357 (FIG. 8) as the articles leave the conveyor belt 107. Elongated leaf spring members 1527 are carried by clamp brackets 1528 that are mounted on frame bars 1530 of the upper nip roll frame 1518. The leaf spring members 1527 urge the articles downwardly onto the stack 357.

The number 1 pusher assembly 26 is shown in FIGS. 4, 6, 10 and 11. The number 1 pusher assembly 26 incorporates a pusher face assembly 494, a ram assembly 496, a support assembly 498, a scissors assembly 499, and an actuator assembly 500.

Figure 11:
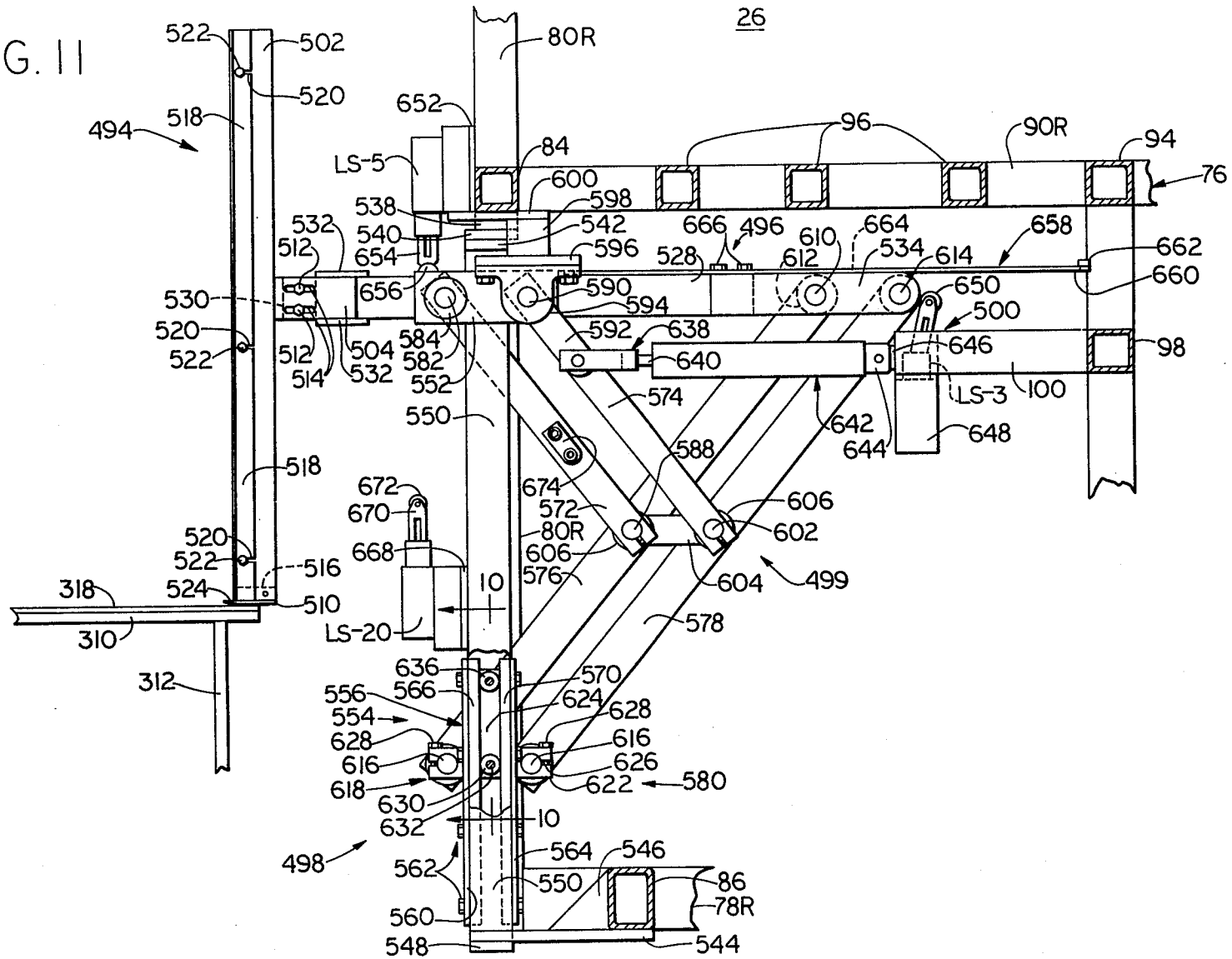
FIG. 11 is a view in longitudinal upright section showing the pusher section of the machine.

The pusher face assembly 494 incorporates a pair of pusher posts 502 rigidly held in spaced lateral relationship by a pair of flange mounts 504 (FIGS. 4 and 11). The output extremity of each of the pair of flange mounts 504 is rigidly affixed to the input surface of, and approximate the middle of, one of the pair of pusher posts 502, such that the inboard surface of each of the posts 502 lies in the same longitudinal and vertical plane as the inboard surface of the associated flange mount 504. The pair of flange mounts 504 is slidably mounted upon, and fixedly attached to, the output end of a ram 528 of the ram assembly 496 by a set of four bolts 512. The set of four bolts 512 passes through a corresponding set of slots 514 in the pair of flange mounts 504 to threadably mount into the sides of the output end of the ram 528. In this manner, the pusher face assembly 494 has a longitudinal degree of adjustment. The bottom extremity of each of the pusher posts 502 (FIGS. 4, 6 and 11) carries a post tab 510 that is rigidly affixed in the manner of an end plate to the bottom thereof, but extends from the output side thereof. A pair of slide blocks 516 is fixedly attached to the bottom extremity of the inboard surfaces of the pair of pusher posts 502. The bottom surfaces of the pair of slide blocks 516 extend slightly below the bottom surfaces of the pair of post tabs 510 to ride upon the top surface of the plastic slide rail 318 of the elevator floor assembly 131. Fixedly attached to the outboard surfaces of the pair of pusher posts 502 is a pair of outside face angles 518 that extends from the top to the bottom thereof. Each member of the pair of outside face angles 518 incorporates a set of three slots 520, as is best seen in FIG. 11, through which extends a set of corresponding bolts 522 to threadably mount into the outboard surfaces of the pair of pusher posts 502 to provide a longitudinal degree of freedom to the pair of outside face angles 518. The bottom extremities of the lateral flanges of the pair of outside face angles 518 rigidly incorporate a pair of short tabs 524, that also extend in the output direction therefrom. The short tabs 524 are in lateral and horizontal alignment with the post tabs 510. A pair of inboard face angles 526 (FIGS. 4 and 6) is fixedly and adjustably attached to the inboard surfaces of the pair of pusher posts 502 in the same manner as the pair of outside face angles 518. The bottom extremity of the longitudinal flange of the pair of inboard face angles 526 is cut away to provide clearance for the pair of slide blocks 516. The pair of slide blocks 516 is therefore mounted behind the lateral flanges of the pair of inboard face angles 526.

The ram assembly 496 incorporates the ram 528 as is shown in FIGS. 4 and 11. The ram 528 is a tubular member of rectangular cross section that incorporates upon its output sides a pair of mount blocks 530 in which the bolts 512 are threaded. A pair of brace plates 532 is rigidly affixed to the top of bottom output surfaces of the ram 528 in such position that the output edges thereof lie in the same vertical plane as the input edges of the pair of mount blocks 530. The pair of brace plates 532 provides a restraining torque to the pair of flange mounts 504 to aid in proper vertical alignment of the pusher face assembly 494. The input end of the ram 528 incorporates a pair of tines 534 rigidly affixed to the sides thereof through the interspacing auspices of a pair of shims 536 (FIG. 4) to form a fork like structure that extends in the input direction therefrom.

The ram assembly 496 is movable in a horizontal plane and in both longitudinal directions by virtue of the scissors assembly 499 (FIG. 11) that is mounted upon the support assembly 498. The support assembly 498 is shown in FIGS. 4, 11 and 11A. It incorporates a pair of top hanger supports 538 rigidly affixed to the bottom surfaces of the upper output transverse beam 84 of the assembling machine framework 76. A bottom plate 540 is rigidly affixed to the lower extremity of each member of the pair of top hanger supports 538. The bottom plates 540 extend slightly in the output direction from the top hanger supports 538. A top lateral mount plate 542 is rigidly affixed to the underside of the two bottom plates 540 and adjacent to the output edge thereof, so that the top lateral mount plate 542 is longitudinally offset in the output direction from the upper output transverse beam 84.

The support assembly 498 also incorporates a pair of bottom standoff mounts 544 that is rigidly affixed to the underside of the base transverse beam 86, and extends in the output direction therefrom. The lateral placement of the pair of bottom standoff mounts 544 is such that it is directly below the pair of top hanger supports 538. The output edges of the pair of bottom standoff mounts 544 and the two bottom plates 540 are in the same vertical plane. The horizontal orientation of the bottom standoff mounts 544 is assured by a pair of gussets 546 (FIG. 11) that is rigidly affixed between the top surface of the pair of bottom standoff mounts 544 and the output face of the base transverse beam 86. A bottom lateral mount plate 548 is rigidly affixed across the bottom output surfaces of the pair of bottom standoff mounts 544, and is longitudinally placed to be directly below the top lateral mount plate 542. A pair of pusher riser plates 550 is rigidly affixed between the top and bottom lateral mount plates 542 and 548, respectively, in such position that the lateral distance between them will receive the scissors assembly 499 of the pusher assembly 26. Also incorporated into the support assembly 498 is a pair of top pivot plates 552 (FIGS. 4, 11 and 11A). The top pivot plates 552 are rigidly affixed across the outboard surfaces of the pair of pusher riser plates 550 near the top thereof.

Approximate the bottom of the pair of pusher riser plates 550 is a cam roll guide assembly 554 that is shown in FIGS. 4, 10 and 11. The cam roll guide assembly 554 is comprised of a left hand guide 556 and a right hand guide 558 that are identical save for mirror image orientation. The left hand guide 556 is shown in FIGS. 4, 10 and 11 and incorporates an output lateral plate 560, fixedly attached to the output edge of, and extending inwardly from, the left hand member of the pair of pusher riser plates 550. A set of four bolts 562 passes through clear holes in the output lateral plate 560 and threadably mounts into the output edge of the left hand member of the pair of pusher riser plates 550, as is seen in FIG. 4. An input lateral plate 564, identical to the output lateral plate 560, is fixedly attached to the input edge of the left hand member of the pair of pusher riser plates 550 in substantially the same manner as the output lateral plate 560. An output guide rail 566 is fixedly attached in a vertical disposition to the input surface of, and adjacent the inboard edge of, the output lateral plate 560. A set of four bolts 568 (FIGS. 4 and 10) pass through clear holes in the inboard edge of the output lateral plate 560 and threadably mount into the output guide rail 566. Opposedly mounted from the output guide rail 566, upon the input lateral plate 564, is an input guide rail 570. The input guide rail 570 is fixedly attached to the input lateral plate 564 in substantially the same manner as that of the output guide rail 566.

The pair of top pivot plates 552 and the cam roll guide assembly 554 function as mounting points for the scissors assembly 499 that carries the ram assembly 496. The scissors assembly 499 (FIGS. 4, 10 and 11) incorporates a pair of output radius arms 572, a pair of input radius arms 574, an output carrier arm 576, an input carrier arm 578, and a cam roll mount assembly 580. The pair of output radius arms 572 is pivotally attached to the output extension of the pair of top pivot plates 552, as is shown most clearly in FIG. 11. More specifically, the upper ends of the pair of output radius arms 572 are clampedly mounted upon the inboard ends of a pair of short output pivot shafts 582. The pair of short output pivot shafts 582 is pivotally mounted in a pair of output bushings 584 that is in turn fixedly attached within the output extensions of the pair of top pivot plates 552. Proper lateral spacing between the pair of output radius arms 572 and the output extension of the pair of top pivot plates 552 is maintained by a pair of coaxial spacers 586 (FIG. 4) mounted upon the pair of short output pivot shafts 582. The pair of short output pivot shafts 582 and the pair of output bushings 584 are held in lateral placement within the pair of top pivot plates 552 by appropriate lock rings that are not shown. The lower ends of the pair of output radius arms 572 are fixedly clamped to the ends of an output middle shaft 588 (FIG. 11).

The upper ends of the pair of input radius arms 547 are pivotally mounted within the input extensions of the pair of top pivot plates 552 in the same manner as just described for the output radius arms 572 except for a left hand input pivot shaft 590. The left hand pivot shaft 590 extends laterally to the left of the pusher assembly 26 to carry an actuator arm 592 and to be pivotally mounted in a bearing 594. The bearing 594 is fixedly attached in an inverted position to the bottom surface of a bearing mount plate 596 that is in turn rigidly affixed to the bottom extremity of a bearing hanger 598. The bearing hanger 598 is rigidly affixed to the bottom surface of, and at the input end of, an offset plate 600 (FIG. 11). The offset plate 600 is rigidly affixed to the underside of the upper output transverse beam 84. The lower ends of the pair of input radius arms 574 are fixedly clamped to the ends of an input middle shaft 602 (FIG. 11).

The longitudinal distance between the output and input middle shafts 588 and 602, respectively, is maintained by a pair of longitudinal links 604. The pair of longitudinal links 604 is pivotally mounted upon the shafts, as shown in FIGS. 4 and 11, and laterally placed thereupon to be adjacent the inboard surfaces of the pairs of input and output radius arms 574 and 572, respectively, with the interspacing auspices of a set of four spacers 606.

The output carrier arm 576 is pivotally mounted upon the central portion of the output middle shaft 588 and is laterally determined thereupon by a pair of output middle spacers 608 (FIG. 4) that work against the inboard surfaces of the pair of longitudinal links 604. The upper end of the output carrier arm 576 is pivotally mounted upon an output ram shaft 610, that is in turn fixedly held at each end within the pair of tines 534 of the ram assembly 496. The output carrier arm 576 is laterally determined upon the output ram shaft 610 by the interspacing auspices of a pair of upper output spacers 612. The input carrier arm 578 is pivotally mounted upon the central portion of the input middle shaft 602, and an input ram shaft 614, in the same manner as has just been described for the output carrier arm 576.

The lower ends of the input carrier arm 578 and the output carrier arm 576 are pivotally mounted upon the central portion of a pair of bottom shafts 616 as is shown in FIGS. 4, 10 and 11. Ends of the bottom shafts 616 are clamped in the cam roll mount assembly 580. The cam roll mount assembly 580 is comprised of a left hand roller mount 618 (FIGS. 4, 10 and 11) and a right hand roller mount 620 (FIG. 4). The left and right hand roller mounts 618 and 620, respectively, are identical except for their mirror image installation, therefore, only the left hand roller mount 618 will be discussed in detail. The left hand roller mount 618 is of inverted T-shape and includes a horizontal cross frame portion 622 and a vertical support stem portion 624. As previously indicated, the left ends of the pair of bottom shafts 616 are clampedly held in clamp bores that are adjacent each end of the horizontal cross bar portion 622 provided with end slits 626 and a pair of clamp bolts 628. A bottom cam roll 630 is rotatably mounted upon a cam bolt 632, that is in turn threadably mounted in the center of the left hand face of the horizontal cross bar portion 622. As is seen in FIG. 10, a washer 634 insures free rotation of the cam roll 630 by spacedly holding its hub away from the horizontal support member 622. An upper cam roll 636 is rotatably mounted at the top of the left hand surface of the vertical support member 624 in the same manner as that just described for the bottom cam roll 630. The bottom and upper cam rolls 630 and 636, respectively, are in vertical alignment and run within the confined vertical space provided by the output and input guide rails 566 and 570, respectively. The bottom and upper cam rolls 630 and 636, respectively, resist torque loads that would tend to displace the horizontal support member 622 from its horizontal orientation. Since the pair of bottom shafts 616 are held in a horizontal plane and the output and input ram shafts 610 and 614 are held in horizontal alignment, the ram 528 is held in a horizontal plane.

The actuator arm 592, that is fixedly attached to the left hand input pivot shaft 590, pivotally supports upon its free extremity an actuator yoke 638, as is shown in FIGS. 4 and 11. The base of the actuator yoke 638 is threadably mounted upon the extended extremity of a piston rod 640 of a hydraulic cylinder 642. The base of the hydraulic cylinder 642 carries a mounting yoke 644. The mounting yoke 644 is pivotally mounted on a cylinder mount lug 646, that is in turn rigidly affixed to the output extremity of the actuator mount beam 100 of the assembling machine framework 76.

LIMIT SWITCHES

A limit switch LS-3 is fixedly attached to the right hand surface of a hanger mount 648, that is in turn rigidly affixed at its upper end to the right hand surface of, and at the output end of, the actuator mount beam 100, as is shown in FIGS. 4 and 11. The limit switch LS-3 is in an upright orientation, such that a switch arm and roller 650 thereof comes in contact with the upper input end of the input carrier arm 578 when the ram assembly 496 is in retracted position.

A limit switch LS-5 (FIG. 11) is fixedly attached in an inverted orientation to the output face of a switch mount 652, that is in turn rigidly afixed at its lower end to the output face of the upper output transverse beam 84 of the assembling machine framework 76. The head of the limit switch LS-5 incorporates a switch arm 654 and a switch roller 656. The limit switch LS-5 is laterally disposed upon the upper output transverse beam 84 so that the switch roller 656 is suspended above the right hand roller mount 620 of the cam roll mount assembly 580. The limit switch LS-5 is not shown in FIG. 4, but its lateral placement can be understood therefrom. The switch roller 656 is vertically placed to cooperate with a switch actuator 658 shown in side view in FIG. 11 and in double-dot-dash top view in FIG. 4. The switch actuator 658 is comprised of an adjustment plate 660 and an actuator lobe 662. The actuator lobe 662 is rigidly affixed laterally across the top input end of the adjustment plate 660 so that it extends slightly to the right thereof. The adjustment plate 660 incorporates a long slot 664 for longitudinally adjusting the actuator lobe 662. A pair of adjustment bolts 666 pass cleanly through the long slot 664 and threadably mount into the top input end of the ram 528 for clampedly holding the adjustment plate 660 thereto. The switch actuator 658 is thereby capable of large longitudinal adjustments, whereby the forward travel of the pusher face assembly 494 can be adjusted over a wide range.

A limit switch LS-20 is shown in FIG. 11. It is fixedly attached to a mount plate 668 that is in turn rigidly affixed across the output edge of the left hand member of the pair of pusher riser plates 550. The mount plate 668 is laterally positioned upon the left hand member of the pair of pusher riser plates 550 so that a switch arm 670 and a switch roller 672 cooperate with a switch lug 674. The switch lug 674 is fixedly attached to the outboard surface of the left hand member of the pair of output radius arms 572, as shown in FIG. 11, and partially in FIG. 4. As the pusher assembly 26 moves the ram 528 in the output direction, or foward, the switch lug 674 swings through an arc which intersects the switch roller 672. The switch arm 670 rotates in the counterclockwise direction (FIG. 11) to allow the switch lug 674 to pass as the ram 528 travels forward to its full position. No control signal is effected at this time. As the ram 528 returns, the switch lug 674 again intercepts the switch roller 672, rotating the switch arm 670 clockwise, making the appropriate control signal that will be discussed hereinafter, as part of the operation discussion of the stacking assembly 14.

OPERATION OF STACKING ASSEMBLY

As can be seen in the overall view of FIG. 1 and FIG. 8, a procession of flattened cartons 40 is delivered from the carton assemblying machine to the stacking assembly 14 of the packing machine 10. Individual cartons of the procession of flattened cartons 40 overlap each other considerably, so that the procession of flattened cartons 40 is said to be shingled. As the individual cartons flow from the carton assembling machine 12, their leading edges are up.

Figure 12:
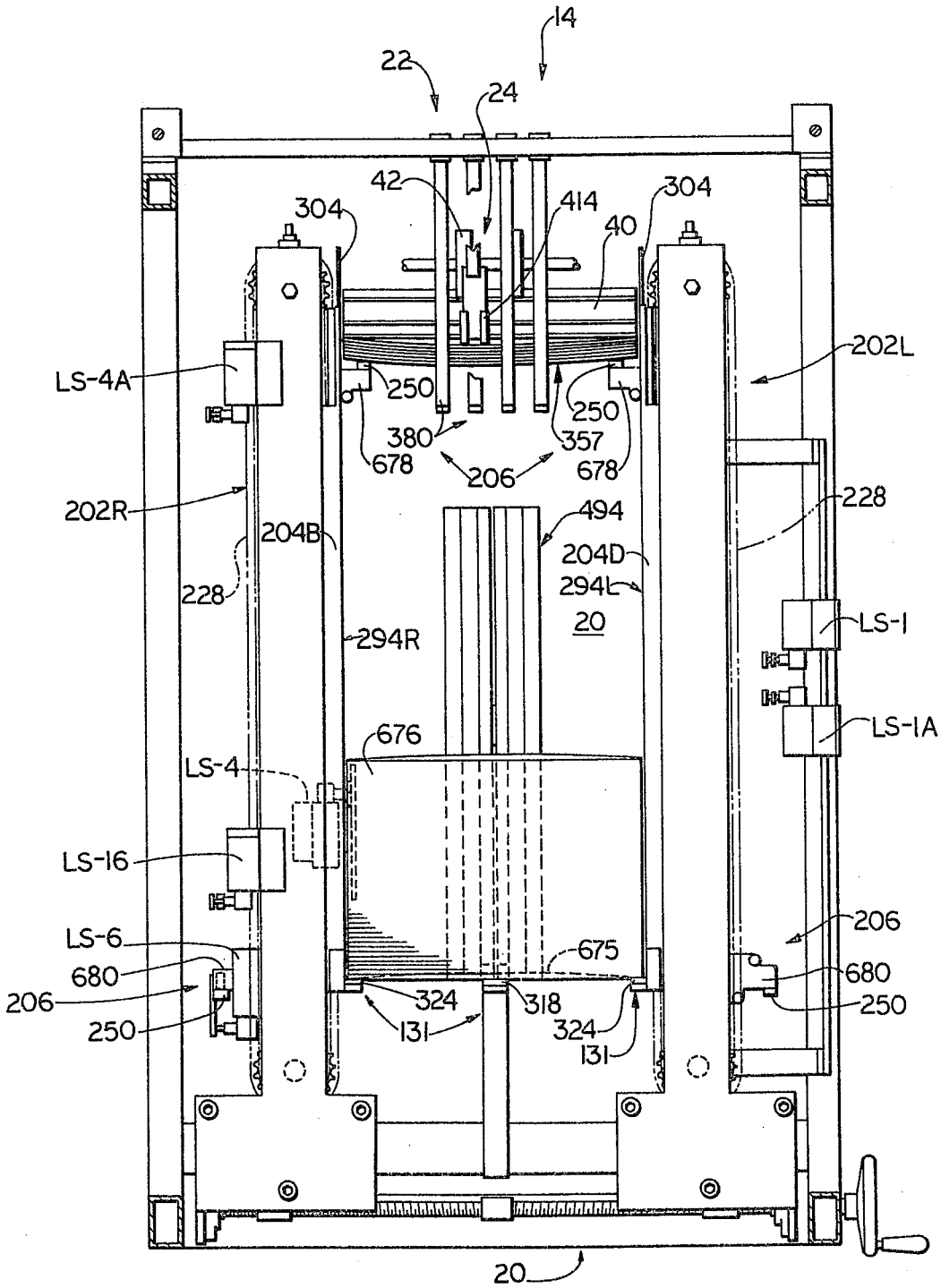
FIG. 12 is a somewhat schematic view in transverse section showing operation of the elevator section of the machine.

As the procession of flattened cartons 40 enter the stacking assembly 14, it is received and laterally guided in a straight path by the pair of input side guide extensions 304 (FIGS. 3, 5 and 6), and then in turn by the inboard faces of the input members of the set of four guide tracks 204A and 204C and the pair of side guides 294L and 294R as is seen in FIGS. 3 and 8. The forward movement of the procession of flattened cartons 40 is arrested by the set of four bar assemblies 380 of the fence assembly 22. The halted cartons therefore commence to build the stack of cartons 357 as again clearly shown in FIG. 3. Referring now to FIGS. 8 and 12, it is seen that the stack of cartons 357 being formed at the top of the stacking assembly 14 rests upon the flight bars 250 of a descending pair of elevator flight assemblies 678 of the set of four elevator flight assemblies 206. The pair of sensing rollers 414 of the rate valve assembly 24 rests lightly upon the top of the stack of cartons 357. As the procession of flattened cartons 40 continues to enter upon the top of the stack of cartons 357 and somewhat forcibly under the pair of sensing rollers 414, the top of the stack of cartons 357 rises. The pair of sensing rollers 414 is raised, as shown in FIG. 8, rotating the radius arm 418 clockwise which, through the linkage of the turnbuckle rod 448, rotates the valve assembly 410 clockwise, thus activating the rate valve 434. The rate or microtorque valve 434 is a proportional device that controls the descent of the descending pair of flight assemblies 678 through control of delivery of fluid to the hydraulic motor 252, and can operate in the manner of the similar device shown and described in Stapp et al. U.S. Pat. No. 3,978,785. A small clockwise rotation of the valve assembly 410 will cause the pair of chain lifts 202L and 202R to advance the bottom of the stack 357 downwardly until the rate valve 434 returns to a neutral position. Thus, the bottom of the stack of cartons 676 is moved downwardly in timed relation with delivery of incoming cartons, with the resulting effect of keeping the top of the stack of cartons 357 at a substantially constant elevation. The stack of cartons 357 being formed in the upper portion of the elevator assembly 20 sags, as can be seen in FIG. 12, since it is supported laterally only along its longitudinal edges by the descending pair of flight assemblies 678. The sag is not due to pressure applied by the pair of sensing rollers 414 but to the strength to weight ratio of the cartons themselves. As the height of the stack of cartons 357 increases, the input face of the stack comes into close vertical alignment with the output face of the pusher face assembly 494 of the number 1 pusher assembly 26, preventing spillage as they move down through the elevator assembly 20.

As the descending pair of flight assemblies 678 moves downwardly, an ascending pair of flight assemblies 680 moves upwardly, since it is opposedly mounted upon the pair of lift chains 228 of the pair of chain lifts 202L and 202R. As is shown in FIG. 12, the right hand member of the ascending pair of flight assemblies 680 leaves the limit switch LS-6 and proceeds upward toward the limit switch LS-16. The limit switch LS-6 controls the delivery of cartons to the belt conveyor 107, as will be explained in greater detail hereinafter, and insures that the descending pair of flight assemblies 678 is in proper place to receive the start of the procession of flattened cartons 40. The limit switch LS-16 is a safety switch that halts the delivery of cartons to the belt conveyor 107 if the number 1 pusher assembly 26 fails to discharge a previous stack or happens to be extended in the output direction and the pusher face assembly 494 is within the confines of the elevator assembly 20. Assuming that the pusher face assembly 494 has discharged any previous stack and is fully retracted, the ascending pair of flight assemblies 680 pass the limit switch LS-16 and continue rising under the control of the rate valve 434. This situation continues until a count limit signal is introduced into the control system by the carton assembling machine 12 (not shown in detail). If this count signal should be given prematurely and before the limit switch LS-1A is actuated, it is ignored by the control circuit of the packing machine 10. The pair of chain lifts 202L and 202R continue until the flight bar 250 of the left hand member of the ascending pair of flight assemblies 680 actuates the limit switch LS-1A. Normally the count signal is given after the limit switch LS-1A is actuated and before the limit switch LS-1 is actuated. This limit switch, under the circumstances, stops the stack forming cycle and initiates a pack cycle. Thus, under normal circumstances, when an accurate count signal is given, the limit switch LS-16 having already been passed, the control system stops the stack forming cycle and initiates a pack cycle.

If the count signal errs by giving the count signal too late or not at all, the limit switch LS-1 terminates the stack forming cycle and initiates the pack cycle. In other terms, the limit switch LS-1 determines a maximum stack height, permitting a pack cycle even if the count circuit fails.

Upon initiation of the pack cycle, the delivery of cartons to the belt conveyor 107 is stopped, and the hydraulic motor 252 is caused to advance the chain lifts 202L and 202R and the stack 357 downwardly in continuous traverse to deliver the stack 357 downwardly into position to actuate the limit switch LS-4 and onto the elevator floor assembly 131. When the stack is deposited on the elevator floor assembly 131, the limit switch LS-4A is actuated. The stack of cartons 357 is then evenly supported upon the slides 324 and the plastic slide rail 318. The input edge of the bottom of the stack of cartons 357 rests upon the pair of post tabs 510 and the pair of short tabs 524 of the pusher face assembly 494 (FIGS. 6 and 11). The input edge of the stack of cartons 357 is thereby held slightly above the plastic slide rail 318, as is indicated in dashed lines at 675 in FIG. 12. The pair of chain lifts 202L and 202R of the elevator assembly 20 continues in continuous traverse, taking the descending pair of flight assemblies 678 down and around the bottom of the pair of chain lifts 202L and 202R where this particular pair of flight assemblies now becomes an ascending pair of flight assemblies 680. As the right hand member of the ascending pair of flight assemblies 680 rises, it actuates the limit switch LS-6, which in turn reactivates the rate valve assembly 24 and the carton assembling machine 12 to begin another stack cycle.

The limit switch LS-4A makes the circuit which energizes the hydraulic cylinder 642 of the number 1 pusher assembly 26, as is shown in FIG. 11. As the piston rod 640 is extended in the output direction, the pairs of output and input radius arms 572 and 547, respectively, are pivoted clockwise to swing the output and input carrier arms 576 and 578 counterclockwise about the pair of bottom shafts 616 of the cam roll guide assembly 554. As the cam roll guide assembly 554 is free to move downwardly, the upper ends of the output and input carrier arms 576 and 578 translate the ram 528 and pusher face assembly 494 horizontally in the output direction, pushing the stack of cartons 357 out of the elevator assembly 20 and into the stack output assembly 16 to the position 357A as shown in FIG. 3. The position of the stack of cartons 357A in the stack output assembly 16 is determined by the limit switch LS-5 shown in FIG. 11. As the actuator lobe 662 of the adjustment plate 660 trips the limit switch LS-5, the forward movement of the pusher assembly 26 is terminated and its withdrawal initiated. On its way back, the switch lug 674 of the left hand member of the pair of output radius arms 572 actuates the limit switch LS-20, indicating that the pusher face assembly 494 is clear of the stack output assembly 16, thereby releasing the stack output assembly 16 so that it can continue its cycle. As the number 1 pusher assembly 26 reaches its full back position, the limit switch LS-3 is actuated to allow the stacking cycle of the elevator assembly 20 to continue as previously described.

MECHANICAL DESCRIPTION STACK OUTPUT ASSEMBLY 16

The stack output assembly 16 is comprised of the turntable assembly 28, the side guide assembly 30 (FIG. 2), the adjustable number 2 pusher assembly 32, and the compressor assembly 34.

Figure 13:
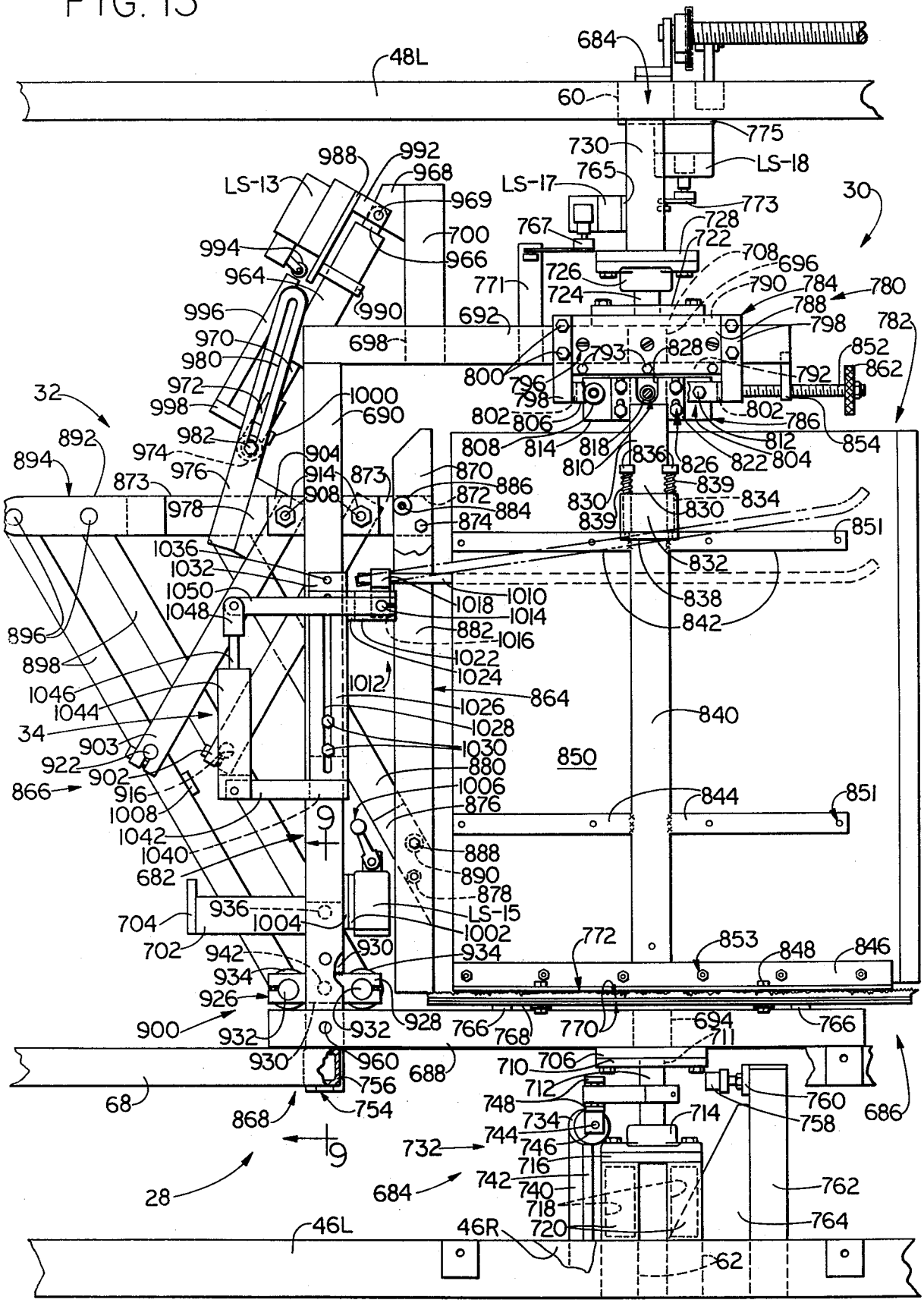
FIG. 13 is a fragmentary view in side elevation of the turntable section of the machine, parts being broken away, compressor bars being shown in raised position in double-dot-dash lines and in horizontal position in full lines.
Figure 14:
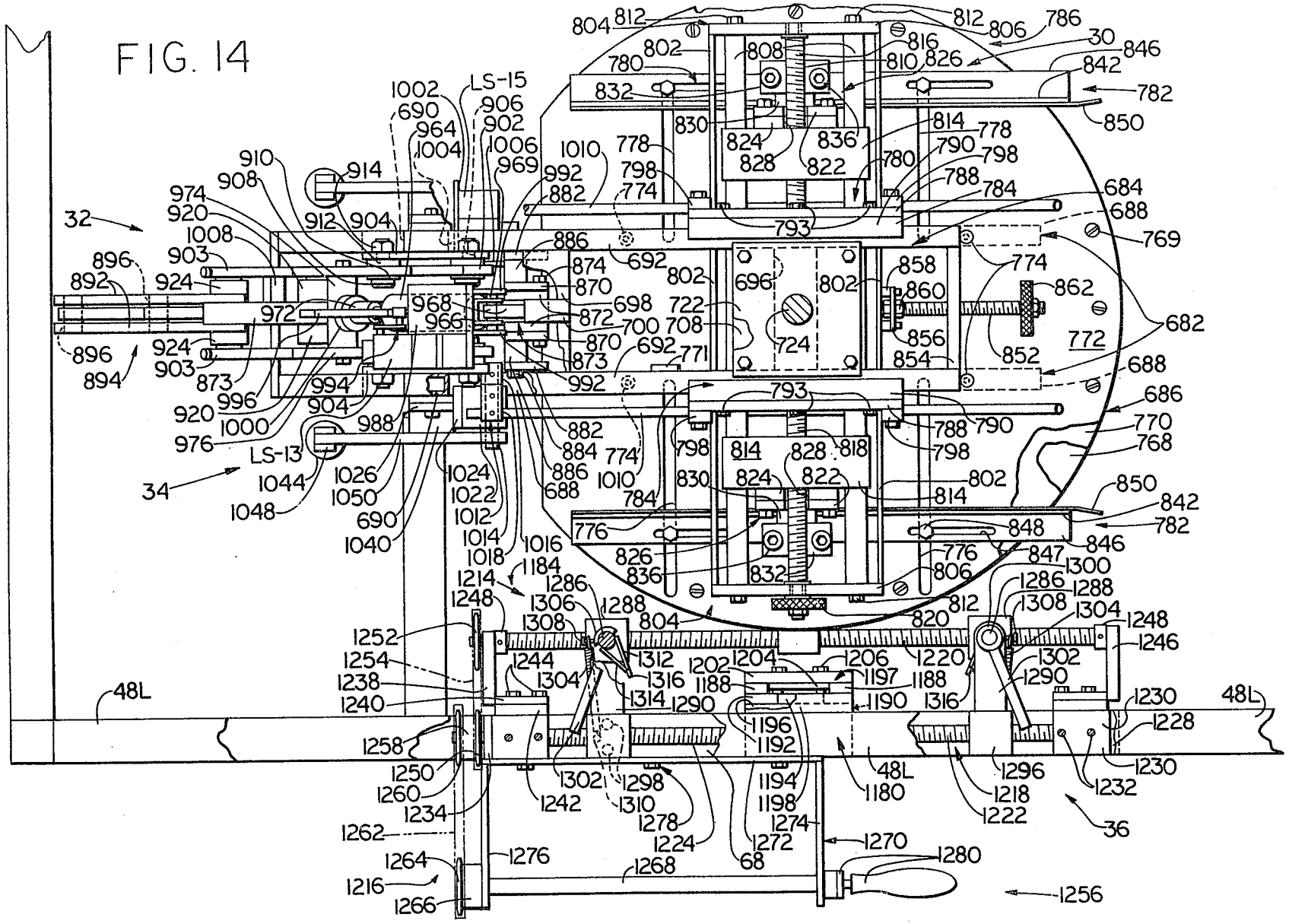
FIG. 14 is a plan view on an enlarged scale of the turntable section, parts being broken away.
Figure 15:
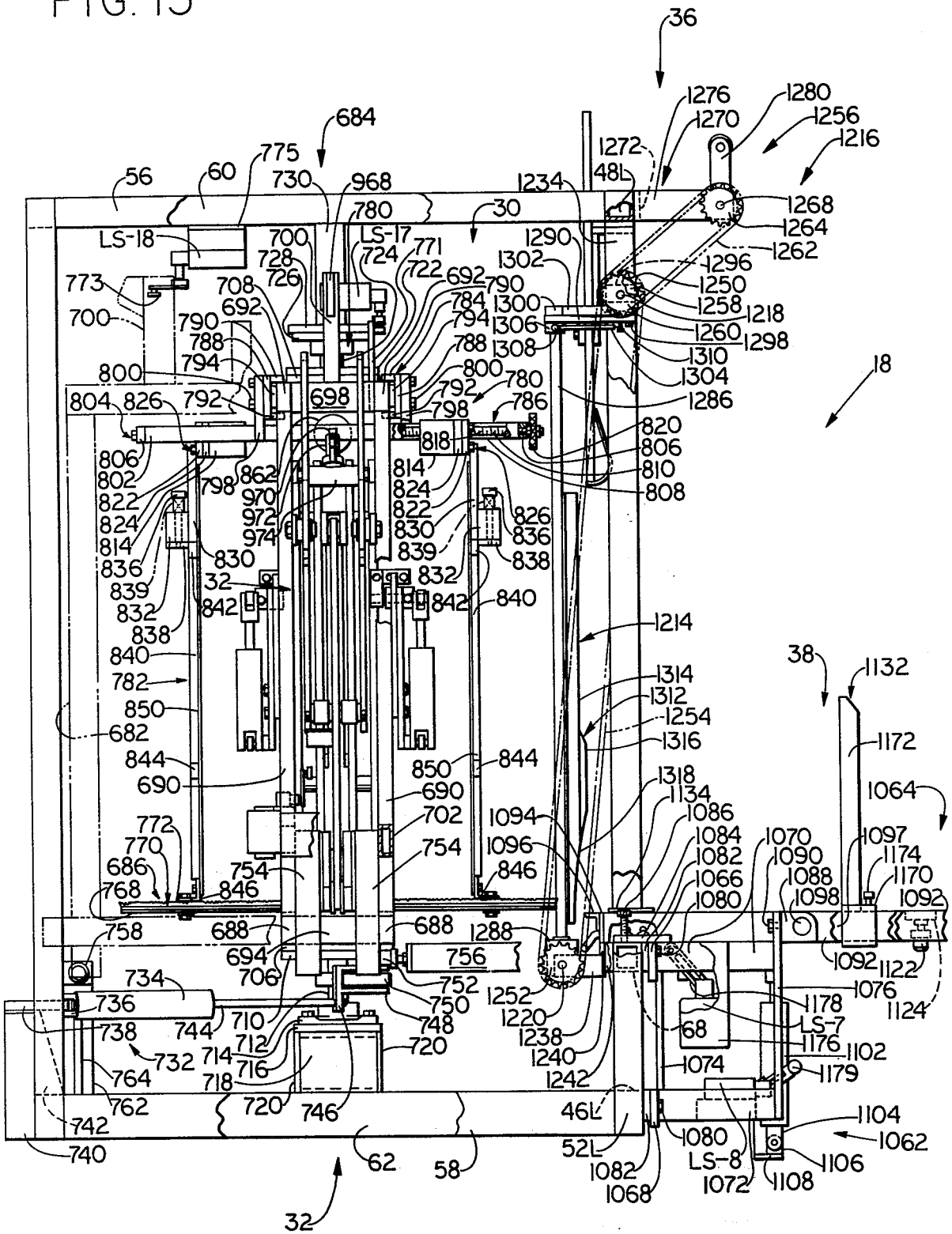
FIG. 15 is a view in end elevation of the turntable section of the machine and of a tip-over section.

The turntable assembly 28 is comprised of a turn frame assembly 682, a pivot assembly 684, and a table assembly 686. As can be seen in FIGS. 13, 14 and 15, the turn frame assembly 682 incorporates a pair of bottom rails 688, a pair of turn frame uprights 690, and a pair of top rails 692. The pair of turn frame uprights 690 is rigidly affixed to the top surface of, and near the output end of, the pair of bottom rails 688. The pair of top rails 692 is rigidly affixed at its output ends to the top extremity of the pair of turn frame uprights 690. Thus, the combination of these parts forms a pair of "C" shaped frames that is held in lateral spaced relationship by a bottom lateral strut 694, a top lateral strut 696, and a top output strut 698. The bottom lateral strut 694 is rigidly affixed between the pair of bottom rails 688, at a longitudinal position that places it closer to the input than the output end. The top lateral strut 696 is rigidly affixed between the pair of top rails 692 and longitudinally placed along them to be in vertical alignment with the bottom lateral strut 694, as is most easily seen in FIG. 13. The top output strut 698 is rigidly affixed between the pair of top rails 692 near the output ends thereof, and also functions as mounting structure for an actuator riser mount bar 700. The actuator riser mount bar 700 is rigidly affixed at its bottom extremity to the top surface of, and at the center of, the top output strut 698. A cantilever extension 702 is rigidly affixed at its input end to the lower output surface of each of the turn frame uprights 690. A lateral plate 704 is rigidly affixed across the output extremities of the cantilever extension 702 to provide lateral rigidity to the turn frame assembly 682 as well as mounting means for necessary hydraulic equipment that is not shown in detail. A bottom mount plate 706, that is approximately square in plan form, is rigidly affixed to the bottom of the turn frame assembly 682, and centered about the intersection of the bottom lateral strut 694 and the pair of bottom rails 688. A top mount plate 708 is rigidly affixed upon the top of the turn frame assembly 682 and centered about the intersection of the top lateral strut 696 and the pair of top rails 692. As shown in FIG. 14, the top mount plate 708 is approximately square in plan form, with its lateral dimension being less than the overall width of the turn frame assembly 682 in order to expose most of the top surface of the pair of top rails 692 to function as slide rails, this function being discussed hereinafter.

The turn frame assembly 682 is pivotally mounted within the frame assembly 44 as shown in FIGS. 13, 14, 15 and 16. The pivot assembly 684 incorporates a bottom pivot mount plate 710 that is fixedly attached to the lower face of the bottom mount plate 706 and is equal in plan form shape thereto. The bottom pivot mount plate 710 has a central bore 711 in which a bottom pivot shaft 712 is rigidly mounted. The bottom pivot shaft 712 extends vertically downward and is rotatably held in a bottom pivot bearing 714. The bottom pivot shaft 712 passes through the bottom pivot bearing 714 and bears against the top surface of a turn frame support plate 716 which supports the weight of the turn frame assembly 682. The bottom pivot bearing 714 is fixedly attached to the turn frame support plate 716, that is in turn rigidly affixed to the upper surfaces of a pair of rectangular tube mounts 718. The four ends of the pair of rectangular tube mounts 718 are closed by a set of four end plates 720, rigidly affixed thereto. The pair of rectangular tube mounts 718 is rigidly affixed upon the top of, and at the center span of, the pair of bottom middle lateral stiffeners 62.

A top pivot mount plate 722 is fixedly attached to the top surface of the top mount plate 708 and is of the same plan form shape thereof. The top pivot mount plate 722 has a central bore in which a top pivot shaft 724 is rigidly mounted. The top pivot shaft 724 rises vertically to pivotally mount in a top pivot bearing 726 that is in turn fixedly attached to the bottom surface of a turn frame mount plate 728. The turn frame mount plate 728 is rigidly affixed at the center of its upper surface to the bottom extremity of a turn frame mount hanger 730, that is in turn rigidly affixed at its top extremity to the bottom surface of, and at the center of, the top middle lateral stiffener 60 of the frame assembly 44.

Figure 16:
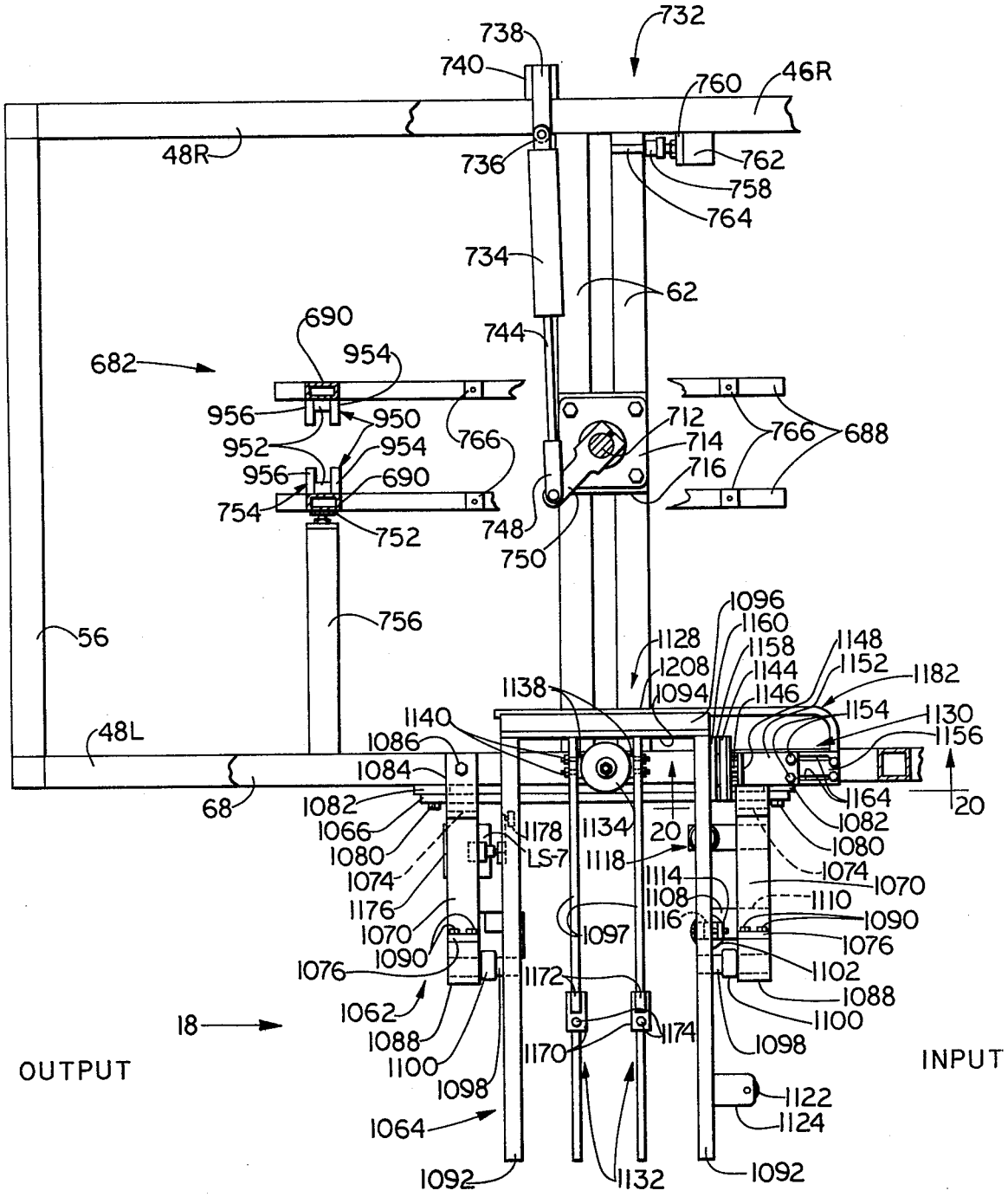
FIG. 16 is a fragmentary plan view of the turntable and tip-over sections of the machine with turntable portions removed to show operation thereof.

The turn frame assembly 682 is turned by a pivot actuator assembly 732, as is best shown in FIG. 16, but is also shown in FIGS. 13 and 15. The pivot actuator assembly 732 includes a pivot cylinder 734 that integrally incorporates a base mounting yoke 736, that is in turn pivotally attached to the inboard end of a cylinder mount bar 738. The cylinder mount bar 738 is rigidly affixed in a lateral orientation across the top end of a cylinder mount riser 740 that is in turn rigidly affixed at its lower inboard surface to the right hand face of the right hand bottom stringer 46R. The lateral and vertical stability of the cylinder mount riser 740 is assured by a gusset 742, which is rigidly affixed to the inboard surface of the cylinder mount riser 740 and the top surface of the right hand bottom stringer 46R. The longitudinal placement of the cylinder mount riser 740 is slightly downstream of the output member of the pair of bottom middle lateral stiffeners 62, as is shown in FIG. 16. The free end of a cylinder rod 744 of the pivot cylinder 734, is threadably attached within a downwardly extending flange 746 of an offset pivot yoke 748, that is pivotally attached to the free end of a pivot arm 750. The pivot arm 750 is fixedly clamped to the bottom pivot shaft 712 of the turn frame assembly 682.

As the pivot cylinder 734 extends its cylinder rod 744, the turn frame assembly 682 is pivoted counterclockwise with respect to FIG. 16. The turn frame assembly 682 is held in longitudinal alignment with the packing machine 10 by the pivot cylinder 734 and a longitudinal stop 752, that comes into rigid contact with the lower outboard surface of the left hand member of a cam roll guide assembly 754 of the adjustable pusher assembly 32 as is shown in FIGS. 13, 15 and 16. As can be seen in the drawings, the cam roll guide assemblies 754 are fixedly attached to the lower inboard surfaces of the turn frame uprights 690 of the turn frame assembly 682. The longitudinal stop 752 is threadably and adjustably mounted into the right hand end of a longitudinal stop mount 756. The longitudinal stop mount 756 is rigidly affixed in a lateral orientation, and in a cantilever manner, to the inboard surface of the short longitudinal beam 68.

As the pivot cylinder 734 retracts its cylinder rod 744, the turn frame assembly 682 is pivoted clockwise with respect to FIG. 16. The turn frame assembly 682 is thus swung around through an arc of 90 degrees to a lateral position as is shown in double dot-dash lines in FIGS. 3 and 15, and is held there by the pivot cylinder 734 and a lateral stop 758 (FIG. 13). The lateral stop 758 comes into resistive contact with the bottom outboard surface of the right hand member of the cam roll guide assemblies 754. The lateral stop 758 is threadably and adjustably mounted into the output face of a thread block 760 that is in turn rigidly affixed to the upper output surface of a lateral riser mount 762. The lateral riser mount 762 is rigidly affixed in an upright position to the inboard surface of the right hand bottom stringer 46R. Its vertical and longitudinal disposition is assured by the addition of a large gusset 764 that is rigidly affixed in an upright orientation to the output face of the lateral riser mount 762. The output bottom edge of the large gusset 764 is rigidly affixed across the top surface of the input member of the pair of bottom middle lateral stiffeners 62.

With reference to FIGS. 13 and 15, a limit switch LS-17 is fixedly attached to a plate mount 765 that is in turn rigidly affixed to the output surface of the turn frame mount hanger 730 just above the top pivot bearing 726. The plate mount 765 extends in a cantilever manner toward the left side of the stack output assembly 16 to dispose a switch arm and roller 767 of the limit switch LS-17 into working relationship with a switch trip 771. The switch trip 771 is rigidly affixed in an upright disposition to the inboard surface of left hand member of the pair of top rails 692, approximately midway between the top lateral strut 696 and the top output strut 698. With the cylinder rod 744 of the pivot cylinder 734 extended, as has been discussed heretofore, the turn table assembly 28 is in the longitudinal position (FIG. 13) and the limit switch LS-17 is activated. As the cylinder rod 744 is retracted, the limit switch LS-17 is released, and the turn frame assembly 682 pivots clockwise with reference to FIG. 14. As the turn frame assembly 682 comes to rest at its lateral position, shown in FIG. 15 in double dot-dash lines, the actuator riser mount bar 700 comes into working association with a switch arm and roller 773 of a limit switch LS-18, thus making a circuit that indicates that the turn frame assembly 682 is in its lateral position. The limit switch LS-18 is fixedly attached to a switch mount plate 775 that is in turn rigidly affixed across the bottom surface of the top middle lateral stiffener 60.

The table assembly 686 (FIGS. 13, 14 and 15) is fixedly attached to the top surface of the pair of bottom rails 688 of the turn frame assembly 682 through the interspacing auspices of a set of four shim mounts 766 as shown in FIG. 16. The set of four shim mounts 766 is rigidly affixed in a distributive orientation to the top surface of the pair of bottom rails 688. The component parts of the table assembly 686 are of circular plan form shape, save for the output side that is cut off straight to accommodate the adjustable pusher assembly 32. The table assembly 686 is comprised of a metal base plate 768, a fiberboard spacer 770 and a rug 772. These three components are fixedly held together by a set of four flathead bolts 774 (FIG. 14) that pass through vertically aligned holes in each member to threadably mount into the set of four shim mounts 766. Additionally, the rug 772 and the fiberboard spacer 770 are fixedly attached to the metal base plate 768 by a set of nine flat head screws 769, appropriately spaced about the circumference of the table assembly 686, as shown in FIG. 14. The table assembly 686 incorporates a pair of long left hand slots 776 and a pair of short right hand slots 778. Both pairs of slots are laterally disposed are are utilized to stabilize the side guide assembly 30 as will be discussed hereinafter. The rug 772 is provided with an upwardly directed resilient pile face across which the stack 357 can be advanced without scratching or deforming of the bottom-most article in the stack.

The side guide assembly 30 of the stack output assembly 16 is comprised of an adjustable mount assembly 780 and a guide plate assembly 782 as is shown in FIGS. 13, 14 and 15. The adjustable mount assembly 780 is further comprised of a longitudinal slide mount 784 and a lateral adjustment mount 786. The longitudinal slide mount 784 incorporates a pair of side plates 788. The side plates 788 are in parallel alignment with the pair of top rails 692. A pair of top slide rails 790 is rigidly affixed upon the inboard surfaces of and along the top edge of the pair of side plates 788 and extend inwardly to partially ride upon the top surface of the pair of top rails 692. A pair of bottom slide rails 792 is fixedly attached by a set of six bolts 793 (FIGS. 13 and 14), along the bottom inboard surface of the pair of side plates 788, and extend inwardly to slidably ride along the bottom surface of the pair of top rails 692. The set of six bolts 793 passes through clear holes along the bottom edge of the pair of side plates 788 and threadably mount into the edge of the pair of bottom slide rails 792. A pair of non-metal slide shoes 794 (FIG. 15) is fixedly attached along the inboard surfaces of the pair of side plates 788 by a set of six flat head screws 796 (3 each side) that pass through clear holes in the pair of side plates 788 and threadably fasten into the pair of non-metal slide shoes 794 as is shown in FIG. 13. A set of four hangers 798 is fixedly attached to the outboard surface of, and adjacent each end of, the pair of side plates 788. Each member of the set of four hangers 798 incorporates a pair of clear holes near its upper end, through which a pair of bolts 800 cleanly pass to threadably mount into the appropriate outboard end of the pair of side plates 788. The opposing halves of the longitudinal slide mount 784 are held in lateral and fixed relationship by a pair of lateral bar mounts 802. The input member of the pair of lateral bar mounts 802 is rigidly affixed in an edge up orientation across the bottom output edges of the pair of input hangers of the set of four hangers 798. The output member of the pair of lateral bar mounts 802 is rigidly affixed in a similar manner across the bottom input edges of the pair of output hangers of the set of four hangers 798.

The lateral adjustment mount 786 incorporates a rectangular framework 804 that is formed by rigidly affixing across the outboard extremities of the pair of lateral bar mounts 802 a pair of mount bars 806. The pair of mount bars 806 provides mounting structure for a pair of slide bars 808 and a lateral adjustment screw 810. The pair of slide bars 808 is fixedly attached in parallel alignment between the pair of mount bars 806 by a set of four bolts 812 that pass through clear holes in the pair of mount bars 806 and threadably mount into each end of the pair of slide bars 808. The horizontal and lateral placement of the pair of slide bars 808 is such that the slide bars 808 lie adjacent to the inboard surfaces of the pair of lateral bar mounts 802 to provide mounting space for the lateral adjustment screw 810, a pair of side guide slide blocks 814, and the guide plate assembly 782.

The lateral adjustment screw 810 is comprised of two segments; a right hand segment 816 and a left hand segment 818. The right hand segment 816 utilizes a left hand thread, the outboard end of which integrally incorporates a short length of smooth shaft of smaller diameter that is rotatably mounted into the center of the right hand member of the pair of mount bars 806. The left hand segment 818 utilizes a right hand thread, the outboard end of which incorporates a length of clear shaft of smaller diameter that is rotatably mounted through the center of the left hand member of the pair of mount bars 806. The right and left hand segments 816 and 818 respectively are fixedly attached in axial alignment at their opposing inboard ends by a shaft coupler, not shown. A hand wheel 820 is fixedly attached to the outboard end of the left hand segment 818 of the lateral adjustment screw 810 for manual rotation thereof.

The pair of side guide slide blocks 814 is slidably mounted, by means of clear parallel holes therethrough, upon the pair of slide bars 808. Each of the side guide slide blocks 814 is also threadably mounted, by means of a threaded hole through the center thereof, upon the lateral adjustment screw 810, such that when the hand wheel 820 is rotated, the pair of side guide slide blocks 814 move apart or toward each other as may be required.

The guide plate assembly 782 incorporates a pair of mount pads 822 that is fixedly attached to the outboard surfaces of the pair of side guide slide blocks 814 through the interspacing auspices of a pair of matched spacers 824. A set of four bolts 826 passes through clear and aligned vertical slots in each of the pairs of mount pads and matched spacers 822 and 824, respectively, to threadably mount into the outbaord surface of the pair of side guide slide blocks 814. The vertical slots in the pairs of mount pads and matched spacers 822 and 824, respectively, give a degree of vertical adjustment to the guide plate assembly 782 so that the bottom extremity thereof can be initially set in close proximity to the table assembly 686. The pair of mount pads and matched spacers 822 and 824, respectively, incorporate an open end slot 828 that enters from the top edge thereof to permit free installation of the parts about the intervening presence of the lateral adjustment screw 810, with which they have no contact. The outboard faces of the pair of mount pads 822 rigidly incorporate a pair of top hanger mounts 830 that is mounted in vertical alignment with the lateral adjustment screw 810, as is shown in FIG. 13. A pair of retainer blocks 832 is rigidly affixed to the outboard surfaces of, and adjacent the bottom ends of, the pair of top hanger mounts 830. Each of the pair of retainer blocks 832 incorporates a pair of clear vertical holes 834 through which pass a pair of long shoulder bolts 836. The pair of long shoulder bolts 836 threadably mounts into a plate mount 838 that is in turn rigidly affixed along its inboard edge to the top outboard surface of a vertical side brace 840 (FIGS. 13 and 15). Intervening between the heads of the pair of long shoulder bolts 836 and the top surface of the pair of retainer blocks 832 is a pair of compression springs 839. The pair of compression springs 839 forcibly lift the plate mount 838 into flush contact with the bottom surface of the pair of retainer blocks 832. The vertical side brace 840 extends vertically downward and functions as a central structural member for a pair of top longitudinal braces 842, a pair of mid-longitudinal braces 844, and a bottom longitudinal angle 846. The pair of top longitudinal braces is rigidly and perpendicularly affixed to, and in coplanar orientation with, the upper input and output edges of the vertical side brace 840, such that the resultant structure is in the shape of a "T". It is also rigidly affixed to the protruding inboard edges of, and level with the top edge of, the plate mount 838. The pair of mid-longitudinal braces 844 is similarly attached to the input and output edges of the vertical side brace 840, approximate the lower portion thereof. The top edge of the vertical flange of the bottom longitudinal angle 846 is rigidly affixed along the bottom edge of, and coplanar with, the inboard surface of the vertical side brace 840. The horizontal flange of the bottom longitudinal angle 846 extends outwardly and incorporates in clear slots 847 therein (FIG. 14), a pair of nut and bolt assemblies 848. The pairs of nut and bolt assemblies 848 cooperate with the pairs of long left hand slots 776 and short right hand slots 778 for holding the bottom extremity of the guide plate assembly 782 in fixed relationship with the table assembly 686. As the pairs of nut and bolt assemblies 848 is turned down tightly, the bottom longitudinal angles 846 are pulled down into the rug 772, thus pulling the plate mounts 838 downward away from the pair of top hanger mounts 830 and compressing the pairs of compression springs 839. Thus, the bottom extremity of the guide plate assembly 782 can be brought repeatedly into compressive contact with the table assembly 686 without loosening the set of eight bolts 826.

A side guide plate 850 is fixedly attached to the inboard surface of the vertical side brace 840, the pair of top longitudinal braces 842, the pair of middle longitudinal braces 844 and bottom longitudinal angle 846 in such manner that the upper portion of the side plate 850 extends upwardly and forwardly beyond the confines thereof. The side guide plate 850 is fixedly attached to the pairs of top and middle longitudinal braces 842 and 844, respectively, and the vertical side brace 840 by a plurality of flat head screws 851 that fit through countersunk holes in the side guide plate 850 and threadably mount into the inboard surfaces of the aforementioned braces. This leaves the heads of the plurality of flat head screws 851 flush with the inboard surface of the side guide plate 850. A plurality of flat head bolts 853 similarly attach the bottom longitudinal angle 846 to the bottom extremity of the side guide plate 850. Although each of the side guide plates 850 rises to within close proximity of the mount pad 822 associated therewith, it is not attached to the associated top hanger mount 830 and is therefore free to slide thereagainst. The input edge of the side guide plate 850 is turned outwardly to facilitate the incoming stack of cartons. The entire side guide assembly 30 can be adjusted in the longitudinal direction by means of a jack screw 852 (FIGS. 13 and 14) that is threadably mounted through the lower portion of a longitudinal adjustment plate 854. The plate 854 is mounted between the input extremities of the pair of top rails 692 of the turn frame assembly 682. The longitudinal adjustment plate 854 extends downwardly from the pair of top rails 692 to bring the jack screw 852 into horizontal alignment with the input member of the pair of lateral bar mounts 802. As is seen in FIG. 14, the output end of the jack screw 852 passes through a clear hole in a retainer plate 856, that is in turn fixedly attached at each end thereof, to the input face of the input member of the pair of lateral bar mounts 802 through the interspacing auspices of a pair of bar spacers 858. A pair of retainer nuts 860 is threadably mounted upon the output end of the jack screw 852, one on each side of the retainer plate 856, and pinned in place thereupon, to rotatably retain the output end of the jack shaft 852 within the clear hole of the retainer plate 856. The input end of the jack shaft 852 fixedly incorporates a hand wheel 862 so that the longitudinal position of the side guide assembly 30 can be changed manually as desired.

The adjustable number 2 pusher assembly 32, shown in FIGS. 9 and 13–17 inclusive, is comprised of a front fence and ram assembly 864, a scissors assembly 866 and a mounting structure assembly 868. The front fence and ram assembly 864 (FIGS. 13, 14 and 17) incorporates a pair of pusher bars 870 that is fixedly attached near the top thereof to the outboard surfaces of a pair of ram spacer blocks 872 that is in turn rigidly affixed to the sides, of and at the input end of, a horizontal ram 873. A pair of bolts 874 passes through clear holes in the pair of pusher bars 870 and threadably mount into the lower input corner of the pair of ram spacer blocks 872. The lower portion of the pair of pusher bars 870 is fixedly attached to the outboard sides of a pair of stiffener spacer pads 876 by a pair of bolts 878 that pass through clear holes in the pair of pusher bars 870 and threadably mount into the pair of stiffener spacer pads 876. The pair of stiffener spacer pads 876 is rigidly affixed to the sides of, and at the bottom of, a fence stiffener 880. The fence stiffener 880 is rigidly affixed at its top end to the bottom surface of the horizontal ram 873 to form the triangular shaped support structure shown in FIG. 13. A pair of auxiliary pusher bars 882 of identical shape to that of the pair of pusher bars 870 is fixedly and spacedly mounted outboardly of the pair of pusher bars 870 by a pair of upper bolts 884 (FIG. 14), a pair of upper tube spacers 886, a pair of lower bolts 888, and a pair of lower tube spacers 890. Both pairs of upper and lower bolts 884 and 888, respectively, pass through clear holes in the pair of auxiliary pusher bars 882, then through the pair of upper and lower tube spacers 886 and 890, respectively, to threadably mount into the pair of pusher bars 870 adjacent to the ram spacer blocks 872 and stiffener spacer pads 876, respectively. In this manner, the pair of auxiliary pusher bars 882 can be easily removed to accommodate cartons of narrow width. The output extremity of the horizontal ram 873 rigidly incorporates a pair of tines 892 to form a thrust yoke 894. The input ends of the inboard surfaces of the pair of tines 892 are recessed for mating closely with the output end of the horizontal ram 873 (FIG. 14) to limit the overall width of the thrust yoke 894.

Figure 17:
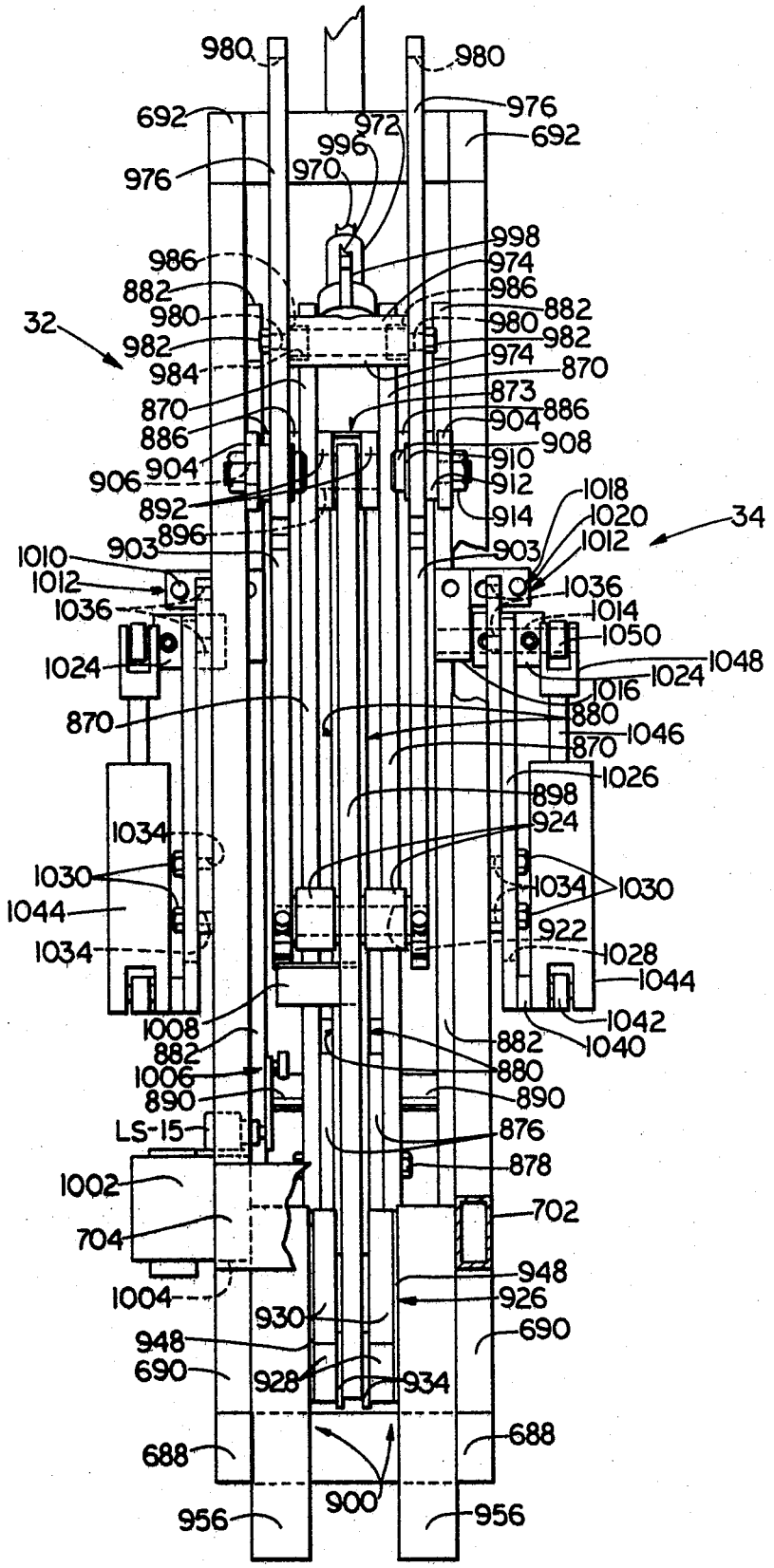
FIG. 17 is a fragmentary view in end elevation showing turntable operating linkages.

A pair of yoke pins 896 is clampedly and spacedly mounted in a lateral disposition within the thrust yoke 894. A pair of carrier arms 898 is pivotally mounted upon the pair of yoke pins 896 and extends downwardly and in the input direction to pivotally mount at its bottom extremity to a cam roll mount assembly 900 that will be discussed hereinafter. A pair of input radius arms 902 and a pair of output radius arms 903 are pivotally mounted at their upper ends to a pair of top pivot mounts 904 as can be seen in FIGS. 14 and 17. The top pivot mounts 904 are rectangular in shape and each of the top pivot mounts 904 is rigidly affixed across the inboard surface of one of the pair of turn frame uprights 690 of the turn frame assembly 682. The pair of top pivot mounts 904 is mounted in the same horizontal plane as the horizontal ram 873 and incorporates a set of four threaded holes 906, one in each end of the overextending portions thereof. Each member of the pair of input and output radius arms 902 and 903 is pivotally and spacedly mounted at its upper end to the respective end of one of the top pivot mounts 904 by a shoulder bolt 908, a washer 910, a spacer 912, and a nut 914 as shown in FIG. 17. Thus, the input and output radius arms 902 and 903 are pivotally mounted inboard of the pair of top pivot mounts 904 and swing downwardly to be pivotally attached at the mid-span of the carrier arms 898. The lower extremity of the pair of input radius arms 902 clampedly incorporates therebetween a middle input pivot pin 916 (FIG. 13), that in turn pivotally passes through the input member of the pair of carrier arms 898 and is held centeredly thereupon by a pair of tubular spacers 920 (FIG. 14). The lower extremity of the pair of output radius arms 903 clampedly incorporates between its members a middle output pivot pin 922, that pivotally passes through the output member of the pair of carrier arms 898, and is held centeredly thereupon by a pair of tubular spacers 924 (FIGS. 14 and 17).

The cam roll mount assembly 900 is comprised of a pair of cam roll mounts 926 that is shown in FIGS. 9, 13 and 17. Each of the mounts 926 includes a horizontal mount bar 928 and a vertical mount bar 930. The vertical mount bar 930 is rigidly affixed in an upright manner to the central portion of the top edge of the horizontal mount bar 928 so that each cam roll mount 926 is of inverted "T" shape. A pair of bottom carrier pins 932 is clampedly mounted between the pair of cam roll mounts 926, centeredly mounted within the overextending portions of the two horizontal mounts 928. The bottom ends of the pair of carrier arms 898 are pivotally mounted upon the bottom carrier pins 932 and laterally and spacedly held in place thereupon by a set of four thrust washers 934. An upper cam roll 936 is rotatably mounted upon a cam bolt 938 (FIG. 9) that is in turn threadably mounted into the upper outboard side of the vertical mount 930. The cam bolt 938 is fixedly held in place by a set screw 940 that threadably enters the top of the vertical mount 930 to intersect therewith. A lower cam roll 942 is also rotatably mounted upon a cam bolt 944 that is in turn threadably mounted into the center of the outboard side of the horizontal mount 928. The cam bolt 944 is fixedly held in place by a bottom set screw 946 that is threadably mounted into the bottom of, and at the center of, the horizontal mount 928, such that the bottom set screw 946 and the threaded portion of the cam bolt 944 intersect, thereby clamping it in place. The upper cam roll 936 and the lower can roll 942 are mounted in vertical alignment with each other. A slide plate 948 is loosely mounted between the upper and lower cam rolls 936 and 942, respectively, and the outboard surface of each member of the pair of cam roll mounts 926. The cam bolts 938 and 944 pass through clear holes in the slide plate 948. The slide plate 948 is the same width as the vertical mount bar 930, but extends downwardly to the bottom extremity of the horizontal mount bar 928. The two slide plates 948 ride frictionally upon the inboard surfaces of the cam roll guide assembly 754 (the cam roll guide assembly 754 being shown in top view in FIG. 16), thereby retaining the cam roll mount assembly 900 in lateral spaced relationship with the turn frame assembly 682. Referring to FIGS. 9 and 16, the cam roll guide assembly 754 is comprised of a pair of upright channels 950. Each member of the pair of upright channels 950 is composed of a base 952, an input flange 954 and an output flange 956. The input flange 954 and the output flange 956 are rigidly affixed along the input and output sides of the base 952, the flanges extending inwardly to form a channel type track within which the upper and lower cam rolls 926 and 942 narrowly fit. This closeness of fit permits the cam roll mount assembly 900 only a vertical degree of freedom. The cam roll guide assembly 754 is fixedly attached to the lower inboard surfaces of the pair of turn frame uprights 690 and to the inboard surfaces of the pair of bottom rails 688 directly adjacent to the bottom of the pair of turn frame uprights 690. Referring again to FIG. 9, a pair of bolts 958 can be reached through a pair of access holes 960, one in the outboard surface of the right hand member of the pair of turn frame uprights 690, the other in the outboard surface of the right hand member of the pair of bottom rails 688. The pair of access holes 960 is vertically aligned. The bolts 958 subsequently pass through clear holes 962 that are axially aligned with the access holes 960, and threadably mount into the base 952, thus fixedly attaching the cam roll guide assembly 754 to the turn frame assembly 682.

As the pairs of input and output radius arms 902 and 903 rotate counterclockwise (with respect to FIG. 13) about the four shoulder bolts 908, the lower ends thereof swing through a circular arc, forming the pair of carrier arms 898 to rotate clockwise about the descending pair of bottom carrier pins 932. As the pair of bottom carrier pins 932 descend, the top extremities of the pair of carrier arms 898 move in a horizontal plane toward the input end of the stack output assembly 16, thus properly moving the front fence and ram assembly 864.

The adjustable pusher assembly 32 receives its motive power from a hydraulic cylinder 964 that is shown in FIGS. 13 and 14, and partially in FIGS. 15 and 17. The base of the hydraulic cylinder 964 integrally incorporates a mounting yoke 966 that is in turn pivotally attached to a cylinder base lug 968 by a pin 969. The cylinder base lug 968 is rigidly affixed to the upper output face of the cylinder riser mount bar 700. A cylinder rod 970 of the hydraulic cylinder 964 extends downwardly and threadably incorporates upon its free end an adapter bar 972 also shown in FIGS. 13 and 17. The lower end of the adapter bar 972 is rigidly affixed to the side of a pusher sleeve 974, that is in turn laterally disposed between a pair of actuator bars 976. The adapter bar 972 and the pusher sleeve 974 form a "T" shaped end lug upon the lower terminus of the cylinder rod 970. The pair of actuator bars 976 is rigidly affixed to the upper output surface of the pair of output radius arms 903 through the intervening auspices of a pair of connector plates 978 (FIG. 13). The pair of actuator bars 976 incorporates a pair of long slots 980 in the upper portion thereof. A pair of bolts 982 pass cleanly through the long slots 980 (FIG. 17) and threadably mount into the ends of a sleeve shaft 984. The sleeve shaft 984 is pivotally mounted in a pair of bushings 986 that is pressed into the ends of the pusher sleeve 974. The length of the pusher sleeve 974 is slightly less than that of the sleeve shaft 984, so that when the pair of bolts 982 is tightened, thereby clamping the pair of actuator bars 976 to the ends of the sleeve shaft 984, the pusher sleeve 974 will remain pivotally free. In this manner, the end of the cylinder rod 970 can be pivotally attached to the pair of actuator bars 976 at any selected point along the length of the pair of long slots 980. FIG. 13 shows this adjustment at the bottom of the pair of long slots 980 which subsequently sets the front fence and ram assembly 864 in its full back position. As the adjustment moves up the pair of long slots 980, the front fence and ram assembly 864 is proportionately set forward, so that the starting point of the assembly 864 moves forward. It does not effect its full travel point that is set by a limit switch to be discussed hereinafter.

A limit switch LS-13, mounted in conjunction with the hydraulic cylinder 964 and shown in FIGS. 13 and 14, is utilized to signal the control system that the adjustable pusher assembly 32 is in the returned or full back position. The limit switch LS-13 is fixedly mounted to a cylinder switch plate 988 that is in turn rigidly affixed to the upper output edge of a cylinder plate mount 990 (FIG. 13). The cylinder plate mount 990 incorporates a clear hole therethrough, so that the plate mount 990 can slidably fit around the case of the hydraulic cylinder 964. The cylinder switch plate 988 is retained in fixed relationship with the hydraulic cylinder 964 by a pair of upper legs 992. Upper extremities of the legs 992 are rigidly affixed to the underside of, and at the input end of, the cylinder switch plate 988. Lower end portions of the legs 992 are pivotally mounted upon the outboard extremities of the pin 969 of the mounting yoke 966 and on opposite sides of the cylinder base lug 968. As can be seen in FIG. 14, the cylinder switch plate 988 extends to the left of the cylinder plate mount 990 and the pair of upper legs 992, and it is this extended left portion of the plate 990 on which the limit switch LS-13 is mounted. The head of the limit switch LS-13 extends downwardly and pivotally incorporates a switch arm and roller 994. The switch arm and roller 994 is so positioned to the inboard side of the limit switch LS-13 that its roller comes into working relationship with the upper extremity of a switch trip bar 996. The lower extremity of the switch trip bar 996 is rigidly affixed to the upper input side of a trip standoff bar 998 shown in FIGS. 13 and 17. The trip standoff bar 998 is rigidly affixed at its lower extremity to the upper side of a trip clamp ring 1000 (FIGS. 13, 14 and 17). The trip clamp ring 1000 is clampedly mounted upon the adapter bar 972 of the hydraulic cylinder 964, adjacent to the pusher sleeve 974. Therefore, as the hydraulic cylinder 964 returns to its closed position, the upper extremity of the switch trip bar 996 rotates the switch arm and roller 994 of the limit switch LS-13 counterclockwise (with respect to FIG. 13), thus making the circuit that indicates that the adjustable pusher assembly 32 is in its full back position. It should also be pointed out that the adjustable features of the pusher do not affect the positioning and operation of the limit switch LS-13.

The adjustable pusher assembly 32 is controlled in its forward throw by a limit switch LS-15 that is generally located upon the lower right hand output corner of the turn frame assembly 682 as is shown in FIGS. 13, 14 and 17. The limit switch LS-15 is fixedly attached to a lateral switch plate 1002 that is in turn rigidly affixed to the lower input surface of the right hand member of the pair of turn frame uprights 690 fhrough the interspacing auspices of a switch plate spacer 1004. The lateral switch plate 1002 extends the limit switch LS-15 slightly to the right of the turn frame assembly 682. The head of the limit switch LS-15 stands uprightly and pivotally extends a switch arm and roller 1006 inboardly to come into working relationship with a switch tab 1008. The switch tab 1008 is rigidly affixed to the input edge of, and approximately at the mid span of, the output member of the pair of carrier arms 898 and extends outboardly to the right thereof. As the adjustable pusher assembly 32 moves forward, the switch tab 1008 moves downwardly and forwardly into contact with the roller of the switch arm and roller 1006 of the limit switch LS-15. The limit switch LS-15 is thereby actuated to cause stopping of the forward movement of the adjustable pusher assembly 32.

The compressor assembly 34 of the stack output assembly 16 is shown in FIGS. 13, 14 and 17. The compressor assembly 34 incorporates a pair of compressor rods 1010 that is in turn fixedly held by its output ends in a pair of compressor pivots 1012. A short length of the input ends of the pair of compressor rods 1010 is turned upwardly to facilitate the reception of the stack of cartons 676 being introduced into the stack output assembly 16 by the stacking assembly 14 as will be discussed hereinafter. Each member of the pair of compressor pivots 1012 incorporates a pivot shaft 1014, a rod block 1016, and a rod block extension 1018. The rod block 1016 is fixedly attached upon the inboard end of the pivot shaft 1014 and rises upwardly a short distance. The rod block extension 1018 is rigidly affixed at its inboard extremity to the upper outboard side of the rod block 1016 to complete the rigid entity of each element of the pair of compressor pivots 1012. A set of three clear holes 1020 (FIG. 17) is incorporated in lateral and horizontal alignment across the top and extended portions of each of the pair of compressor pivots 1012. Associated with each hole of the set of three clear holes 1020 is a vertically disposed set screw, not shown in detail, that enters the top of each member of the pair of compressor pivots 1012 to fixedly hold or clamp one of the rods of the pair of compressor rods 1010 within a selected hole of the set of three clear holes 1020. This provides a degree of lateral adjustment to the pair of compressor rods 1010, necessary to accommodate cartons of various widths. Each pivot shaft 1014, of the pair of compressor pivots 1012, is pivotally mounted through a pivot block 1022. The pivot block 1022 is fixedly attached at its output end to the input face of a mount flange 1024. The mount flange 1024 is rigidly and centeredly affixed to the upper input edge of a compressor adjustment mount 1026. A pair of bolts 1030 passes through a long vertical slot 1028 that is incorporated into the compressor adjustment mount 1026, and threadably mounts into a pair of tapped lower holes 1034, as is shown in FIGS. 13 and 17, or a pair of tapped upper holes 1036, of a compressor base plate 1032, whichever is necessary. A large degree of vertical adjustment is thus provided to the mount flange 1024 and therefore the compressor assembly 34. Each of the compressor base plates 1032 is rigidly affixed to the outboard surface of one of the turn frame uprights 690. The bottom outboard face of the compressor adjustment mount 1026 rigidly incorporates a standoff block 1040 that in turn rigidly incorporates upon its outboard face one of a pair of cantilever cylinder mounts 1042. Each cantilever cylinder mount 1042 extends in the output direction from its standoff block 1040, and pivotally incorporates upon its unsupported end are a pair of short stroke cylinders 1044. Cylinder rods 1046 of the short stroke cylinders 1044 rise vertically. Each of the cylinder rods 1046 threadably incorporates upon its working end, a cylinder clevis 1048. Each cylinder clevis 1048 is pivotally attached to the output end of one of a pair of power arms 1050, the input end of which is clampedly attached to the outboard end of one of the pivot shafts 1014. With reference to FIG. 13, as the short stroke cylinders 1044 extend their cylinder rods 1046, as shown, each compressor rod of the pair of compressor rods 1010 pivots clockwise or downwardly upon the top of a stack of cartons. As the cylinder rods 1046 are retracted, the compressor rods 1010 rotate counterclockwise upward, thus releasing the stack of cartons and thereby preparing to accept another stack.

OPERATION OF STACK OUTPUT ASSEMBLY 16

Referring now to FIG. 3, as the number 1 pusher assembly 26 of the stacking assembly 14 slides the stack of cartons 357 off the elevator floor asssembly 131 and onto the rug 772 of the table assembly 686 of the stack output assembly 16 to the position 357A, the stack of cartons 357 enters between the two side guide plates 850 of the side guide assembly 30. As has been previously described, the number 1 pusher assembly 26 extends far enough in the output direction under the control of limit switch LS-5 (FIG. 1), to place the stack of cartons 357A in the center of the table assembly 686. The front fence and ram assembly 864 of the adjustable number 2 pusher assembly 32 is preset, according to the carton being processed, to be within very close proximity of the output face of the stack of cartons 357A as it comes to position upon the table assembly 686. The front fence and ram assembly 864 at this time functions to prevent the stack of cartons from continuing, or spilling, in the output direction. With the limit switch LS-5 being made under conditions of full stroke of the pusher assembly 26, the limit switch LS-5 also energizes the short stroke cylinders 1044 of the compressor assembly 34, thereby lowering the pair of compressor rods 1010 downwardly and firmly to a horizontal position across the top of the stack of cartons 357A, as is indicated in FIG. 13. This holds the stack of cartons 357A in upright position as the number 1 pusher assembly 26 retreats from its full forward position. The limit switch LS-20 is actuated as soon as the pusher face assembly 494 is clear of the turn table assembly 28 and causes the pivot cylinder 734 to retract the piston rod 744 as shown in FIG. 16 to swing the turn table assembly 28 clockwise with respect to FIG. 3, rotating it 90 degrees into the double-dot-dash line position as shown. Upon its arrival at the lateral position (FIG. 15), the actuator riser mount bar 700 of the turn frame assembly 682 actuates the limit switch LS-18. The limit switch LS-18 energizes the proper circuit to cause the hydraulic cylinder 964 (FIG. 13) of the adjustable number 2 pusher assembly 32 to extend, thereby pushing the stack of cartons 357 off the table assembly 686 and into the case packing assembly 18 (FIG. 2). At full stroke, the adjustable pusher assembly 32 actuates the limit switch LS-15 (FIG. 13), activating the proper circuitry that stops the hydraulic cylinder 964, returns the hydraulic cylinder 964 after a time delay, commands the case packing assembly 18 to begin its cycle, and releases the short stroke cylinders 1044 of the compressor assembly 34. Restated, the turn table assembly 28 begins its return to the longitudinal position as soon as the adjustable pusher assembly 32 reaches its full forward stroke. On reaching full stroke, the compressor releases, the case packing assembly cycle is begun, but the adjustable number 2 pusher assembly 32 does not begin its return until after a short time delay that is necessary to prevent the stack of cartons 357 from bouncing back out of the case packing assembly 18. As the time delay expires, the adjustable number 2 pusher assembly 32 returns. As the adjustable pusher assembly 32 reaches its full back position, that is, the hydraulic cylinder 964 has retracted, the limit switch LS-13 is made, thus indicating the same, and subsequently preparing the circuit for another cycle. As the turn table assembly 28 reaches its longitudinal position, the limit switch LS-17 is made (FIG. 13) thus indicating that the stack output assembly 16 is in position to start a new cycle.

Referring again to FIG. 3, one of the cartons 40 is indicated on top of the stack of cartons 357, such stack being made up of a plurality of cartons 40. The carton 40 is cut from a single sheet of cardboard, then printed, glued, folded and sealed into the flat specimen that is shown here. The carton 40 includes a set of four side panels 1054, a set of top flaps 1056, and a set of bottom flaps 1058. The carton 40 is of usual construction and is formed by folding the two side panels that are shown on top, in from the other side panels (not shown) and sealing them together with a glue tab 1060. Thus glue joint is known as the seam of the carton 40. The seam of the carton 40 or glue tab 1060, is parallel with the direction of travel of the stack of cartons 357 at this point. As has previously been described, the stack of cartons 357 is transferred to the turn table assembly 28, turned 90° clockwise, then displaced laterally to the left into the case packing assembly 18. In this operation, the glue tab 1060, or the seam of the carton 40 remains parallel to the direction of linear travel, entering the case packing assembly 18 endways. This is known as end seam packing.

Figure 18:
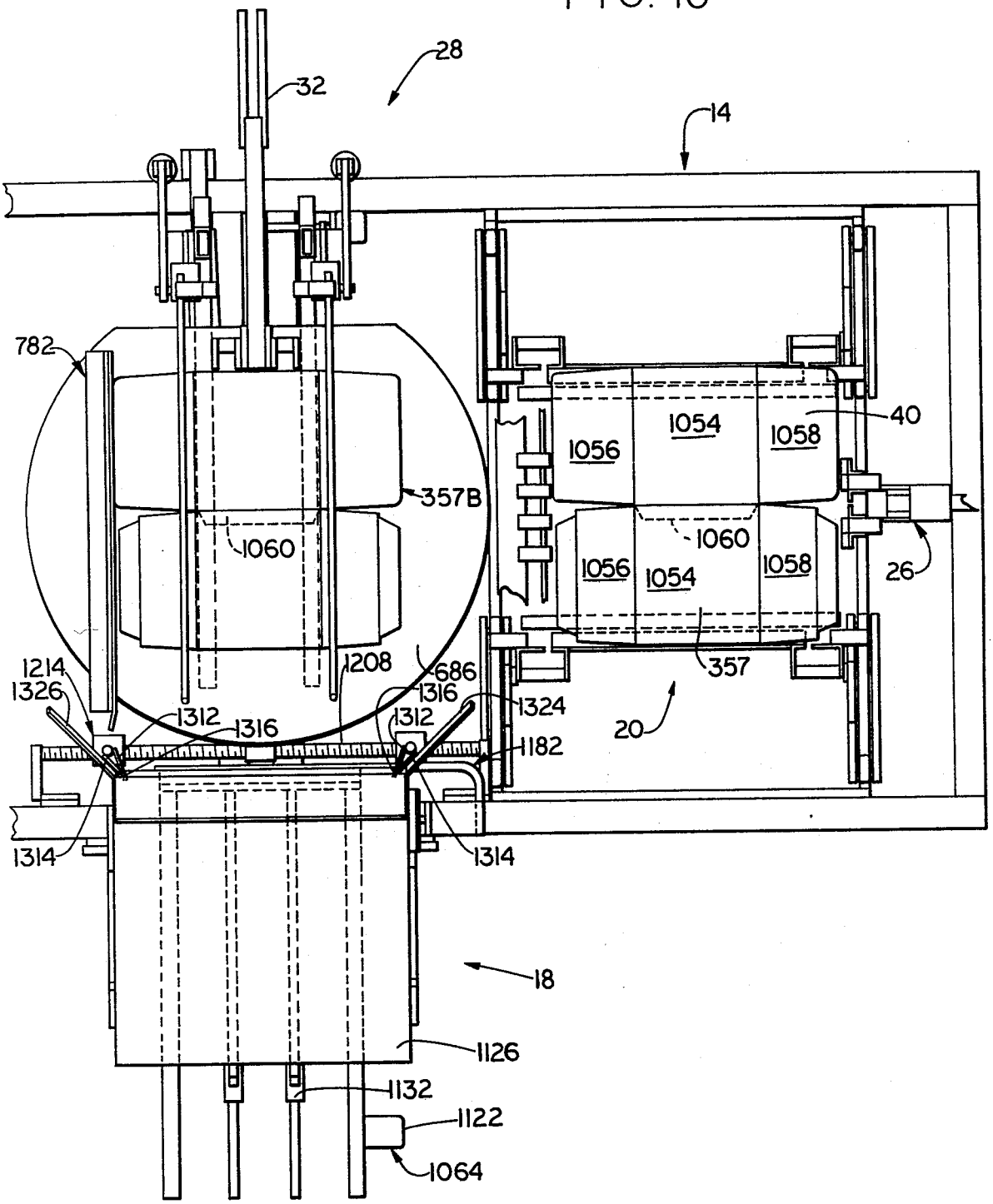
FIG. 18 is a fragmentary plan view showing the turntable in its second position with the machine arranged for sideseam delivery of a stack of articles to a case.

Referring now to FIG. 18, an alternate mode of operation of the machine for side seam packing is shown. The stack of cartons 357 leaves the elevator assembly 20 as before and enters the turn table assembly 28 when it is already in the lateral position. In this mode the turn table assembly 28 does not move cyclically, but is stationary. The adjustable number 2 pusher assembly 32 of the turn table assembly 28 subsequently translates the stack of cartons 357 sideways into the case packing assembly 18. In this operation, the glue tab 1060, or the seam of the carton 40 does not remain parallel to the line of linear travel, but is perpendicular to it as the stack 357B is discharged from the table assembly 686. The seam of the carton 1052 is moved sideways into the case packing assembly 18. This is known as side seam packing. The dual purpose packing machine 10 gives the operator the option of packing end seam or side seam without major changeover procedures, nor the necessity of possessing duplicate machinery.

Side seam packing requires a minor changeover in the machine. As is indicated in FIG. 18, the stack of cartons 357B is again brought to the center of the table assembly 686 by the pusher assembly 26. The left hand member of the guide plate assembly 782 is adjusted laterally upon the table assembly 686 so that it is in close proximity with the output side of the stack of cartons 357B to act as a backstop to prevent the stack of cartons 357B from over travel or spilling as it comes to rest upon the table assembly 686. The right hand member of the guide plate assembly 782 is removed. The start position of the adjustable number 2 pusher assembly 32 is brought forward so that the front fence and ram assembly 864 initially performs as a side guide, then as a side pusher for the stack of cartons 357B.

Referring now to FIG. 2, in side seam operation, the stack of cartons 357, as delivered from the elevator assembly 20, is shown in double-dot-dash lines. The up position of the compressor assembly 34 is also shown in double-dot-dash lines. For the stack of cartons 357 to enter the turn table assembly 28, the vertical height of the compressor assembly 34 must be adjusted so that the compressor rods 1010 clear the top of the stack of cartons 357, then compresses the stack sufficiently to assure that the stack will enter the case packing assembly 18. In the compressed position, the compressor rods 1010 are tilted downwardly away from the compressor pivots 1012, to obtain sufficient compression of the stack as it enters the case packing assembly 18. In end seam packing, the compressor rods 1010 are horizontally disposed across the stack of cartons 357 in the compressed state. A side seam mode selector switch SW4 (FIG. 23) is provided for changing the sequential operation of the electrical-hydraulic control system (described hereinafter) to account for the stationary positioning of the turn table assembly 28.

CASE PACKING ASSEMBLY

The case packing assembly 18 is shown in FIGS. 14, 15, 16 and 19-22, inclusive. It is comprised of the flap holding assembly 36 (FIG. 22) and the corrugated case output assembly 38 (FIG. 15).

The corrugated case output assembly 38 is further comprised of a base frame 1062 and a tipover table 1064. The base frame 1062 (FIGS. 15, 16 and 19) incorporates a top mounting plate 1066 and a bottom mounting plate 1068. A pair of top frame tubes 1070 is rigidly affixed to the top mounting plate 1066 and extend to the left therefrom. Similarly, a pair of bottom frame tubes 1072 is rigidly affixed to the bottom mounting plate 1068. The top mounting plate 1066 and the bottom mounting plate 1068 are held in rigid and vertical spaced relationship by a pair of inboard riser plates 1074. The inboard riser plates 1074 are rigidly affixed at their bottom extremities to the top inboard edges of the bottom frame tubes 1072, and rise vertically to be rigidly affixed to the bottom inboard edges of the top frames tubes 1070. The left hand extremities of the top frame tubes 1070 are held in vertical spaced relationship above the left hand extremities of the bottom frame tubes 1072 by a pair of outboard riser plates 1076. The outboard riser plates 1076 are rigidly affixed to the outboard ends of the bottom frame tubes 1072 and extend vertically upward somewhat above the top frame tubes 1070 to whose outboard extremities the outboard riser plates 1076 are also rigidly affixed.

Figure 19:
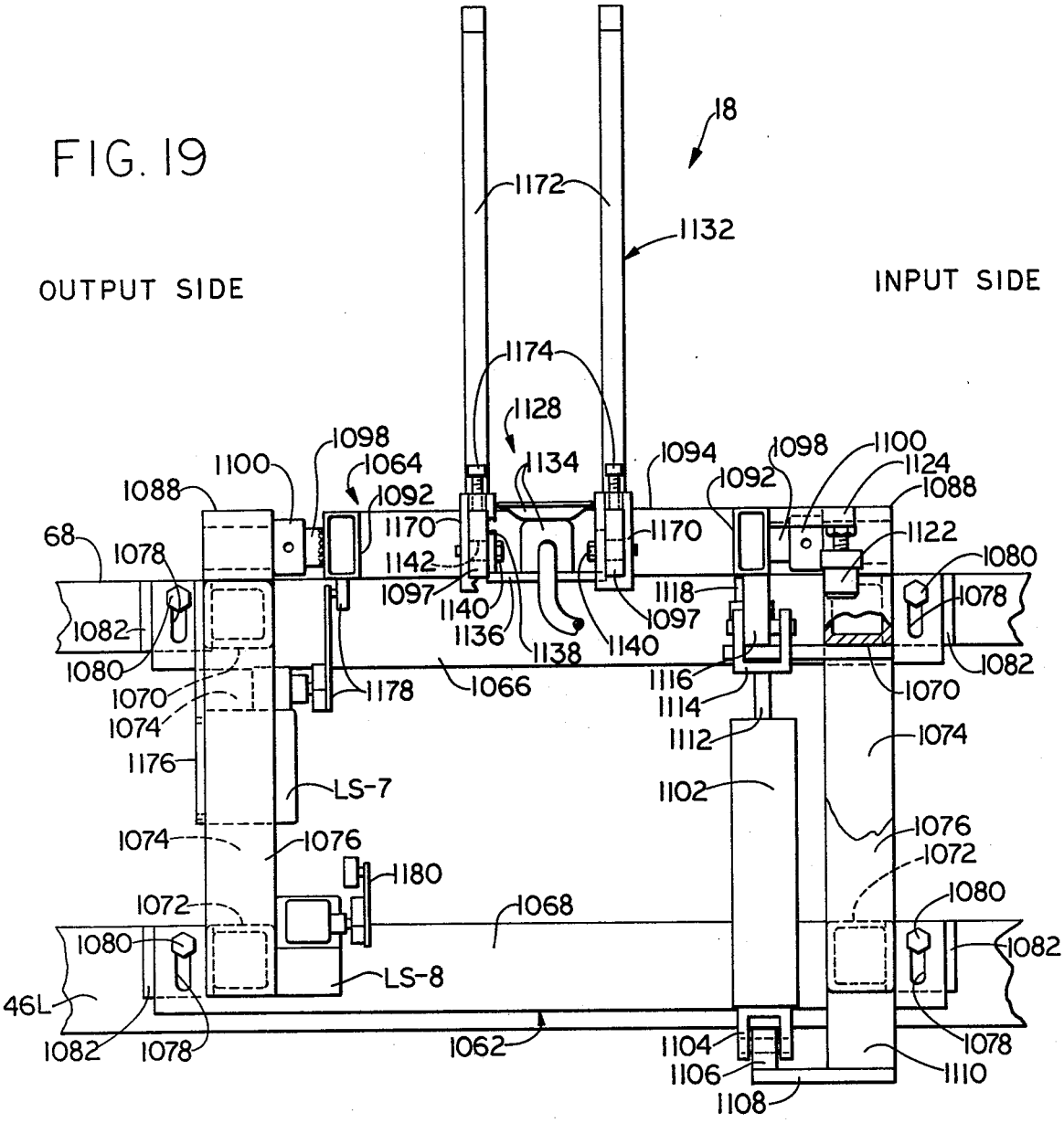
FIG. 19 is a fragmentary view in side elevation on an enlarged scale showing details of the tip-over table section of the machine.

From FIG. 19, it can be seen that the longitudinally extending extremities of the top and bottom mounting plates 1066 and 1068, respectively, incorporate a set of four vertical slots 1078, one slot in each extremity. A set of four bolts 1080 passes cleanly through the set of four vertical slots 1078 and threadably mount into a set of four mounting pads 1082. The top members of the set of four mounting pads 1082 are rigidly affixed to the outboard surface of the short longitudinal beam 68. The bottom members of the set of four mounting pads 1082 are rigidly affixed to the outboard surface of the left hand bottom stringer 46L. The longitudinal placement of the set of four mounting pads 1082 with respect to the dual purpose packing machine 10 is shown most clearly in FIG. 1, and is such to bring the lateral centerline of the base frame 1062 into alignment with the pivot center of the turntable assembly 28. This slotted cantilever style attachment method provides the base frame 1062 with a degree of vertical adjustment that is facilitated by a pair of adjusting pads 1084. The left end portion of the bottom surface of each of the pair of adjusting pads 1084 is rigidly affixed to the top surface of, and at the right end of, one of the pair of top frame tubes 1070. The adjusting pads 1084 extend laterally across the top edge of the top mounting plate 1066 to which the adjusting pads 1084 are also rigidly affixed. The right hand portions of the adjusting pads 1084 extend across the top surface of the short longitudinal beam 68. An adjusting bolt 1086 is threadably mounted in a vertical disposition through the inwardly extending portion of each of the adjusting pads 1084, and bears downwardly against the short longitudinal beam 68. Consequently, as the pair of adjusting bolts 1086 is turned down, the base frame 1062 is raised to its desired position, then secured in place by tightening the set of four bolts 1080.

A pair of pivot mounts 1088 is fixedly attached to the upper outboard face of the pair of outboard riser plates 1076. Bolts 1090 pass through clear holes in the upper end of each of the outboard riser plates 1076 and threadably mount into each member of the pair of pivot mounts 1088. The tipover table 1064 is pivotally mounted in the pair of pivots mounts 1088. The tipover table 1064 incorporates a pair of side frames 1092 (FIG. 16), an inboard brace 1094, an inboard angle 1096, a pair of slide mounts 1097, and a pair of pivot pins 1098. The pair of side frames 1092 is laterally disposed with respect to the dual purpose packing machine 10, and is rigidly held in parallel and longitudinal spaced relationship by the inboard brace 1094 that is rigidly affixed accoss the inboard extremities thereof. The slide mounts 1097 are evenly spaced between the pair of side frames 1092 and are fixedly attached to the outboard surface of the inboard brace 1094. The inboard angle 1096 is fixedly attached by means of its vertical flange along the upper inboard edge of the inboard brace 1094 (FIG. 15), so that the horizontal flange thereof is coplanar with the top surface of the tipover table 1064. The inboard angle 1096 is a replaceable piece, intended to help adjust the inboard extremity of the tipover table 1064. A pair of holes, longitudinally aligned, is incorporated through the sides of the pair of side frames 1092 about midway along its length. The pair of pivot pins 1098 is rigidly affixed within the holes of the pair of side frames 1092, in such manner that the end of each pin facing the centerline of the tipover table 1064 is affixed flush with the inside surfaces of the pair of side frames 1092, and the pair of pivot pins 1098 is cantilever mounted upon the tipover table 1064, and each pin 1098 extends outwardly therefrom. The pivot pins 1098 are pivotally mounted in the pivot mounts 1088, and the tipover table 1064 is maintained in longitudinal place therebetween by a pair of set collars 1100 (FIGS. 16 and 19). The pair of set collars 1100 is fixedly attached upon the pair of pivot pins 1098.

The tipover table 1064 is turned by a tipover cylinder 1102 that is shown in FIGS. 2, 15, 16, and 19. The base of the tipover cylinder 1102 integrally incorporates a mounting yoke 1104 that is in turn pivotally attached to a cylinder mount lug 1106. The cylinder mount lug 1106 is rigidly affixed upon the top of an offset plate 1108, and is located upon the left hand output corner thereof as is indicated in FIG. 16. The upper input surface of the offset plate 1108 is rigidly affixed to the bottom extremity of a cylinder mount hanger 1110, that is in turn rigidly affixed to the bottom of the input member of the pair of bottom frame tubes 1072 and the bottom extremity of the input member of the pair of outboard riser plates 1076. A cylinder rod 1112 (FIG. 19) of the tipover cylinder 1102 threadably incorporates upon its upper extremity a rod yoke 1114, that is in turn pivotally mounted to a table lug 1116. The table lug 1116 is rigidly affixed to the bottom surface of the input member of the pair of side frames 1092 of the tipover table 1064, and is laterally disposed thereupon just inboardly of the input member of the pair of pivot pins 1098. As the tipover cylinder 1102 retracts the cylinder rod 1112, the tipover table 1064 is pivoted counterclockwise (with respect to FIG. 2) to the horizontal position, and is stopped in fixed place by a down stop 1118. The down stop 1118 is threadably mounted through the output end of a down stop mount 1120 and is adjustably fixed therein. The input end of the down stop mount 1120 is rigidly affixed to the bottom surface of the input member of the pair of top frame tubes 1070, a short distance outboardly of the input member of the pair of inboard riser plates 1074. This brings the down stop 1118 into working resistance against the bottom surface of one of the side frames 1092 of the tilt table 1064, at a convenient point near the inboard end thereof, as shown in FIG. 19. As the tipover cylinder 1102 extends the cylinder rod 1112, the tilt table 1064 rotates counterclockwise (FIG. 2) until it reaches a vertical orientation as is shown in double-dot-dash lines. It is stopped in the vertical position by an up stop 1122 that is shown in FIGS. 15, 16 and 19. The up stop 1122 is threadably mounted through the input end of an up stop mount 1124, that is in turn rigidly affixed to the upper input side of the input member of the pair of side frames 1092 and is laterally positioned near the outboard end thereof. In this manner, and referring to FIGS. 15 and 19, the up stop 1122 swings clockwise downwardly and comes into working resistance with the outboard face of the input member of the pair of outboard riser plates 1076. The tilt table 1064 is held in place by the tipover cylinder 1102.

A corrugated case 1126 (FIG. 2) is placed upon the tilt table 1064 and maintained thereupon, by a suction assembly 1128 (FIGS. 16 and 19), a case side guide assembly 1130 (FIGS. 16, 20 and 21), and a bottom support assembly 1132 (FIGS. 15, 16 and 19). The suction assembly 1128 is comprised of a suction cup 1134 that is fixedly attached to the top surface of a suction cup mount 1136. A pair of cup hangers 1138 is rigidly affixed in upright disposition to the longitudinal extremities of the top of the suction cup mount 1136. A pair of bolt and nut assemblies 1140 pass outwardly through clear holes in each member of the pair of cup hangers 1138, and then through a pair of slots 1142 in each member of the pair of slide mounts 1097 of the tipover table 1064. The slots 1142 extend vertically when the slide mounts 1097 are in the position shown in FIGS. 16 and 19. In this manner, the suction cup 1134 is provided with a degree of adjustment with respect to the slide mounts 1097.

Figure 20:
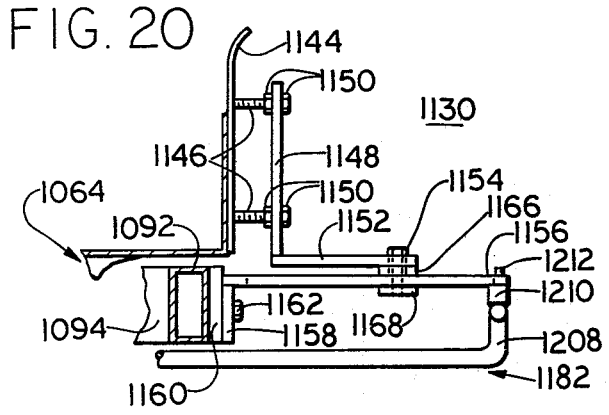
FIG. 20 is a fragmentary view in section taken on the line 20—20 in FIG. 16, a portion of a case being shown.

The case side guide assembly 1130 is shown in FIGS. 16 and 20, and incorporates an upright side plate 1144, having a top edge which is rolled outwardly in the input direction to facilitate entry of a corrugated case 1126. The side plate 1144 incorporates a pair of vertically aligned threaded holes into which threaded rods 1146 are mounted. Input ends of the threaded rods 1146 pass through clear holes in a plate mount 1148 and are adjustably held therein by a set of four nuts 1150. The plate mount 1148 is mounted on a horizontal extension mount 1152. The horizontal extension mount 1152 incorporates a pair of clear holes through which adjustment bolts 1154 downwardly pass.

Continuing with FIGS. 20, the output end of a longitudinal slide mount 1156 is rigidly affixed upon the top edge of a slide mount plate 1158, that is in turn fixedly attached to a standoff plate 1160. A pair of bolts 1162 pass through clear holes in the slide mount plate 1158 and threadably mount in the standoff plate 1160. The standoff plate 1160 in turn is rigidly affixed to the right hand input surface of the input member of the pair of side frames 1092 of the tipover table 1064, as shown in FIG. 20.

Figure 21:
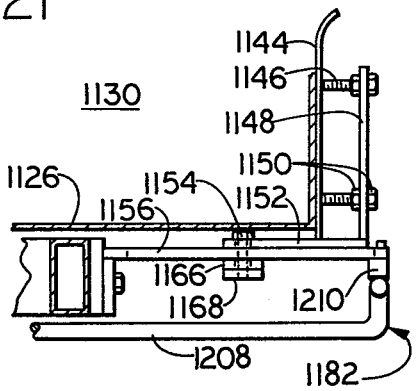
FIG. 21 is a fragmentary view in section taken on the same line as FIG. 20, but with a side plate assembly in an alternate position.

The longitudinal slide mount 1156 incorporates a pair of slots 1164 (FIG. 16), that essentially extend the full length thereof, for slide mounting of the pair of adjustment bolts 1154. The adjustment bolts 1154 pass downwardly through the horizontal extension mount 1152, as indicated before, then continue downwardly through a rectangular spacer 1166 and the pair of slots 1164, to threadably mount into a clamp block 1186. Thus, the side plate 1144 can be moved close to the lateral centerline of the tipover table 1064 to perform as side guide for small corrugated cases. More specifically, the side guide plate 1144 is cantilever mounted over the tipover table 1064 by the horizontal extension mount 1152 in cooperation with the longitudinal slide mount 1156. As the size of the corrugated case increases, the horizontal extension mount is slid away from the lateral centerline of the tipover table 1064 until the pair of adjustment bolts 1154 reaches the input extremity of the pair of slots 1164 of the longitudinal slide mount 1156. At this point a change in configuration is necessary. As is indicated in FIG. 21, the pair of adjustment bolts 1154 can be removed and the rectangular spacer 1166 can be transferred from the top to the bottom of the longitudinal slide mount 1156. The horizontal extension mount 1152 is turned around, and the side plate 1144 is dismounted from the plate mount 1148, then remounted on the other side thereof. With these changes, the case side guide assembly 1130 is prepared to handle corrugated cases of larger size. Note that a corrugated case 1126 that is in place upon the top of the tipover table 1064, and held slightly thereabove by the suction assembly 1128, will clear all parts of the case side guide assembly 1130, including the pair of adjustment bolts 1154 as indicated in the drawing.

The bottom support assembly 1132 is shown in FIGS. 15, 16 and 19, and is comprised of a pair of rectangular slide collars 1170, a pair of bottom support bars 1172 and a pair of set screws 1174. The bottom support bars 1172 are perpendicularly disposed to the slide mounts 1097. Each bottom support bar 1172 is attached to one of the rectangular slide collars 1170. Each rectangular slide collar 1170 is slidably placed upon one of the slide mounts 1097 of the tipover table 1064. The slide collars 1170 are locked in adjusted position on the slide mounts 1097 by the set screws 1174.

A limit switch LS-7 is shown in FIGS. 15, 16 and 19 and is fixedly attached to the lower input surface of a switch mount plate 1176, that is in turn rigidly affixed at its upper end to the output side of the output member of the pair of top frame tubes 1070 of the base frame 1062. A switch arm and roller 1178 pivotally extends from the input side of the upwardly oriented head of the limit switch LS-7. The switch arm extends upwardly to bring its roller into working contact with the bottom surface of the output member of the pair of side frames 1092 of the tipover table 1064.

A limit switch LS-8 is fixedly attached in a horizontal attitude to the input side of, and near the outboard end of, the output member of the pair of bottom frame tubes 1072 of the base frame 1062. The head of the limit switch LS-8 extends outboardly therefrom, and pivotally incorporates from its input side a switch arm and roller 1179. The switch arm and roller 1180 extends outboardly and upwardly to come in working relationship with the bottom outboard surface of the output member of the pair of side frames 1092 of the tipover table 1064, when the tipover table 1064 reaches its vertical position.

Figure 22:
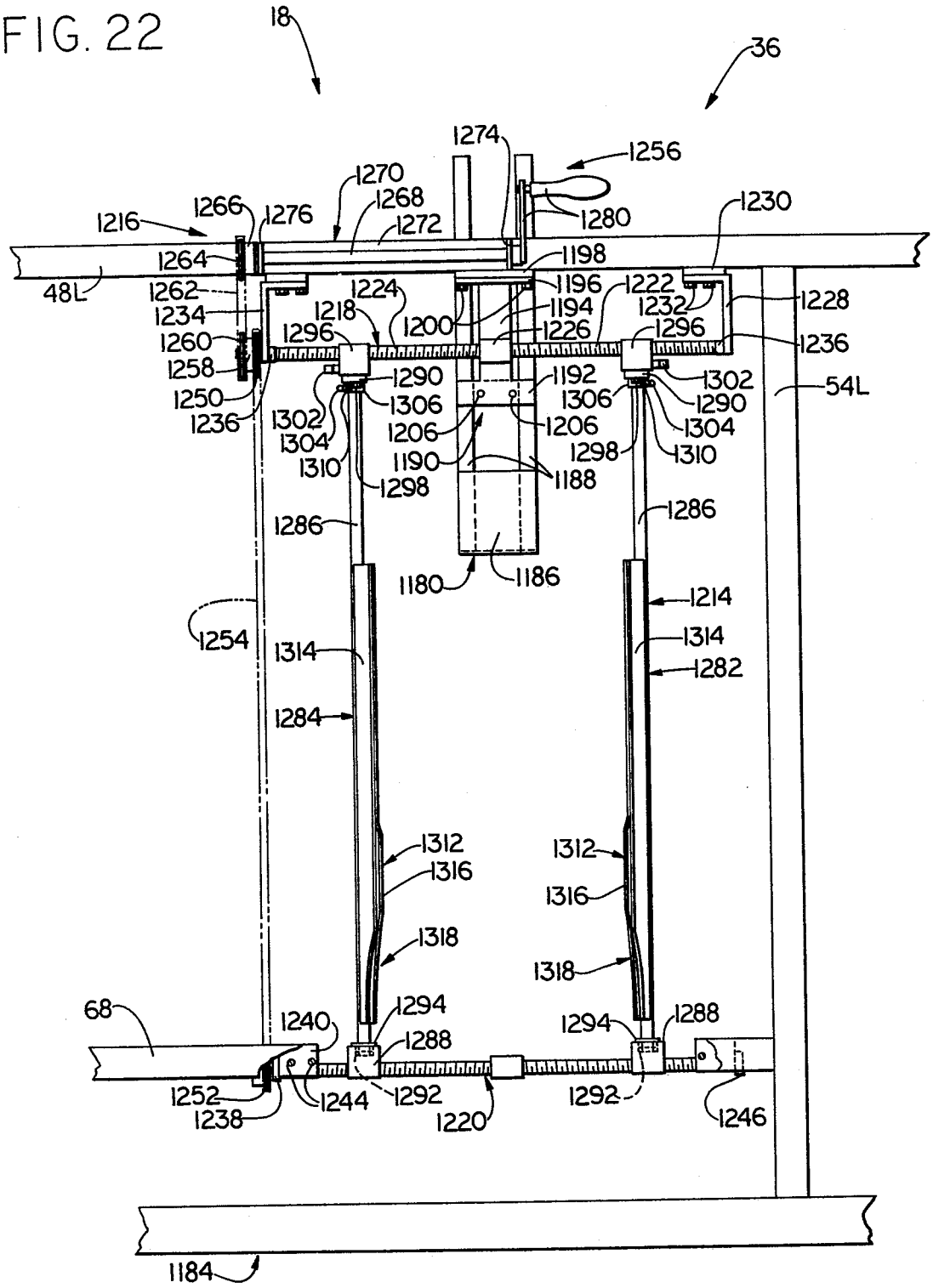
FIG. 22 is a fragmentary view partly in side elevation and partly broken away of a case guide section of the machine.

When the corrugated case 1126 is in a horizontal position upon the tipover table 1064, as is indicated in solid line in FIG. 2, the flaps of the corrugated case 1125 are controlled by a top flap guide assembly 1180 (FIGS. 2, 14 and 22), a bottom flap holding assembly 1182 (FIGS. 2, 16, 20 and 21) and a side flap guide assembly 1184 (FIGS. 14, 15 and 22).

The top flap guide assembly 1180 incorporates a flap pusher plate 1186, whose bottom portion is rigidly affixed to the bottom extremity of a pair of hanger slides 1188. The pusher plate 1186 extends outwardly and upwardly in a curved manner to be rigidly affixed by its top extremity to the outboard surfaces of the hanger slides 1188. The pair of hanger slides 1188 extend upwardly in spaced parallel relationship, rigidly held by virtue of the flap pusher plate 1186, to be fixedly but adjustably held in a hanger mount 1190. The hanger mount 1190 is comprised of a bottom clamp base 1192, a vertical mount 1194, a hanger mount 1196, and a clamp bar 1197. The top edge of the bottom clamp base 1192 is rigidly affixed to the bottom extremity of the vertical mount 1194 in a centered position, such that the two parts form an inverted "T" shaped assembly. The top outboard edge of the vertical mount 1194 is rigidly affixed across the inboard edge of the hanger mount 1196, also in a centered position. A pair of bolts 1200 passes through a pair of clear holes in the longitudinally extending portions of the hanger mount 1196, and threadably mount into a hanger mount pad 1198 that is in turn rigidly affixed to the bottom surface of the left hand top stringer 48L. The hanger mount pad 1198 extends inboardly a small distance from the left hand top stringer 48L. The pair of hanger slides 1188 is clampedly and adjustably held to the right hand surface of the bottom clamp base 1192 by the clamp bar 1197 that incorporates a clamp 1202 and a spanner bar 1204 as is seen in FIG. 14. The spanner bar 1204 is rigidly affixed in a centered position upon the left hand face of the clamp 1202. A pair of bolts 1206 passes through a pair of clear holes that extend through the clamp 1202 and the spanner bar 1204 and threadably mount into the bottom clamp base 1192. The thickness of the spanner bar 1204 is less than that of the pair of hanger slides 1188 as shown. The top flap guide assembly 1180 shown in FIG. 2 is in an adjusted position with respect to the corrugated case 1126, whereas that shown in FIG. 22 is not.

The bottom flap holding assembly 1182 is shown in FIGS. 2, 16, 20 and 21, and is comprised of a compoundly bent rod 1208 and a small mount pad 1210. The small mount pad 1210 is fixedly attached laterally across the bottom input edge of the longitudinal slide mount 1156 of the case side guide assembly 1130. A pair of machine screws 1212 pass downwardly through a pair of clear holes in the input end of the longitudinal slide mount 1156 and threadably mount into the small mount pad 1210. The outboard end of the compoundly bent rod 1208 is rigidly affixed along the bottom of the small mount pad 1210. As the rod extends inboardly, it angles downwardly for a short distance (FIG. 2), then bends in a radius toward the output end of the frame assembly 44. The compoundly bent rod 1208 then extends longitudinally across the tipover table 1064 as is shown in FIG. 16.

The side flap guide assembly 1184 is shown in FIGS. 14, 15 and 22, and is comprised of a flap assembly 1214 and an adjustment assembly 1216. The adjustment assembly 1216 incorporates a top adjustment screw 1218 and a bottom adjustment screw 1220 that are identical in construction, therefore only one will be described. The input half of the top adjustment screw 1218 is comprised of a right hand threaded rod 1222 whose extremities integrally incorporate a short length of smaller diameter smooth shaft. The output half of the top adjustment screw 1218 is comprised of a left hand threaded rod 1224 whose input end integrally incorporates a short length of smaller diameter smooth shaft and whose output end similarly incorporates a smooth shaft of somewhat longer length. The right and left hand threaded rods 1222 and 1224, respectively, are joined together by a shaft coupler 1226 to form the top adjustment screw 1218.

The input end of the top adjustment screw 1218 is rotatably mounted in a top input bracket 1228. The top input bracket 1228 is inverted "L" shaped hanger whose vertical flange accommodates the top adjustment screw 1218 at its lower end, and whose upper horizontal flange is fixedly attached to a top input mount pad 1230. A pair of bolts 1232, longitudinally aligned, pass through clear holes in the horizontal flange of the top input bracket 1228 and threadably mount into the top input mount pad 1230, that is in turn rigidly affixed to the bottom surface of the left hand top stringer 48L. The output end of the top adjustment screw 1218 is rotatably mounted through a top output bracket 1234. The top output bracket 1234 is identical to the top input bracket 1228, except that it is mounted to the left hand top stringer 48L in mirror image relationship. The top adjustment screw 1218 is held in longitudinal position between the vertical flanges of the top input and output brackets 1228 and 1234, respectively, by a pair of set collars 1236. The pair of set collars is fixedly attached to the smooth shaft end extensions of the top adjustment screw 1218 and adjacent the threaded portion thereof.

The output end of the bottom adjustment screw 1220 is rotatably mounted through the inboard end of a lateral output mount 1238. The lateral output mount 1238 is rigidly affixed along its left hand input edge to the lower output edge of a bottom output mount 1240. The bottom output mount 1240 is fixedly attached to a bottom output mount pad 1242, that is in turn rigidly affixed to the right hand face of the short lateral beam 68. A pair of bolts 1244 (FIG. 14) passes through clear holes in the bottom output mount 1240 and threadably mount in the bottom output mount pad 1242. The input end of the bottom adjustment screw 1220 is rotatably mounted in the inboard end of a lateral input mount 1246 that is in turn rigidly and fixedly attached to the right hand surface of the short lateral beam 68 in a manner similar to that described for the lateral output mount 1238. Like the top adjustment screw 1218, the bottom adjustment screw 1220 is centeredly held between the lateral output and input mounts 1238 and 1246, respectively, by a pair of bottom set collars 1248.

The top and bottom adjustment screws 1218 and 1220, respectively, are rotated in unison with each other by an upper sprocket 1250, a lower sprocket 1252, a transfer chain 1254, and a crank assembly 1256. The upper sprocket 1250 is fixedly attached to the input side of a sprocket hub 1258 that is in turn fixedly attached to the output extremity of the top adjustment screw 1218. The lower sprocket 1252 is attached in the same manner to the output extremity of the bottom adjustment screw 1220. The transfer chain 1254 circumscribes the upper and lower sprockets 1250 and 1252, respectively, so that whatever rotation is imparted to the top adjustment screw 1218, the bottom adjustment screw 1220 will also receive.

Rotation is imparted to the top adjustment screw 1218 by the crank assembly 1256 and a crank sprocket 1260. The crank sprocket 1260 is fixedly attached to the output face of the sprocket hub 1258. The crank assembly 1256 incorporates a crank chain 1262, a transfer sprocket 1264, a transfer hub 1266, and a crank shaft 1268. The transfer sprocket 1264 is fixedly attached to the output face of the transfer hub 1266, that is in turn fixedly attached to the output end of the crank shaft 1268. The crank chain 1262 circumscribes the transfer sprocket 1264 and the crank sprocket 1260. The crank shaft 1268 integrally incorporates at both ends a short length of smaller diameter smooth shaft, for rotatably mounting the shaft through the tines of a large yoke mount 1270.

The large yoke mount 1270 is comprised of a yoke base 1272, an input mount 1274 and an output mount 1276. The input mount 1274 is laterally disposed, with its right hand extremity rigidly affixed to the left hand surface of, and at the input end of, the yoke base 1272. The output mount 1276 is of the same dimensions as the input mount 1274 and is rigidly affixed by its right hand extremity to the left hand surface of, but at the output end of, the yoke base 1272. Both the input and output mounts 1274 and 1276, respectively, incorporate at the left end thereof a bushinged hole in which the crank shaft 1269 is rotatably and longitudinally retained. The yoke base 1272, and therefore the large yoke mount 1270, is fixedly attached to the left hand surface of the left hand top stringer 48L. A set of three bolts 1278 (FIG. 14) passes through clear holes in the yoke base 1272 and threadably mount into the left hand top stringer 48L.

A crank handle 1280 is fixedly attached to the input extremity of the crank shaft 1268 for manual rotation thereof. As the crank handle 1280 is turned, the top and bottom adjustment screws 1218 and 1220 turn in unison to cause the opposing members of the flap assembly 1214 to move together or apart as can be seen in FIG. 22.

The flap assembly 1214 (FIGS. 14, 15, and 22) is comprised of an input flap system 1282 and an output flap system 1284, that are identical in construction, save for right and left handedness, therefore only one will be described. The guide members will apply equally to both, for both sides of the system will be utilized to describe the mechanism as will be clear in viewing the cut away qualities of FIG. 14. The output flap system 1284 incorporates a flap post 1286 that is pivotally mounted at its lower end in a socket block 1288, and at its upper end through the inboard end of an offset mount 1290. The socket block 1288 is threadably mounted upon the bottom adjustment screw 1220 and incorporates a clean hole 1292 (FIG. 22) bored vertically downward in the top thereof, but whose depth does not interfere with the threaded hole through which the bottom adjustment screw 1220 passes. A flange bushing 1294 is frictionally inserted in the clean hole 1292 and pivotally retains the bottom end of the flap post 1286. The bottom extremity of the flap post 1286 bears against the bottom of the clean hole 1292. The offset mount 1290, being laterally disposed, is fixedly attached to the bottom of an upper adjustment block 1296, that is in turn threadably mounted on the top adjustment screw 1218. A pair of bolts 1298 passes vertically upward through clear holes in the outboard end of offset mount 1290 and threadably mounts into the upper adjustment block 1296.

The top extremity of the flap post 1286 fixedly incorporates a set collar 1300 (FIGS. 14 and 15) to which is rigidly affixed a limit bar 1302. The limit bar 1302 is thereby perpendicularly orientated with respect to the flap post 1286 and performs as a pivotal stop when its free extremity comes into contact with the outer inboard corner of the upper adjustment block 1296 as is most clearly shown in FIG. 14. The limit bar 1302 is held in steady state contact with the upper adjustment block 1296 by a spring 1304 and a torque collar 1306. The torque collar 1306 is fixedly attached to the flap post 1286 and threadably includes a spring pin 1308 in the side thereof. The spring 1304, a tension spring, is hooked from the spring pin 1308 to an anchor pin 1310 that is in turn threadably mounted in an inverted orientation into the bottom surface of, and near the outboard end of, the offset mount 1290. The spring pin 1308 and the anchor pin 1310 incorporate heads for the retention of the spring 1304.

As can be seen more clearly in FIG. 14, but also in FIGS. 15 and 22, an inner flap 1312 of extended vertical length in rigidly affixed to the inner surface of the flap post 1286 in such manner that its free vertical edge extends angularly toward the center of the tipover table 1064. This being an inherently weak attachment, it is strengthened by the addition of a flap web 1314 that extends the full length of the inner flap 1312, and is rigidly affixed between the outer surface of the flap post 1286 and the outboard edge of the inner flap 1312. The inner flap 1312 integrally incorporates a corrugated case retainer plate 1316, (FIG. 15), intended to reach into the top of the corrugated case 1126 and hold it open and square, as will be described hereinafter. The lower outboard portion of both the inner flap 1312 and the flap web 1314 incorporate a circular arc cutout 1318 that is necessary to permit the passage of the top of the corrugated case 1126 upon the tipover table 1064 and will likewise be described hereinafter.

OPERATION OF THE CASE PACKING ASSEMBLY

The case packing assembly 18 controls the packing machine 10 and is the machine/operator interface. Referring to FIG. 2, the tipover table 1064 is shown in the down or horizontal position by solid lines, and in the up or vertical position by double-dot-dash lines at 1064A. With the tipover table 1064 in the up position, the operator places the bottom of the corrugated case 1126 upon the bottom support assembly 1132. The corrugated case 1126 has an inboard/bottom flap 1320, an outboard/top flap 1322, an input side flap 1324, and an output side flap 1326. The operator in so placing the corrugated case 1126 upon the bottom support assembly 1132, tucks the inboard/bottom flap 1320 under the compoundly bent rod 1208 of the bottom flap holding assembly 1182 and pushes the corrugated case 1126 against the suction cup 1134 of the suction assembly 1128. The operator then depresses a push button switch SW-5B1 (FIG. 23) which activates the vacuum system of the suction assembly 1128, thereby retaining the corrugated case 1126 against the vertically disposed tipover table 1064, as will be explained more fully hereinafter. The case is slightly tilted upon the tipover table 1064 as shown in FIG. 2 because of the elevated position of the suction assembly 1128. The tipover cylinder 1102 is retracted, pivoting the tipover table 1064 and corrugated case 1126 to the horizontal position shown in full lines. As the corrugated case approaches the horizontal position, the flap pusher plate 1186 of the top flap guide assembly 1180 contacts the outboard/top flap 1322 and retains it in the acutely bent position shown in FIG. 2, which clears it from the guide plate assembly 782. The bottom edges of the input and output side flaps 1324 and 1326, respectively, are engaged by the flap web 1314 of the flap assembly 1214, and are forced outwardly at such an angle (FIG. 18) that they also clear the guide plate assembly 782. It should be noted here that the two corrugated case retainer plates 1316 extend slightly into the top opening of the corrugated case 1126, and the circular arc cutout 1318 provides free passage of the bottom inboard extremity thereof. As the tipover table 1064 comes to full down upon the down stop 1118 (FIG. 2), the limit switch LS-7 (FIG. 15) is operated, thus making the proper circuit that permits the adjustable number 2 pusher 32 to push. As the stack of cartons 357 moves laterally to the left of the packing machine 10, it is pushed downwardly to full compression by the pair of compressor rods 1010 so that the stack enters the corrugated case 1126. The end seam packing procedure compresses the stack of cartons 357 to a horizontal position as is shown in FIGS. 3 and 13. The side seam packing procedure is illustrated in FIGS. 2 and 18. Referring again to FIG. 18, the advancing stack of cartons 357B comes in contact with the inwardly facing surfaces of the two inner flaps 1312, rather close to their inboard edges. The advancing stack of cartons 357 forces the flap assembly 1214 open against the restoring tension of the two springs 1304, thus swinging the corrugated case retainer plates 1316 against the inside walls of the corrugated case 1126. This expands the sides of the box slightly, insuring that the advancing stack of cartons 357B will not collide with the top edges of the box and holds the case 1126 squarely open. As the stack of cartons 357B is fully inserted into the corrugated case 1126, the adjustable pusher 32 pauses briefly, as previously described, to dampen the rebound energy produced by collision with the bottom of the box and the bottom support assembly 1132. The limit switch LS-15 is actuated at the full stroke of the adjustable number 2 pusher 32 and makes the proper circuit that extends the cylinder rod 1112 of the tipover cylinder 1104, sending the tipover table 1064 back to its vertical position. As the tipover table 1064 reaches its full up position against the up stop 1122, the limit switch LS-8 is actuated. The filled case can now be removed from the packing machine 10 either manually or automatically. In the case of automatic extraction (not shown in detail), the limit switch LS-8 serves to initiate a removal cycle.

OPERATION

The operation of the machine will now be described with particular reference to FIG. 23, which shows electrical connections of the machine, and FIG. 24, which shows hydraulic connections.

Figure 23:
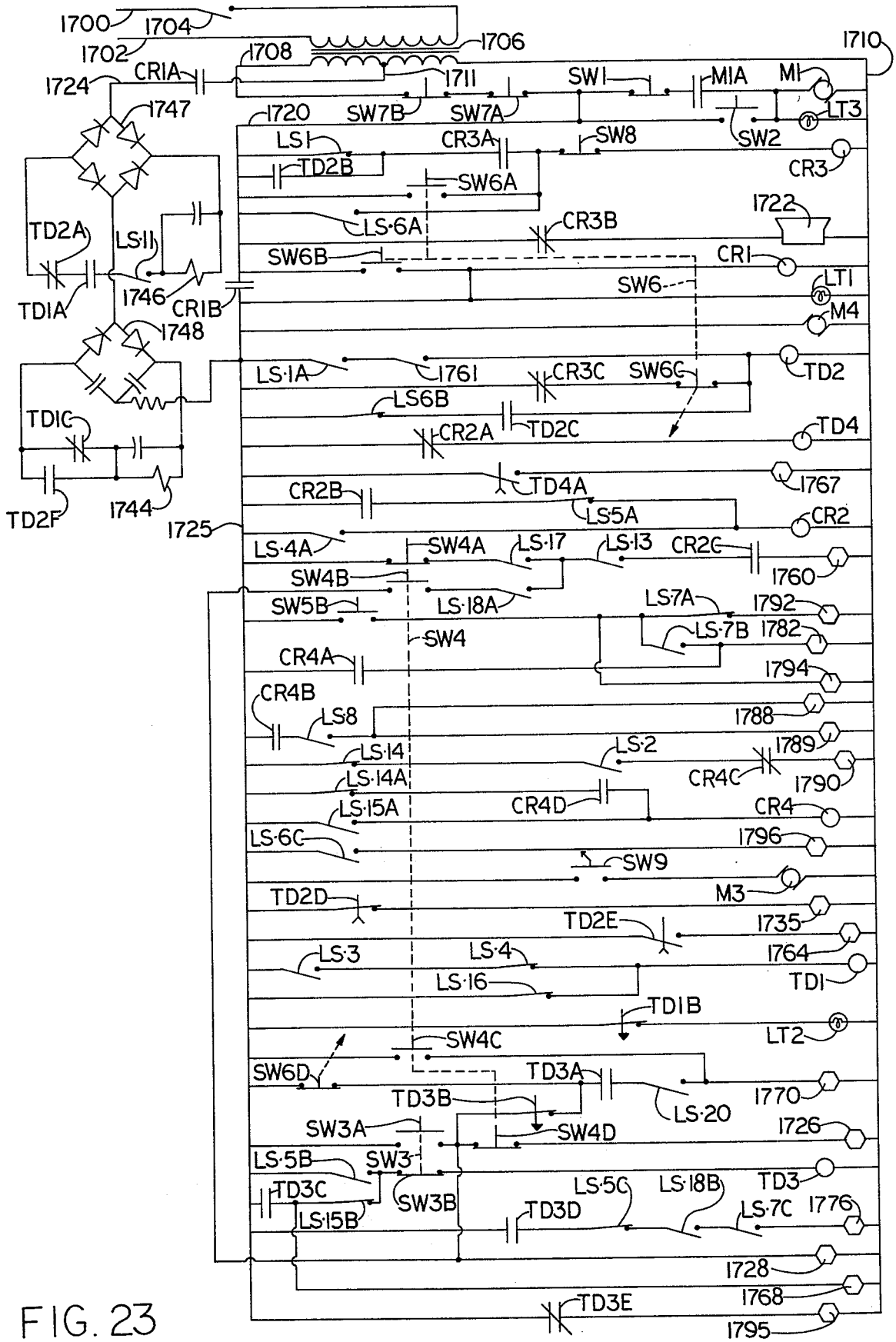
FIG. 23 is a schematic view of electrical connections of the machine.

Referring to FIG. 23, electrical power is supplied by line leads 1700 and 1702 through a line switch 1704 to a primary winding of a transformer 1706. The secondary winding of the transformer 1706 provides power across leads 1708 and 1710. A portion of the secondary winding of the transformer 1706 supplies power across the lead 1708 and a lead 1711. A hydraulic pump motor M-1 is energized when a push button switch SW-2 is closed. Motor relay contacts M-1A are closed when the motor M-1 is energized. A lamp LT-3 is illuminated when the motor M-1 is energized. The hydraulic pump motor M-1 can be stopped when a push button switch SW-1 is opened. The hydraulic pump motor M-1 drives a pump 1712 (FIG. 24) to supply hydraulic fluid under pressure from a tank 1714 to a pressure line 1716. Hydraulic fluid is returned to the tank 1714 through a return line 1718. A lead 1720 (FIG. 23) is normally connected to the lead 1708 through contacts of emergency stop switches SW-7A and SW-7B.

A discharge mode switch SW-4 is placed either in the position shown for end seam discharge, or in its other position for side seam discharge. In the position shown, contacts SW-4A are closed, contacts SW-4B and SW-4C are open, and contacts SW-4D are closed. The operation of the machine will be described with reference to the switch SW-4 in the position shown for end seam operation.

A control start push button switch SW-6 is actuated to close contacts SW-6A and SW-6B, to open contacts SW-6C and SW-6D. Closing of the contacts SW-6A energizes a control relay CR-3 to close hold-in contacts CR-3A and open contacts CR-3B and CR-3C thereof. The contacts CR-3B actuate an alarm 1722 when the control relay CR-3 is de-energized. Closing of the contacts SW-6B energizes a control relay CR-1 to close contacts CR-1A and CR-1B thereof. Closing of the contacts CR-1A connects a lead 1724 to the lead 1711. A lamp LT-1 is energized when the control relay CR-1 is energized. Closing of the contacts CR-1B connects a lead 1725 to the lead 1720.

An on-off switch SW-9 is placed in its other position to energize a conveyor drive motor M-3. As shown in FIGS. 1 and 11B, the motor M-3 drives on a drive pulley 2000 which drives a belt 2002 to drive a second drive pulley 2004. The pulleys 2000 and 2004 and the belt 2002 can form an adjustable speed drive for a shaft 2006 on which the pulley 2004 is mounted. The shaft 2006 also drives gearing (not shown in detail) in a gear housing 2008 to drive shaft 2010, which drives a sprocket 2012 to drive the drive chain 1498 and cause advance of the belt conveyor 107 and the nip rolls 42. The shaft 2006 also drives a clutch 2014 (FIG. 11B). When the clutch 2014 is actuated, a shaft 2015 is driven to drive gearing (not shown) in a gear box 2016 which drives a shaft 2018 to drive a sprocket 2020 and a chain 2021. The chain 2021 drives the main conveyor 1499. When the clutch 2014 is deactuated, a brake 2022 is actuated to prevent advance of the main conveyor 1499.

A push button reject switch SW-8 (FIG. 23) is opened to deenergize the control relay CR-3. Deenergizing of the control relay CR-3 causes closing of the contacts CR-3C to energize a time delay relay TD-2 to open contacts TD-2A, close contacts TD-2B and TD-2C, open delay contacts TD-2D, close delay contacts TD-2E, and open contacts td-2F. Closing of the contacts TD-2E energizes a solenoid 1764 to advance a valve 1766 to the right as shown in FIG. 24 to connect a line 1749 to the pressure line 1716 so that fluid flows through the hydraulic motor 252 to cause advance of the elevator flight assemblies 206 (FIGS. 5 and 6), the fluid returning through a line 1755. The elevator flight assemblies 206 advance until the limit switch LS-6 is actuated when one pair of the elevator flight assemblies 206 reaches its start position. When the limit switch LS-6 is actuated, contacts LS-6A close to energize the control relay CR-3 and contacts LS-6B open to deenergize the control relay TD-2.

A push button reset switch SW-3 is actuated to close contacts SW-3A and open contacts SW-3B. Closing of the contacts SW-3A energizes a turntable return solenoid 1726 and a number 2 pusher return solenoid 1728. The turntable return solenoid 1726 advances a valve 1730 to its other position, as shown in FIG. 24, to direct hydraulic fluid under pressure along a line 1732 to the hydraulic cylinder 734 (FIGS. 16 and 24) to cause extension of the cylinder rod 744 to return the turntable assembly 686 to its position for receiving a stack of articles. The hydraulic fluid returns through a line 1733 to the return line 1718. Energizing of the number 2 pusher return solenoid 1728 causes a spring returned valve 1736 to advance to the left to direct fluid under pressure along a line 1737 to the cylinder 964 (FIGS. 13 and 24) to retract the cylinder rod 970 and retract the number 2 pusher, the fluid returning along a line 1738 to the return line 1718. Throttle check valve units 1739 in the lines 1732, 1733, 1737 and 1738 permit control of the operation of the cylinders 734 and 964. Opening of the contacts SW-3B (FIG. 23) de-energizes a time delay relay TD-3 to open contacts TD-3A, to close delay contacts TD-3B after a time delay, and to open contacts TD-3C and TD-3D and close contacts TD-3E.

The time delay relay TD-2 is in de-energized position with contacts TD-2A closed, contacts TD-2B and TD-2C open, time delay TD-2D closed, time delay contacts TD-2E open, and contacts TD-2F open. Closing of the time delay contacts TD-2D energizes a solenoid 1735 which advances a valve 1740 (FIG. 24) to its oher position to direct fluid under pressure along a line 1742 to the rate valve 434.

The pusher number 1 is in retracted position and the limit switch LS-3 (FIGS. 4 and 23) is closed to energize a time delay relay TD-1 to close contacts TD-1A, to open time delay contacts TD-1B, and to open contacts TD-1C. Opening of contacts TD-1B de-energizes a lamp LT-2. Opening of contacts TD-1C de-energizes a brake solenoid 1744, and closing of the contacts TD-1A energizes a clutch solenoid 1746. The clutch solenoid 1746 actuates the clutch 2014 (FIG. 11B) to drive the drive chain 2021 (FIG. 8) to drive a main conveyor 1499 (FIG. 1), not shown in detail, which delivers cartons to the conveyor belt 107. A limit switch LS-11 (FIG. 23) not shown in detail, is closed when cartons are available for delivery by the main conveyor 1499. De-energizing of the brake solenoid 1744 releases the brake 2022 (FIG. 1). The conveyor belt 107 advances the cartons to the nip roll assembly 42 (FIG. 8) which drives the cartons beneath the sensing rollers 414.

Direct current for the clutch solenoid 1746 and the brake solenoid 1744 are supplied by rectifier networks 1747 and 1748, respectively. As the stack builds up under the sensing rollers 414, the rate valve 434 is caused to swing clockwise to connect the line 1742 through the line 1749, a pilot check valve 1750, a throttle check valve unit 1752, the hydraulic motor 252 (FIGS. 5 and 24), a throttle check valve unit 1754, the line 1755, a pilot check valve 1756 and check valve 1757, and a line 1758 to the rate valve 434 to be directed by the rate valve 434 to the return line 1718. The pilot check valve 1756 is controlled by pressure in the line 1742 and permits flow therethrough when there is pressure in the line 1742. The rate valve 434 controls the advance of the hydraulic motor 252 so that the level of the top of the stack 357 remains substantially constant as the stack builds up. If the stack moves downwardly too far, the rate valve 434 swings counterclockwise so that fluid is directed through the line 1758, a solenoid operated valve 1760, the pilot check valve 1756, the line 1755, the hydraulic motor 252, the pilot check valve 1750, the line 1749 and the rate valve 434 to the return line 1718. The pilot check valve 1750 permits flow when there is pressure in the line 1755. When the stack has reached a predetermined height, the contacts of the limit switch LS-16 open. If the contacts of the limit switch LS-3 (FIG. 1) are closed to indicate the first pusher assembly 26 is retracted and the contacts of the limit switch LS-4 are closed to indicate there is no stack at the bottom of the elevator, the opening of the contacts of the limit switch LS-16 has no effect.

When the height of the stack is a little less than that for a full count, the limit switch LS-1A is actuated. Thereafter, when a full count has been reached by a counting mechanism (not shown in detail) and a predetermined number of cartons has been delivered to the belt conveyor 107, a count switch 1761 closes to energize the time delay relay TD-2 to initiate a cycle of rapid descent of the elevator with the completed stack. Opening of the contacts TD-2A de-energizes the clutch solenoid 1746 and closing of the contacts TD-2F energizes the brake solenoid 1744 to actuate the brake 2022 (FIG. 1) to stop the delivery of cartons to the belt conveyor 107. The belt conveyor 107 continues to run to deliver cartons that are thereon to the stack. Closing of the contacts TD-2B provides a circuit which bypasses the contacts of the limit switch LS-1 so that, as the contacts of the limit switch LS-1 open as the stack is lowered further, there is no effect on the control relay CR-3. After a time delay, the contacts TD-2D open to de-energize the solenoid 1735 to permit the valve 1740 to return to the position shown in FIG. 24 so that pressure is no longer applied to the rate valve 434. After a time delay, the contacts TD-2E close to energize the solenoid 1764 to advance the valve 1766 to the right as shown in FIG. 24 to connect the line 1749 to the pressure line 1716 to cause continuous advance of the elevator and the stack downwardly. The time delay is sufficient to permit the cartons on the belt conveyor 107 to reach the stack.

As the elevator descends, the limit switch LS-4 (FIG. 5) is actuated to open the contacts thereof. The contacts of the limit switch LS-4 remain open until the number 1 pusher starts to advance the stack off the stack supports 308. If through failure of operation the stack is not advanced away from the actuator 356 (FIG. 5) of the limit switch LS-4 before the limit switch LS-16 is actuated, the time delay relay TD-1 is de-energized to stop delivery of cartons to the conveyor 107 (FIG. 1). Closing of the contacts TD-1B energizes the lamp LT-2.

As the stack descends further onto the stack supports 308 (FIG. 6), the limit switch LS-4A is actuated to close the contacts thereof and energize a control relay CR-2. Energizing of the control relay CR-2 opens contacts CR-2A to de-energize a time delay relay TD-4, closes hold-in contacts CR-2B and closes contacts CR-2C. DE-energizing of the time delay relay TD-4 opens contacts TD-4A thereof.

Closing of the contacts CR-2C energizes a solenoid 1760 when the limit switch LS-17 (FIG. 15) is closed to indicate the turntable 772 is in stack receiving position and the limit switch LS-13 (FIG. 13) is closed to indicate the number 2 pusher is retracted. The solenoid 1760 advances a valve 1762 to the right as shown in FIG. 24 to direct fluid under pressure along a line 1764 to the number 1 pusher cylinder 642 (FIG. 11) to advance the stack from the elevator to the turntable 772 (FIG. 3), the fluid returning through a line 1765 to the return line 1718. When the number 1 pusher is fully advanced, the limit switch LS-5 is actuated to open contacts LS-5A, to close contacts LS-5B and to open contacts LS-5C. Opening of the contacts LS-5A de-energizes the control relay CR-2 to permit closing of the contacts CR-2A to energize the time delay relay TD-4 and cause closing of the contacts TD-4A thereof after a time delay to energize a solenoid 1767 which advances the valve 1762 to the left to direct the fluid under pressure along the line 1765 to cause retraction of the piston rod 640 of the cylinder 642 and cause retraction of the number 1 pusher 26. Closing of the contacts LS-5B energizes the time delay relay TD-3. Contacts TD-3C close to energize a solenoid 1768 which actuates a valve (not shown) to direct air under pressure to a lower end of the compressor cylinder 1044 (FIG. 13) to cause lowering of the compressor bars 1010 to stack compressing position. Closing of the contacts TD-3A energizes a solenoid 1770 when the number 1 pusher is sufficiently retracted to actuate the limit switch LS-20.

Figure 24:
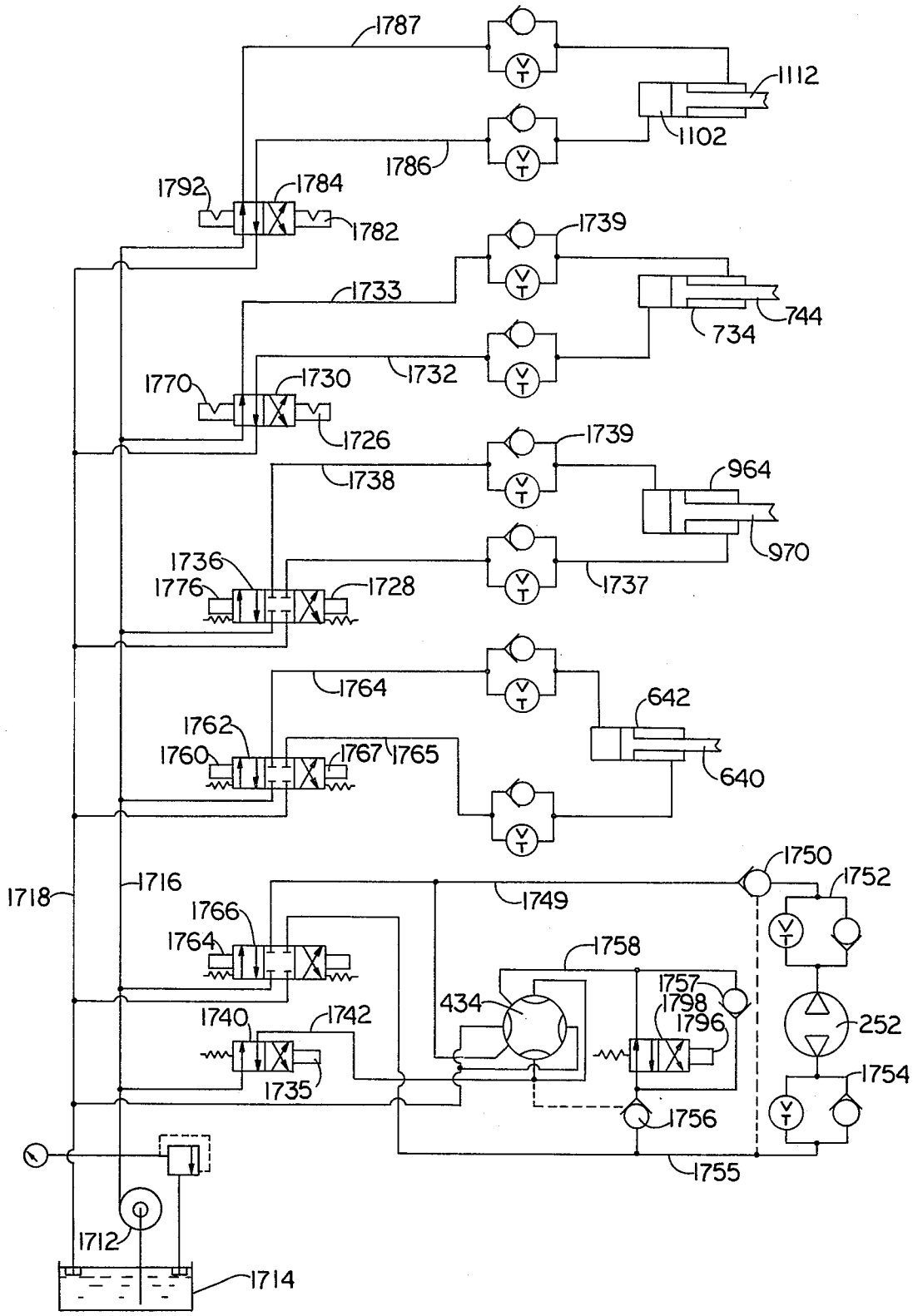
FIG. 24 is a schematic view of hydraulic connections of the machine.

When the solenoid 1770 is energized, the valve 1730 moves to the position shown in FIG. 24 at which fluid under pressure is directed along the line 1733 to the table turning cylinder 734 to rotate the turntable 772 to the position shown in FIG. 2 ready for action of the number 2 pusher assembly 32. When the turntable 772 reaches its fully turned position, the limit switch LS-18 (FIG. 13) is actuated to close contacts LS-18A and LS-18B thereof. Closing of the contacts LS-18B energizes a solenoid 1776 if contacts LS-7C of the limit switch LS-7 are closed. Energizing of the solenoid 1776 advances the valve 1736 to the right to direct fluid under pressure along the line 1738 to the cylinder 964 (FIG. 13) to advance the number 2 pusher assembly 32 to advance the stack from the turntable 772 into the case 1126 (see FIG. 2).

When the number 2 pusher is fully extended, the limit switch LS-15 is actuated to close contacts LS-15A and open contacts LS-15B. Closing of the contacts LS-15A energizes a control relay CR-4 to close contacts CR-4A and CR-4B, to open contacts CR-4C and to close contacts CR-4D. Closing of the contacts CR-4A energizes a solenoid 1782 to advance a valve 1784 to its other position and direct fluid under pressure along a line 1786 to the cylinder 1102 so that the tip-over rack 38 is advanced to the double-dot-dash line position of FIG. 2, the fluid returning from the cylinder 1102 through a line 1787. When the tip-over rack 38 is in this position, the limit switch LS-8 is actuated to close the contacts thereof. Closing of the contacts of the limit switch LS-8 energizes solenoids 1788 and 1789. The solenoid 1788 operates a vacuum valve, not shown in detail, which disconnects the vacuum cup 1134 from a source of vacuum so that the case can be removed from the tip-over rack. The solenoid 1789 can actuate mechanism, not shown, which can remove the case from the tip-over rack. Opening of the contacts CR-4C de-energizes a solenoid 1790 which is part of the mechanism (not shown) for removing the case from the tip-over rack 38. Limit switches LS-2, LS-14 and LS-14A can also be parts of the mechanism (not shown) for removing the case from the tip-over rack 38. The contacts LS-14A can open when the mechanism for removing the case has discharged the case, de-energizing the control relay CR-4. Opening of the contacts LS-15B de-energizes the time delay relay TD-3 to close the contacts TD-3E and energize a solenoid 1795 which actuates an air valve (not shown) to direct air under pressure to the upper end of the compressor cylinder 1044 to cause raising of the compression bars 1010. When the case has been removed, the operator places a new case on the tip-over rack 38 and closes contacts of a push button switch SW-5B to energize a solenoid 1792 to advance the valve 1784 to the position as shown in FIG. 24 to direct fluid under pressure along the line 1787 to the cylinder 1102 to return the tip-over rack 38 to the full line position of FIG. 2. Closing of the contacts of the push button switch SW-5B also energizes a solenoid 1794 which actuates a vacuum valve (not shown) to connect the vacuum cup 1134 to the source of vacuum so that the case is held on the tip-over rack 38. When the tip-over rack 38 is in the full line position of FIG. 2, the limit switch LS-7 (FIG. 15) is actuated to open contacts LS-7A and close contacts LS-7B and LS-7C.

While the first stack is being pushed by the number 1 pusher, the elevator continues to advance until the limit switch LS-6 (FIG. 6) is actuated to indicate the elevator is in position for starting a new stack. When the limit switch LS-6 is actuated, the contacts LS-6A close to provide a circuit energizing the control relay CR-3, the contacts LS-6B open to de-energize the control relay TD-2 and the contacts LS-6C close to energize a solenoid 1796. De-energizing of the time delay relay TD-2 energizes the clutch solenoid 1746 to start discharge of cartons to the belt conveyor 107 and connects the rate valve 434 to the source of pressure as already described. Energizing of the solenoid 1796 advances a valve 1798 to its other position to prevent reverse movement of the elevator under control of the rate valve 434 until the new stack has started to form and the limit switch LS-6 is released. Thus, the new stack starts forming while the first stack is being discharged. If for some reason, the new stack reaches a height such that the elevator actuates the limit switch LS-16 before the number 1 pusher has advanced to remove the stack from the elevator to release the limit switch LS-4 and has returned to retracted position to close the contacts of the limit switch LS-3, opening of the contacts of the limit switch LS-16 de-energizes the time delay relay TD-1 to stop flow of cartons until the limit switches LS-3 and LS-4 close to energize the time delay relay TD-1 again.

When the machine is to be operated in a side seam discharge mode, the switch SW-4 is positioned in its other position, and the machine operated in substantially the same manner except that the turntable 772 does not turn, and the turntable 772 is held in the position shown in FIG. 18 by action of the contacts SW-4C which energize the solenoid 1770 to maintain the valve 1730 in the position shown in FIG. 24.

The machine illustrated in the drawings and described above is subject to structural modification without departing from the spirit and scope of the appended claims.

Having described our invention, what we claim as new and desire to secure by letters patent is:

1. A machine for arranging flat articles in a stack which comprises means for delivering articles to a stack forming station, endless flight supports mounted on opposite sides of the stack forming station, opposed flights mounted on the flight supports for supporting a stack of the articles therebetween, stack support means below the stack forming station, means for lowering the flights as the stack builds up thereon until a complete stack has been formed and for lowering the complete stack onto the stack support means, the flights passing the stack support means to return to the stack forming station, means for advancing the complete stack from the stack support means as the flights return, a table, a rug mounted on the table with a pile face of the rug exposed and aligned with the stack support means, the stack advancing means advancing the stack from the stack support means onto the pile face of the rug, side guides, side guide supports above the side guides for supporting the side guides substantially parallel to and on opposite sides of the path of stack advance from the stack support means, resilient means connecting the side guide supports to the side guides to resiliently support the side guides, and means releasably clamping lower edge portions of the side guides against the pile face of the rug on opposite sides of the path of stack advance.

2. A machine as in claim 1 wherein there are opposed second flights mounted on the flight supports and a second stack starts to form on the second flights as the stack advancing means advances the complete stack from the stack support means and returns to a position for engaging the second stack when the second stack reaches the stack support means.

3. A machine as in claim 1 wherein the articles are advanced to the stack forming station in a shingle formation.

4. A machine as in claim 3 wherein there is means for arresting delivery of articles as the complete stack is being lowered onto the stack support means.

5. A machine as in claim 1 wherein the side guide supports are mounted on the table, and the machine includes upright pivot means supporting the table, means for turning the table so that the side guides extend transversely of the path of stack advance from the stack supports, and pusher means for discharging the stack from the table transversely of the path of stack advance from the stack support means.

6. A machine as in claim 5 wherein the pusher means is mounted on and turns with the table.

7. A machine as in claim 5 which includes a case support for supporting a case with an open end in the path of discharge of the stack from the table.

8. A machine as in claim 7 wherein the case support includes an angle-shaped case supporting frame and the machine includes means for swinging the case supporting frame through an angle of approximately 90 degrees when the stack has been discharged into the case to position the case with the open end up.

9. A machine as in claim 5 which includes a stack compressing member mounted on the table and means for lowering the stack compressing member against the top of the stack when the stack is on the table to hold the stack in compressed position while the table turns and while the stack is discharged from the table.

10. A machine for placing a stack of articles in a case which comprises stack support means, means for depositing the stack on the stack support means, a table adjacent the stack support means, a rug mounted on the table with a pile face of the rug exposed and aligned with the stack support means, means for advancing the stack from the stack support means onto the pile face of the rug, pusher means for discharging the stack from the table crosswise of the path of stack advance from the stack support means, and a case support for supporting a case with an open end in the path of discharge of the stack from the table.

11. A machine as in claim 10 which includes means for mounting the table for swinging about a vertical axis and means for swinging the table through an angle of approximately 90 degrees when the stack is on the table.

12. A machine as in claim 11 which includes side guides, side guide supports mounted on the table above the side guides for supporting the side guides substantially parallel to and on opposite sides of the path of stack advance from the stack support means, resilient means connecting the side guide supports to the side guides to resiliently support the side guides, and means releasably clamping lower edge portions of the side guides against the pile face of the rug on opposite sides of the path of stack advance.

13. A machine as in claim 11 wherein the pusher means is mounted on and turns with the table.

14. A machine as in claim 11 wherein the case support includes an angle-shaped case supporting frame and the machine includes means for swinging the case supporting frame through an angle of approximately 90 degrees when the stack has been discharged into the case to position the case with the open end up.

15. A machine as in claim 11 which includes a stack compressing member mounted on the table and means for lowering the stack compressing member against the top of the stack when the stack is on the table to hold the stack in compressed position while the table turns and while the stack is discharged from the table.

16. A machine for handling a stack of articles which comprises a table, a rug mounted on the table with a pile face of the rug exposed, side guide support means mounted above the table, side guide means resiliently mounted on the side guide support means, means for releasably clamping lower edge portions of the side guide means against the pile face of the rug in selected position, means for advancing the stack onto the rug of the table in position to be guided by the side guide means, and means for discharging the stack from the table.

17. A machine as in claim 16 which includes means for advancing the side guide support means parallel to the table when the lower edge portions of the side guide means are released.

18. A machine as in claim 16 which includes upright pivot means supporting the table and means for turning the table when the stack has been advanced onto the table so that the stack is discharged transversely of the direction of advance of the stack onto the table.

19. A machine as in claim 16 wherein there is stack compressor means mounted above the table and means for lowering the compressor means against the stack to compress the stack when the stack has been advanced onto the table.

* * * * *